US009946175B2

(12) United States Patent
Nakata et al.

(10) Patent No.: US 9,946,175 B2
(45) Date of Patent: Apr. 17, 2018

(54) ELECTROPHOTOGRAPHIC PHOTOSENSITIVE MEMBER, PROCESS CARTRIDGE, ELECTROPHOTOGRAPHIC APPARATUS, AND CONDENSED POLYCYCLIC AROMATIC COMPOUND

(71) Applicant: CANON KABUSHIKI KAISHA, Tokyo (JP)

(72) Inventors: Koichi Nakata, Tokyo (JP); Shinji Takagi, Yokohama (JP); Yuzo Tokunaga, Chiba (JP); Masaki Nonaka, Toride (JP); Ryoichi Tokimitsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/128,914

(22) PCT Filed: Mar. 23, 2015

(86) PCT No.: PCT/JP2015/059823

§ 371 (c)(1),
(2) Date: Sep. 23, 2016

(87) PCT Pub. No.: WO2015/147315

PCT Pub. Date: Oct. 1, 2015

(65) Prior Publication Data

US 2017/0108789 A1 Apr. 20, 2017

(30) Foreign Application Priority Data

Mar. 28, 2014 (JP) ..... 2014-069580
Mar. 17, 2015 (JP) ..... 2015-053017

(51) Int. Cl.
*G03G 5/047* (2006.01)
*G03G 5/07* (2006.01)
(Continued)

(52) U.S. Cl.
CPC ..... *G03G 5/07* (2013.01); *G03G 5/0603* (2013.01); *G03G 5/0605* (2013.01); *G03G 5/0609* (2013.01); *G03G 21/18* (2013.01)

(58) Field of Classification Search
CPC .. G03G 5/0601; G03G 5/0603; G03G 5/0605; G03G 5/0607
See application file for complete search history.

(56) References Cited

U.S. PATENT DOCUMENTS

2006/0147703 A1 7/2006 Walker, Jr.
2010/0264367 A1* 10/2010 Inagaki ..... C09K 19/32 252/299.61

FOREIGN PATENT DOCUMENTS

JP 10-310606 A 11/1998
JP 11-149821 A 6/1999
(Continued)

*Primary Examiner* — Peter L Vajda
(74) *Attorney, Agent, or Firm* — Canon U.S.A. Inc., IP Division

(57) ABSTRACT

To provide an electrophotographic photosensitive member which satisfies abrasion resistance and electrical properties and which is difficult to cause image deletion. A surface layer of the electrophotographic photosensitive member of this invention contains a polymerized product of a hole transporting compound having a polymerizable functional group, in which the hole transporting compound is at least one compound selected from the group consisting of:

a compound consisting of one or more carbon atoms, one or more hydrogen atoms, and one or more halogen atoms; and a compound consisting of one or more carbon atoms, one or more hydrogen atoms, one or more oxygen atoms, and one or more halogen atoms.

8 Claims, 1 Drawing Sheet

(51) Int. Cl.
*G03G 21/18* (2006.01)
*G03G 5/06* (2006.01)

(56) References Cited

FOREIGN PATENT DOCUMENTS

| | | | |
|---|---|---|---|
| JP | 2006-307150 | A | 11/2006 |
| JP | 2007-11005 | A | 1/2007 |
| JP | 2007-231193 | A | 9/2007 |
| JP | 2007-272191 | A | 10/2007 |
| JP | 2007-272192 | A | 10/2007 |
| JP | 2007-279678 | A | 10/2007 |
| JP | 2011-105643 | A | 6/2011 |
| WO | 2008-136265 | A1 | 11/2008 |

* cited by examiner

ELECTROPHOTOGRAPHIC PHOTOSENSITIVE MEMBER, PROCESS CARTRIDGE, ELECTROPHOTOGRAPHIC APPARATUS, AND CONDENSED POLYCYCLIC AROMATIC COMPOUND

CROSS-REFERENCE TO RELATED APPLICATIONS

This application is a National Stage filing of International Application No. PCT/JP2015/059823 filed Mar. 23, 2015, which claims the benefit of Japanese Patent Application No. 2014-069580, filed Mar. 28, 2014, and Japanese patent application No. 2015-053017, filed Mar. 17, 2015, the disclosures of each of which are hereby incorporated by reference herein in their entirety.

TECHNICAL FIELD

The present invention relates to an electrophotographic photosensitive member and a process cartridge and an electrophotographic apparatus having an electrophotographic photosensitive member. The present invention also relates to a novel condensed polycyclic aromatic compound.

BACKGROUND ART

To a surface layer of an electrophotographic photosensitive member, a stress caused by electrophotographic processes, such as a charging process, an exposure process, a development process, a transfer process, and a cleaning process, has been repeatedly applied. Therefore, the surface layer of the electrophotographic photosensitive member has been required to have abrasion resistance and chemical stability.

Methods for increasing the abrasion resistance of the surface layer of the electrophotographic photosensitive member include a method for blending a polymerized product of a hole transporting compound (hole transportation substance) in the surface layer of the electrophotographic photosensitive member. The polymerized product of the hole transporting compound is a kind of curable resin.

However, when a high abrasion-resistant surface layer is provided, the surface layer is difficult to be abraded, so that the surface of the surface layer is difficult to be refreshed, which is likely to cause accumulation of chemical deteriorated-substances on the surface of the surface layer. The chemical deteriorated-substances mainly include those formed by a chemical change of the polymerized product of the hole transporting compound due to the repeated application of the stress by the electrophotographic processes described above.

The chemical change of the polymerized product of the hole transporting compound sometimes may cause a phenomenon in which an image (electrophotographic image) output in a high humidity environment, particularly, in a high temperature and high humidity environment becomes unclear (hereinafter also referred to as "image deletion").

Therefore, in order to suppress the image deletion, it has been required to suppress the chemical change of the polymerized product of the hole transporting compound.

Techniques for suppressing the chemical degradation of the hole transporting compound include a technique for blending additives in the surface layer of the electrophotographic photosensitive member together with the polymerized product of the hole transporting compound.

PTL 1 discloses a technique for suppressing the image deletion by blending a specific fluorine atom containing monomer having a polymerizable functional group in a surface layer of an electrophotographic photosensitive member.

PTLs 2, 3, and 4 disclose a technique for suppressing the image deletion by blending a specific amine compound in a surface layer of an electrophotographic photosensitive member.

However, the technique using additives disclosed in each patent literature described above is a technique for reducing the stress to be applied to the polymerized product of the hole transporting compound and is not a technique for increasing the chemical stability of the hole transporting compound itself.

In recent years, an increase in the durability of the electrophotographic photosensitive member has noticeably proceeded and a technique for suppressing the image deletion has been further demanded. In order to further suppress the image deletion, it has been required to not only reduce the above-described stress but increase the chemical stability of the hole transporting compound itself.

CITATION LIST

Patent Literature

PTL 1 Japanese Patent Laid-Open No. 2007-11005
PTL 2 Japanese Patent Laid-Open No. 2007-272191
PTL 3 Japanese Patent Laid-Open No. 2007-272192
PTL 4 Japanese Patent Laid-Open No. 2007-279678

SUMMARY OF INVENTION

The present invention provides an electrophotographic photosensitive member that has high abrasion resistance and that is difficult to cause image deletion and a process cartridge and an electrophotographic apparatus having the electrophotographic photosensitive member.

The present invention also provides a condensed polycyclic aromatic compound with high chemical stability.

According to an aspect of the present invention, there is provided an electrophotographic photosensitive member having a support and a photosensitive layer provided on the support, in which a surface layer of the electrophotographic photosensitive member contains a polymerized product of a hole transporting compound having a polymerizable functional group, and the hole transporting compound is at least one compound selected from the group consisting of: a compound consisting of one or more carbon atoms, one or more hydrogen atoms, and one or more halogen atoms; and a compound consisting of one or more carbon atoms, one or more hydrogen atoms, one or more oxygen atoms, and one or more halogen atoms.

According to another aspect of the present invention, there is provided a process cartridge that integrally supports the electrophotographic photosensitive member and at least one device selected from the group consisting of a charging device, a developing device, a transfer device, and a cleaning device, and that is detachably mountable to a main body of an electrophotographic apparatus.

According to another aspect of the present invention, there is provided an electrophotographic apparatus having the electrophotographic photosensitive member, a charging device, an exposing device, a developing device, and a transfer device.

According to another aspect of the present invention, there is provided a condensed polycyclic aromatic compound containing one of an acryloyloxy group and a methacryloyloxy group, in which the condensed polycyclic aromatic compound is at least one compound selected from the group consisting of: a compound consisting of one or more carbon atoms, one or more hydrogen atoms, and one or more halogen atoms; and a compound consisting of one or more carbon atoms, one or more hydrogen atoms, one or more oxygen atoms, and one or more halogen atoms.

Further features of the present invention will become apparent from the following description of exemplary embodiments with reference to the attached drawings.

DESCRIPTION OF EMBODIMENTS

Figure 1:
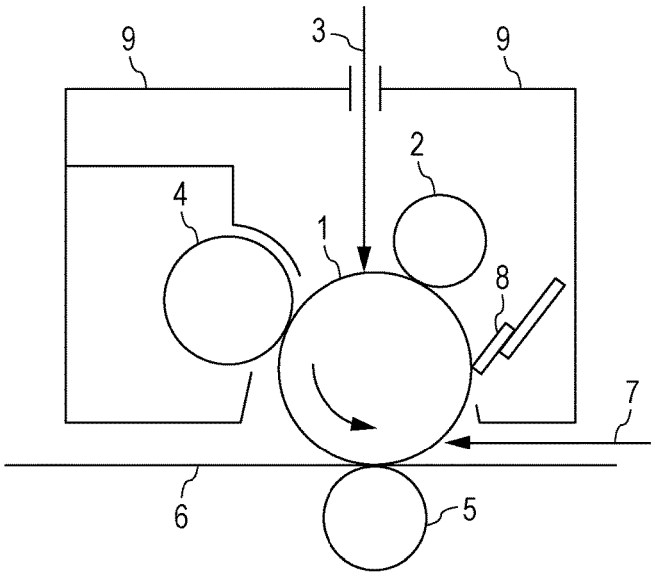
FIG. 1 is a view illustrating an example of an electrophotographic apparatus.

In an electrophotographic photosensitive member of the present invention, a surface layer contains a polymerized product of a hole transporting compound having a polymerizable functional group, and the hole transporting compound has a structure consisting of one or more carbon atoms, one or more hydrogen atoms, and one or more halogen atoms or a structure consisting of one or more carbon atoms, one or more hydrogen atoms, one or more oxygen atoms, and one or more halogen atoms. Hereinafter, the hole transporting compound (hole transportation substance) having a polymerizable functional group having the above-described features is also referred to as a "hole transporting compound according to the present invention". The polymerizable functional group is a kind of reactive functional group.

The present inventors have conducted an examination, and then have obtained a finding that a chemical change of an arylamine structure of a hole transporting compound which has been frequently used for a surface layer of a former electrophotographic photosensitive member is one of the causes of the image deletion. Then, the present inventors have searched for a hole transporting compound for electrophotographic photosensitive member which does not have the arylamine structure based on the obtained finding, and have accomplished the present invention.

As the hole transporting compound for electrophotographic photosensitive member, an arylamine compound having hole transportation ability has been frequently used. By evaluating the electrical properties, such as residual potential and sensitivity, of an electrophotographic photosensitive member, the degree of the hole transportation ability of the hole transporting compound can be measured.

It is considered that the hole transportation ability of the arylamine compound is developed by electron donation properties of an arylamine part. It is considered that the electron donation properties are demonstrated by an interaction of a nitrogen atom and a group (aryl group and the like) containing a carbon atom group having an sp2 hybrid orbital (sp2 electron orbital) around the nitrogen atom. Hereinafter, the carbon atoms having the sp2 hybrid orbital are also referred to as "sp2 carbon atoms".

On the other hand, it is considered that the arylamine part of the arylamine compound is easily chemically reacted because holes are actively transferred through a repetition of electrophotographic processes. In particular, the arylamine part tends to be likely to cause changes, such as oxidization, due to the discharge energy in a charging process and the action of a discharge product (oxidant), such as ozone, generated by the discharge. As a result, the present inventors assume that the chemical change of the arylamine part is caused.

As a result of an examination, the present inventors have obtained a finding that, by the use of the polymerized product of the hole transporting compound according to the present invention for the surface layer of the electrophotographic photosensitive member, the abrasion resistance and the electrical properties of the electrophotographic photosensitive member are improved and further an effect of suppressing the image deletion is obtained. As the reason therefor, the present inventors assume that the hole transporting compound according to the present invention does not have the arylamine structure and particularly does not contain a nitrogen atom, and therefore is more difficult to chemically change than an arylamine compound.

The hole transporting compound according to the present invention has a halogen atom. The present inventors assume that, due to the presence of the halogen atom, an interaction with the discharge product decreases, so that the chemical change is further suppressed. In particular, the present inventors assume that when the halogen atom is a fluorine atom, the carbon-fluorine bond energy is high, and therefore the durability (degradation resistance) to the chemical change of the hole transporting compound improves, so that the chemical stability becomes higher.

Therefore, from the viewpoint of the effect of suppressing the chemical change, the hole transporting compound according to the present invention suitably has a fluorine atom or an alkyl fluoride group.

In the hole transporting compound according to the present invention, a structure other than the polymerizable functional group preferably has a conjugated structure containing continuously bonded 24 or more sp2 carbon atoms from the viewpoint of developing sufficient hole transportation ability. More preferably, the structure other than the polymerizable functional group has a conjugated structure containing continuously bonded 28 or more sp2 carbon atoms.

The conjugated structure preferably has a condensed polycyclic structure containing continuously bonded 12 or more sp2 carbon atoms. From the viewpoint of developing better hole transportation ability, the number of the sp2 carbon atoms forming one condensed polycyclic structure is preferably 14 or more and more preferably 16 or more. On the other hand, from the viewpoint of ease of the formation of the surface layer, compatibility with other materials, and the like, the number of the sp2 carbon atoms forming one condensed polycyclic structure is preferably 20 or less and more preferably 18 or less.

The total number of the sp2 carbon atoms of the hole transporting compound according to the present invention is preferably 120 or less and more preferably 60 or less from the viewpoint of ease of the formation of the surface layer, compatibility with other materials, film strength of the surface layer, and the like.

The conjugated structure refers to a structure in which the sp2 carbon atoms are continuously bonded. The conjugated structure has a property of promoting delocalization of electrons in molecules and facilitating transfer of charges between molecules. The condensed polycyclic structure in the present invention refers to a structure in which two or more ring structures, such as a benzene ring, are adjacent to each other. From the viewpoint of developing better hole transportation ability, the condensed polycyclic structure is preferably a structure in which three or more ring structures are adjacent to each other. On the other hand, the condensed polycyclic structure is preferably a structure in which six or less ring structures are adjacent to each other and more preferably a structure in which five or less ring structures are adjacent to each other from the viewpoint of ease of the formation of the surface layer, flexibility of molecules, and the like. A structure in which four or less ring structures are adjacent to each other is more suitable.

In the condensed polycyclic structure, it is suitable that the conjugated structure planarly spreads. In order to form the planarly spreading conjugated structure, it is suitable that the condensed polycyclic structure is constituted by a 5-membered ring and/or a 6-membered ring.

The hole transporting compound according to the present invention has one or more units (one or more) of condensed polycyclic structures as a partial structure. From the viewpoint of developing better hole transportation ability, the hole transporting compound according to the present invention preferably has two or more units and more preferably three or more units of the condensed polycyclic structures in one molecule. On the other hand, in the hole transporting compound according to the present invention, the number of the condensed polycyclic structures in one molecule is preferably 10 units or less and more preferably 4 units or less.

When the hole transporting compound according to the present invention has two or more units of the condensed polycyclic structures, it is suitable that the condensed polycyclic structures are bonded to each other through a single bond, i.e., the condensed polycyclic structures are directly bonded, from the viewpoint of the chemical stability of the hole transporting compound.

The condensed polycyclic structure includes structures, such as fluorene, anthracene, phenanthrene, fluoranthene, and pyrene, for example. Among the above, the fluorene structure, the anthracene structure, and the pyrene structure are suitable from the viewpoint of the hole transportation ability and the suppression of image deletion.

The condense polycyclic structure may have a substituent.

The number of the sp2 carbon atoms of the hole transporting compound according to the present invention does not include the sp2 carbon atoms contained in the polymerizable functional group. For example, the number of the sp2 carbon atoms of the hole transporting compound according to the present invention does not include sp2 carbon atoms in a double bond contained in an acryloyloxy group or a methacryloyloxy group which is an example of the polymerizable functional group and sp2 carbon atoms in a carbonyl group.

The surface layer of the electrophotographic photosensitive member of the present invention contains the polymerized product of the hole transporting compound having the polymerizable functional group. The polymerized product is obtained by a reaction (polymerization reaction and a reaction of bonding molecules through a covalent bond) of the polymerizable functional group. Polymerization manners include chain polymerization, sequential polymerization, and the like. Radical polymerization, cationic polymerization, and anionic polymerization are included in the chain polymerization. Polycondensation, polyaddition, and addition condensation are included in the sequential polymerization. The polymerizable functional group refers to a functional group (reactive functional group) to be subjected to the polymerization manners.

The polymerizable functional group includes groups shown below, for example.

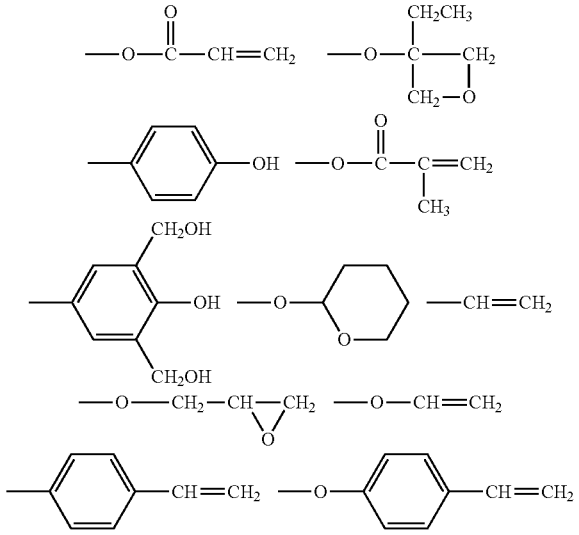

From the viewpoint of the abrasion resistance of the surface layer of the electrophotographic photosensitive member, the polymerizable functional group is suitably a chain polymerizable functional group (radically polymerizable functional group), such as an acryloyloxy group (first row in the left column in the groups shown above) and a methacryloyloxy group (second row in the left column in the groups shown above).

Two or more kinds of the polymerizable functional groups may be contained in one molecule of the hole transporting compound or polymerizable functional groups different in molecules may be contained.

Methods for performing a polymerization reaction of the polymerizable functional group include, for example, a method for imparting energy of light (ultraviolet rays and the like), radiations (electron beam and the like), heat, and the like to the polymerizable functional group, a method for causing auxiliary agents, such as a polymerization initiator, and compounds, such as acid, alkali, and a complex, to coexist, a method in which the above-described methods are combined, and the like.

In the hole transporting compound according to the present invention, a compound in which the polymerizable functional group in the hole transporting compound is replaced by a hydrogen atom is suitably a compound represented by the following formula (1).

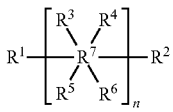

(1)

In the formula (1) above, $R^1$ to $R^6$ each independently represent a hydrogen atom, a halogen atom, a substituted or unsubstituted alkyl group, a substituted or unsubstituted cycloalkyl group, a substituted or unsubstituted alkoxy group, a substituted or unsubstituted aralkyl group, or a substituted or unsubstituted aryl group. $R^7$ is a hexavalent group derived by removing six hydrogen atoms from substituted or unsubstituted arene. Hereinafter, the group is also referred to as a "hexavalent group derived from arene". n is an integer of 1 or more and 10 or less. When n is 2 or more and 10 or less, a partial structure represented by the following formula (2) in the formula (1) above may be the same or different.

(2)

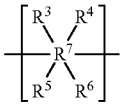

In the formula (2) above, $R^3$ to $R^7$ are the same as $R^3$ to $R^7$ of the formula (1) above, respectively.

The molecular structure of the hole transporting compound according to the present invention can be roughly classified into the polymerizable functional group and a structure other than the polymerizable functional group.

The polymerizable functional group includes, for example, the polymerizable functional groups shown above.

The structure other than the polymerizable functional group refers to a structure in which the polymerizable functional group is removed from the molecular structure of the hole transporting compound. Herein, when the polymerizable functional group is simply removed from the molecular structure of the hole transporting compound, a portion (bond part) bonded with the polymerizable functional group in the structure other than the polymerizable functional group is left. A structure in which a hydrogen atom is bonded to the left bond part is the "compound in which the polymerizable functional group in the hole transporting compound is replaced by a hydrogen atom" described above.

The halogen atom includes a fluorine atom, a chlorine atom, a bromine atom, an iodine atom, and the like, for example.

The alkyl group includes, for example, methyl groups, ethyl groups, propyl groups (an n-propyl group and an isopropyl group), butyl groups (an n-butyl group, an isobutyl group, a sec-butyl group, and a tert-butyl group), pentyl groups (an n-pentyl group, an isopentyl group, a neopentyl group, and a tert-pentyl group) hexyl groups (an n-hexyl group, a 1-methylpentyl group, a 4-methyl-2-pentyl group, a 3,3-dimethyl butyl group, a 2-ethyl butyl group, and the like), heptyl groups (an n-heptyl group, a 1-methylhexyl group, and the like), octyl groups (an n-octyl group, a tert-octyl group, a 1-methylheptyl group, a 2-ethylhexyl group, a 2-propylpentyl group, and the like), nonyl groups (an n-nonyl group, a 2,2-dimethylheptyl group, a 2,6-dimethyl-4-heptyl group, a 3,5,5-trimethylhexyl group, and the like), decyl groups (an n-decyl group and the like), undecyl groups (an n-undecyl group, a 1-methyldecyl group, and the like), dodecyl groups (an n-dodecyl group and the like), tridecyl groups (an n-tridecyl group, a 1-hexylheptyl group, and the like), tetradecyl groups (an n-tetradecyl group and the like), pentadecyl groups (an n-pentadecyl group and the like), hexadecyl groups (an n-hexadecyl group and the like), heptadecyl groups (an n-heptadecyl group and the like), octadecyl groups (an n-octadecyl group and the like), eicosyl groups (an n-eicosyl group and the like), and the like.

The cycloalkyl group includes, for example, a cyclopentyl group, a cyclohexyl group, a cyclohexyl methyl group, a 4-tert-butyl cyclohexyl group, a cycloheptyl group, a cyclooctyl group, and the like.

The alkoxy group includes, for example, methoxy groups, ethoxy groups, propoxy groups (an n-propoxy group and an isopropoxy group), butoxy groups (an n-butoxy group, an isobutoxy group, a sec-butoxy group, and a tert-butoxy group), pentyloxy groups (an n-pentyloxy group and the like), hexyloxy groups (an n-hexyloxy group and the like), and the like.

The aralkyl group includes, for example, a benzyl group, a phenethyl group, an α-methylbenzyl group, an α,α-dimethylbenzyl group, a 1-naphthyl methyl group, a 2-naphthyl methyl group, an anthracenyl methyl group, a phenanthrenyl methyl group, a pyrenyl methyl group, a furfuryl group, a 2-methylbenzyl group, a 3-methylbenzyl group, a 4-methylbenzyl group, a 4-ethylbenzyl group, a 4-isopropylbenzyl group, a 4-tert-butylbenzyl group, a 4-n-hexylbenzyl group, a 4-n-nonylbenzyl group, a 3,4-dimethylbenzyl group, a 3-methoxybenzyl group, a 4-methoxybenzyl group, a 4-ethoxybenzyl group, a 4-n-butyloxybenzyl group, a 4-n-hexyloxybenzyl group, a 4-n-nonyloxybenzyl group, and the like. The aralkyl group is a monovalent group containing an alkylene part and an aryl part.

The aryl group includes a phenyl group, a biphenylyl group, a naphthyl group, a fluorenyl group, an anthracenyl group, a phenanthrenyl group, a fluoranthenyl group, a pyrenyl group, a triphenylenyl group, a monovalent group derived from tetracene, a monovalent group derived from chrysene, a monovalent group derived from pentacene, a monovalent group derived from acenaphthene, an acenaphthylenyl group, a monovalent group derived from perylene, a monovalent group derived from corannulene, a monovalent group derived from coronene, and the like. The aryl group may be a group having a structure in which the polycyclic structures having the conjugated structure are directly connected or connected through a conjugated double bond group.

The arene includes benzene, naphthalene, fluorene, anthracene, phenanthrene, fluoranthene, pyrene, triphenylene, tetracene, chrysene, pentacene, acenaphthene, acenaphthylene, perylene, corannulene, coronene, and the like, for example. Those in which the arenes are directly connected or connected through a conjugated double bond group may be acceptable. Among the above, those in which the conjugated structure planarly spreads are suitable and, specifically, fluorene, anthracene, phenanthrene, fluoranthene, and pyrene are suitable.

The alkyl groups, the cycloalkyl groups, the alkoxy groups, the aralkyl groups, the aryl groups, and the hexavalent groups derived from arene may be groups replaced by halogen atoms, such as a fluorine atom, a chlorine atom, a bromine atom, and an iodine atom.

The alkyl groups replaced by halogen atoms include, for example, alkyl groups replaced by fluorine atoms, such as a fluoromethyl group, a difluoromethyl group, a trifluoromethyl group, a 2,2,2-trifluoroethyl group, a pentafluoroethyl group, a 3,3,3-trifluoropropyl group, a 3,3,3,2,2-pentafluoropropyl group, a heptafluoropropyl group, a 2,2,2-trifluoro-1,1-dimethylethyl group, a 2,2,2-trifluoro-1,1-bis(trifluoromethyl)ethyl group, a 4,4,4-trifluorobutyl group, a 5,5,5-trifluoropentyl group, a 6,6,6-trifluorohexyl group, a 6,6,6,5,5-pentafluorohexyl group, a 6,6,6,5,5,4,4-heptafluorohexyl group, and a 6,6,6,5,5,4,4,3,3-nonafluorohexyl group. Moreover, mentioned are alkyl groups replaced by chlorine atoms, such as a chloromethyl group, a dichloromethyl group, a trichloromethyl group, a 2,2,2-trichloroethyl group, a pentachloroethyl group, a 3,3,3-trichloropropyl group, a 3,3,3,2,2-pentachloropropyl group, a 3,3,3-trifluoro-2-chloropropane, a heptachloropropyl group, a 2,2,2-trichloro-1,1-dimethylethyl group, a 2,2,2-trichloro-1,1-bis(trifluoromethyl)ethyl group, a 4,4,4-trichlorobutyl group, a 5,5,5-trichloropentyl group, and a 6,6,6-trichlorohexyl group. Moreover, alkyl groups replaced by bromine atoms, such as a bromomethyl group, a dibromomethyl group, and a tribromomethyl group, are mentioned. Moreover, alkyl groups replaced by iodine atoms, such as a 2-iodineethyl group, a 3-iodinepropyl group, and a 4-iodinebutyl group, are mentioned. Among the above, the alkyl groups replaced by fluorine atoms, i.e., alkyl fluoride groups, are suitable.

The alkoxy group replaced by halogen atoms include, for example, alkoxy groups replaced by fluorine atoms, such as a fluoromethyloxy group, a difluoromethyloxy group, a trifluoromethyloxy group, a 2-fluoroethyloxy group, a 2,2-difluoroethyloxy group, a 2,2,2-trifluoroethyloxy group, a pentafluoroethyloxy group, a 3,3,3-trifluoropropyloxy group, a 4,4,4-trifluorobutyloxy group, a 5,5,5-trifluoropentyloxy group, and a 5,5,5,4,4-pentafluoropentyloxy group. Moreover, groups having chlorine atoms, bromine atoms, or iodine atoms in place of the fluorine atoms and the like are mentioned.

The aralkyl groups in which the alkylene part is replaced by halogen atoms include, for example, aralkyl groups in which the alkylene part is replaced by fluorine atoms, such as a 2,2-difluoro-2-phenylethyl group, a 2,2,1,1-tetrafluoro-2-phenylethyl group, a 3,3-difluoro-3-phenylpropyl group, and a 4,4-difluoro-4-phenylbutyl group. Moreover, groups having chlorine atoms, bromine atoms, or iodine atoms in place of the fluorine atom, groups having other aryl groups, such as a naphthyl group, in place of the phenyl group, and the like are mentioned.

The aralkyl group in which the aryl part is replaced by halogen atoms includes, for example, aralkyl groups in which the aryl part is replaced by fluorine atoms, such as a fluorophenyl methyl group and a difluorophenyl methyl group. Moreover, groups having chlorine atoms, bromine atoms, or iodine atoms in place of the fluorine atoms, groups having other aryl groups, such as a naphthyl group, in place of the phenyl group, and the like are mentioned.

The aryl groups replaced by halogen atoms include, for example, aryl groups replaced by fluorine atoms, such as a fluorophenyl group and a difluorophenyl group. Moreover, groups having chlorine atoms, bromine atoms, or iodine atoms in place of the fluorine atoms and the like are mentioned.

The alkyl groups, cycloalkyl groups, alkoxy groups, aralkyl groups, aryl groups, and arene mentioned above may be replaced by substituents other than halogen atoms. The substituents other than halogen atoms include, for example, linear or branched alkyl groups, linear or branched aralkyl groups, linear or branched alkoxy groups, hydroxyalkyl groups, and the like. However, the substituent is selected in such a manner as to obtain a compound in which the hole transporting compound consists of one or more carbon atoms, one or more hydrogen atoms, and one or more halogen atoms, or a compound in which the hole transporting compound consists of one or more carbon atoms, one or more hydrogen atoms, one or more oxygen atoms, and one or more halogen atoms.

In the formula (1) above, n is an integer of 1 or more and 10 or less. However, since it is suitable that the conjugated system in the hole transporting compound moderately spreads from the viewpoint of hole transportation ability, n is preferably 1 or more and 6 or less and more preferably 1 or more and 4 or less.

Similarly, since it is suitable that the conjugated system in the hole transporting compound moderately spreads from the viewpoint of hole transportation ability, the molecular weight of the hole transporting compound according to the present invention is preferably 300 or more and 3,000 or less.

When n in the formula (1) above is an integer of 2 or more and 10 or less, the compound represented by the formula (1) above has a structure in which $R^7$s are linked. In this case, a structure in which the arene structures in $R^7$s are directly bonded may be acceptable or a structure in which the arene structures are bonded through carbon atoms may be acceptable. However, a structure in which the arene structures are directly bonded is suitable.

It is suitable that one or more of $R^1$ to $R^7$ in the formula (1) above have the condensed polycyclic structure and it is more suitable that two or more of $R^1$ to $R^7$ have the condensed polycyclic structure.

In the hole transporting compound according to the present invention, it is suitable that the structure other than the polymerizable functional group has a conjugated structure containing continuously bonded 24 or more sp2 carbon atoms as described above but sp3 carbon atoms may be contained in an appropriate proportion. The "sp3 carbon atoms" refers to carbon atoms having a sp3 hybrid orbital.

Examples of the hole transporting compound according to the present invention (exemplary compounds) are shown below. However, the hole transporting compound which can be used for the present invention is not limited to the exemplary compounds.

(No. 1)

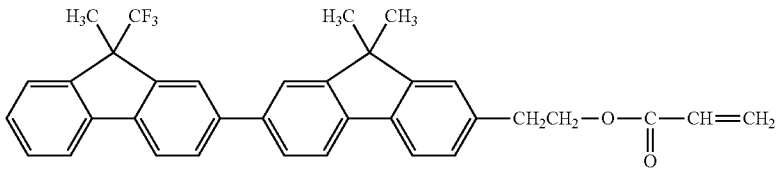

(No. 2)

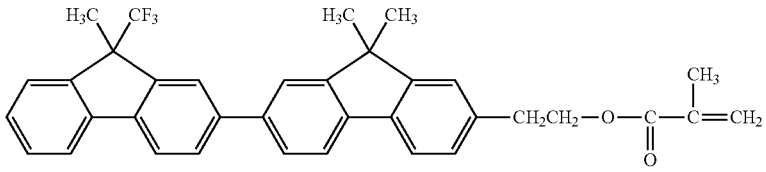

-continued
(No. 3)
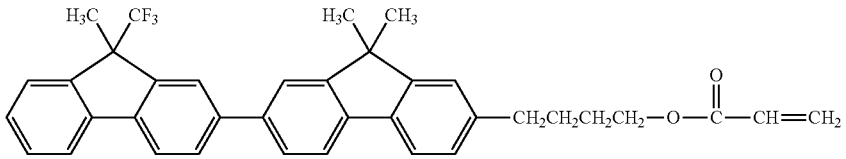
(No. 4)
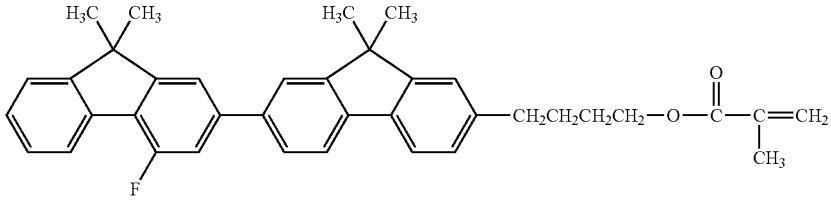
(No. 5)
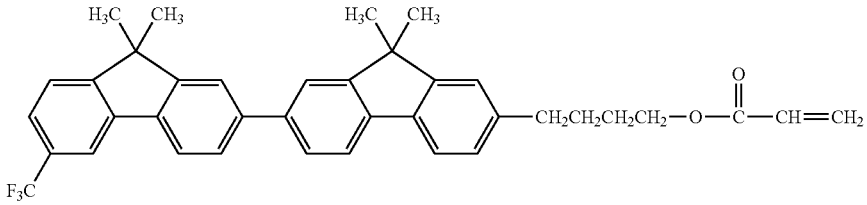
(No. 6)
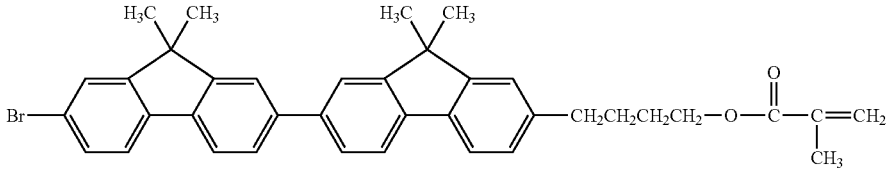
(No.7)
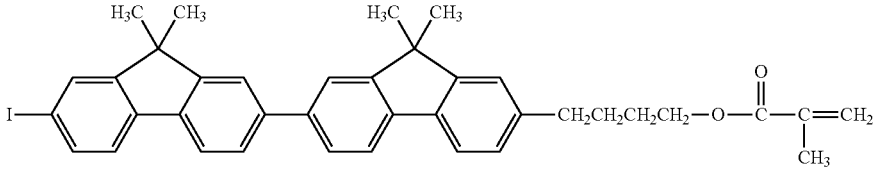
(No. 8)
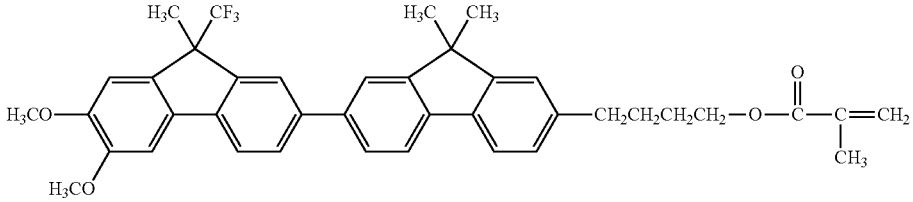
(No. 9)
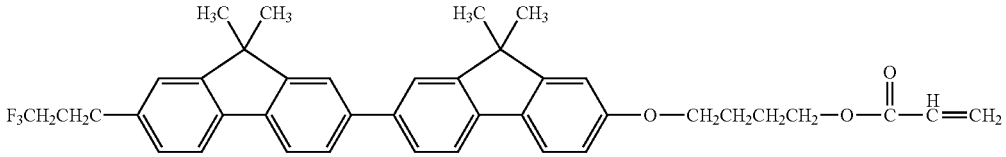
(No. 10)
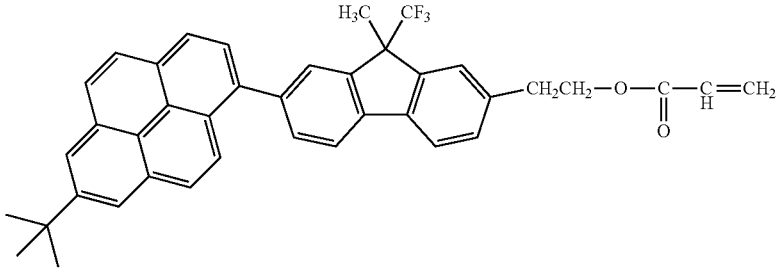

-continued
(No. 11)
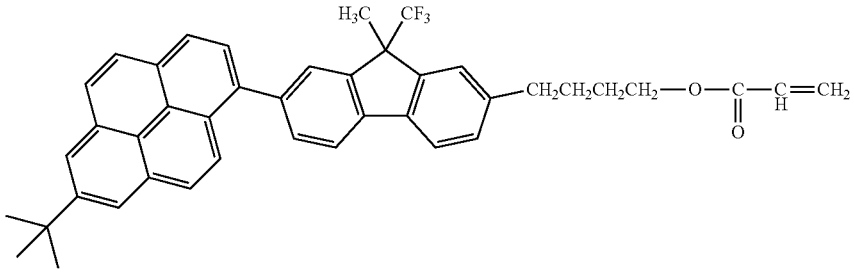
(No. 12)
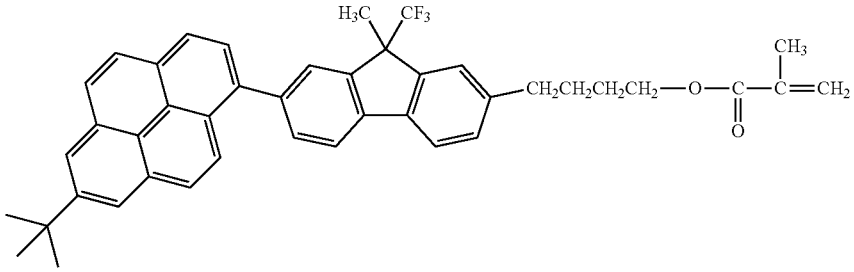
(No. 13)
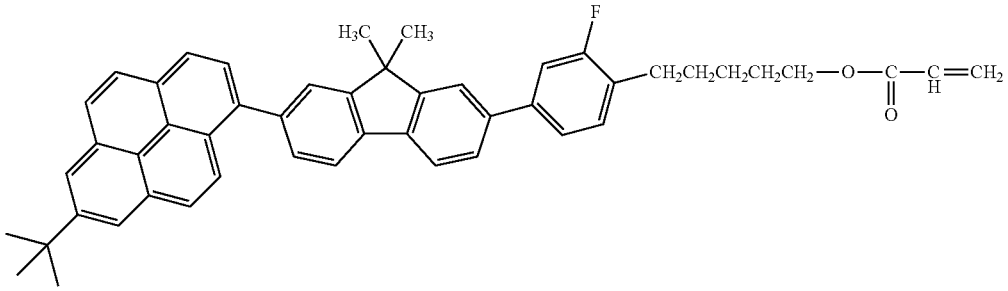
(No. 14)
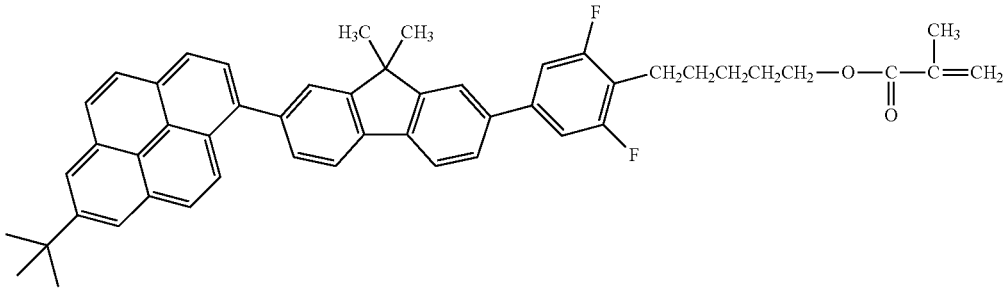
(No. 15)
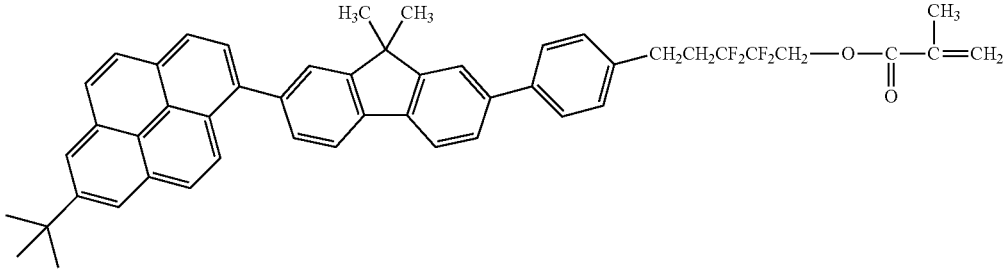
(No. 16)
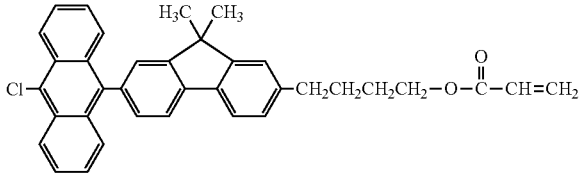
(No. 17)
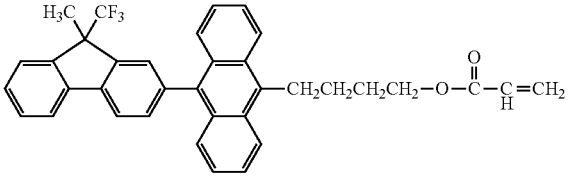

-continued
(No.18)
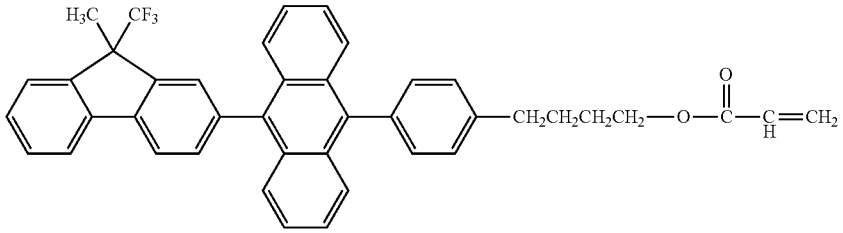
(No. 19)
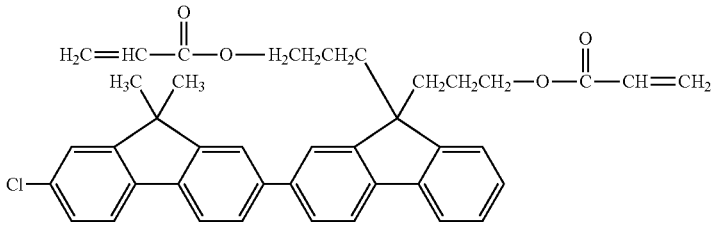
(No. 20)
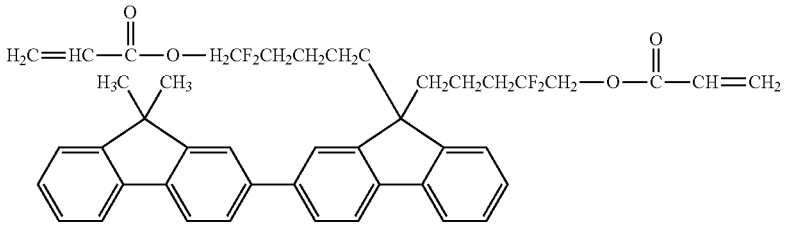
(No. 21)
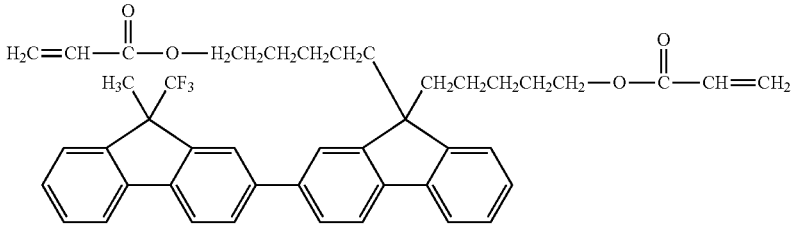
(No. 22)
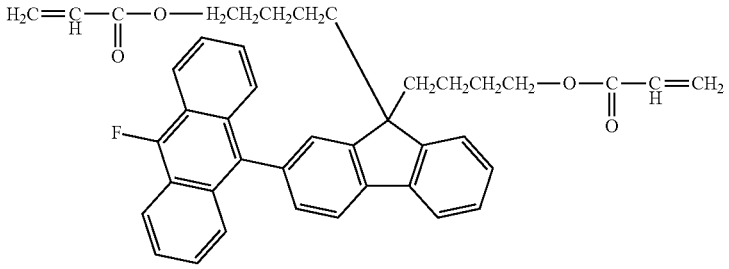
(No. 23)
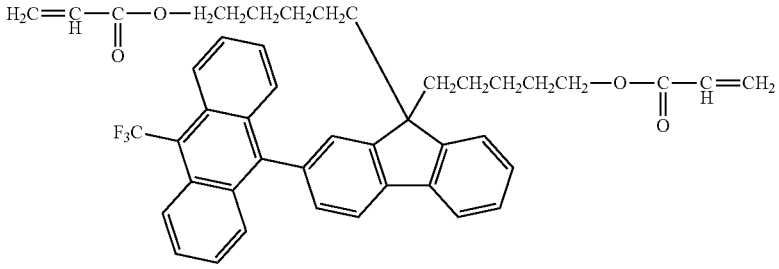

-continued
(No. 24)
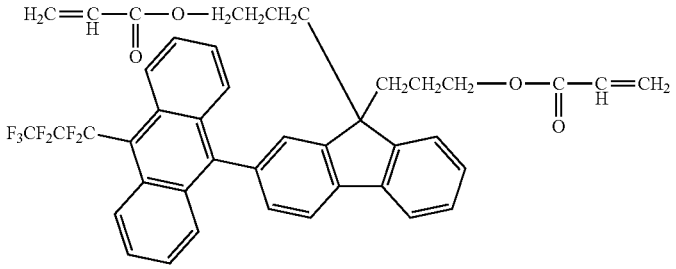
(No. 25)
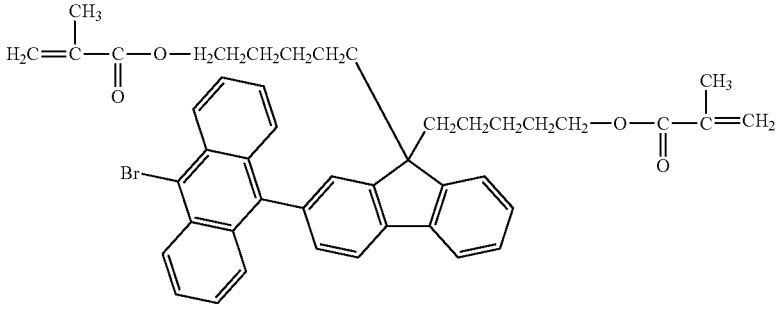
(No. 26)
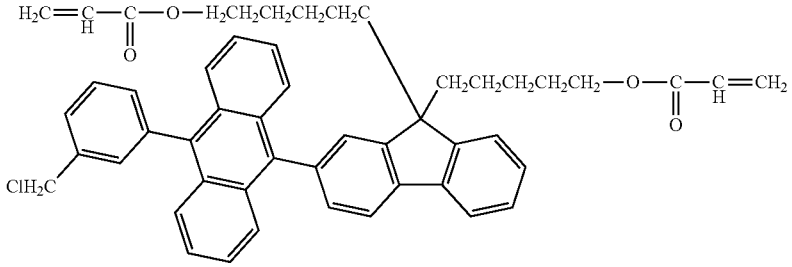
(No. 27)
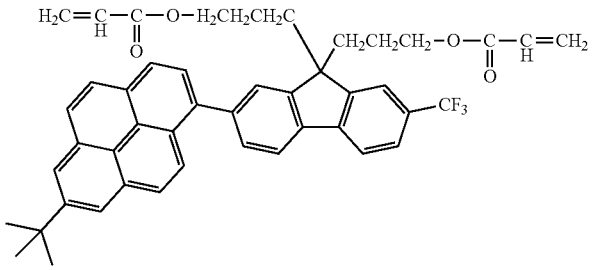
(No. 28)
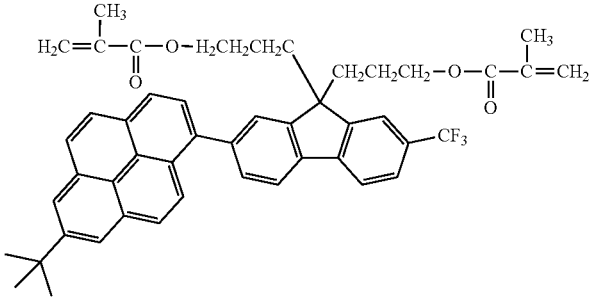
(No. 29)
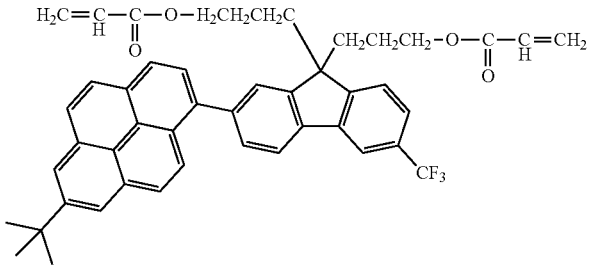
(No. 30)
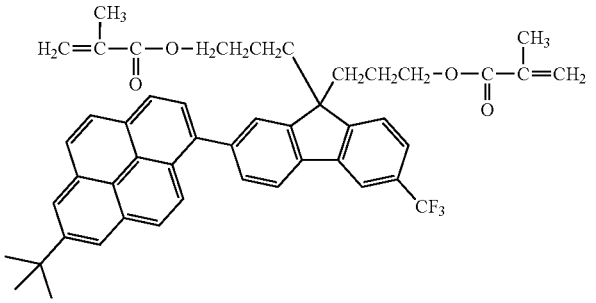

-continued
(No. 31)
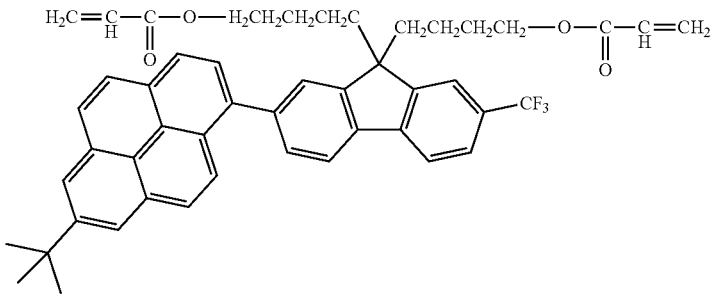
(No. 32)
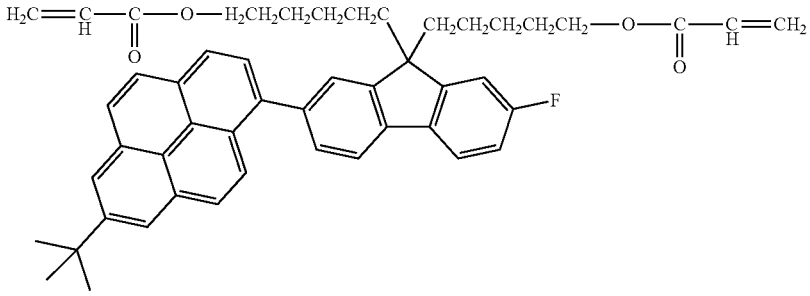
(No. 33)
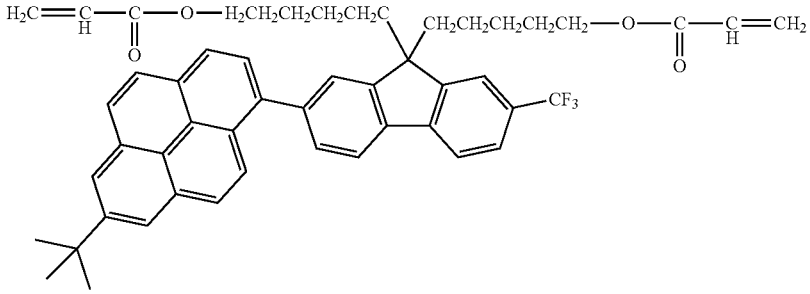
(No. 34)
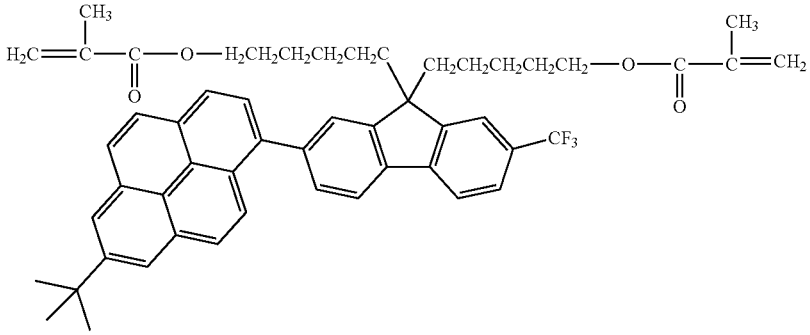
(No. 35)
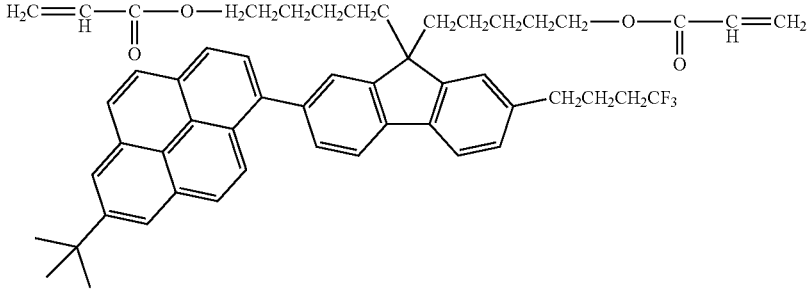

-continued
(No. 36)
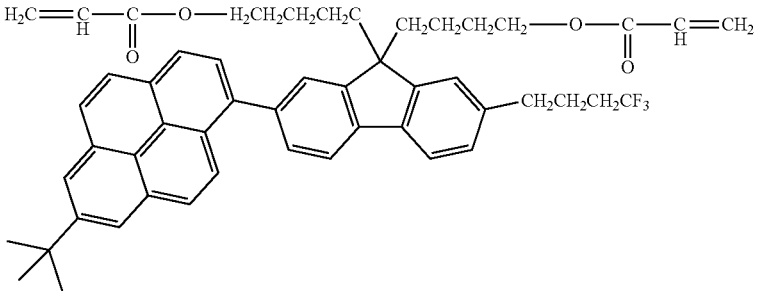
(No. 37)
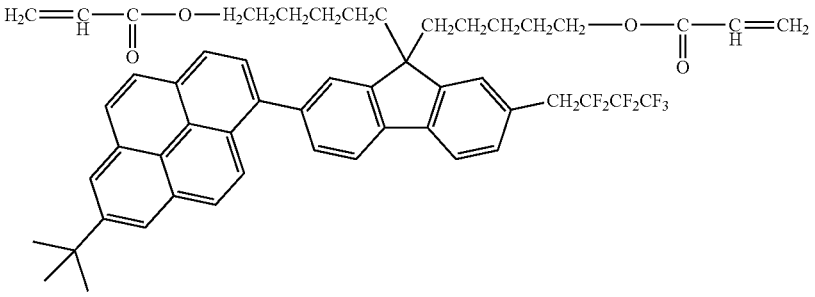
(No. 38)
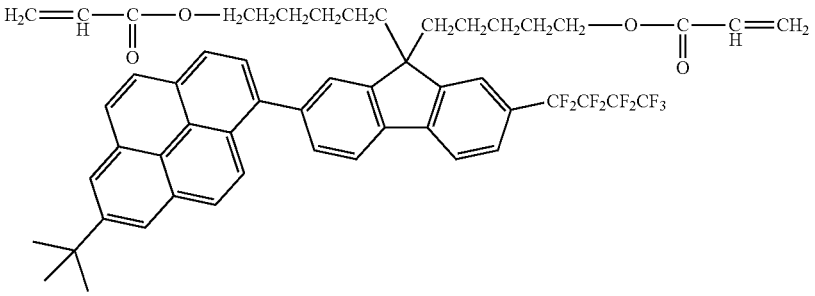
(No. 39)
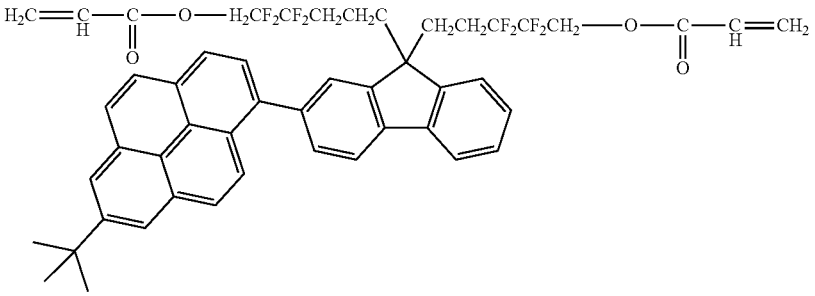
(No. 40)
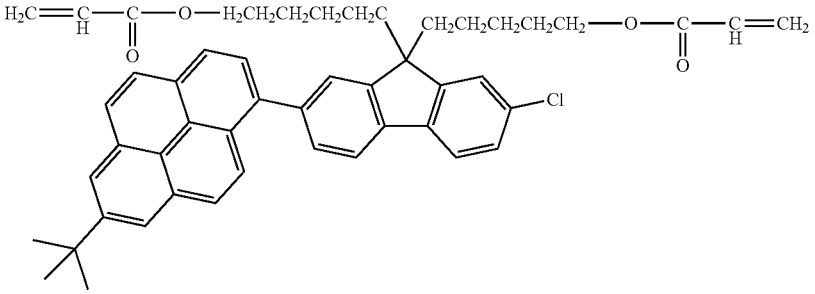

-continued
(No. 41)
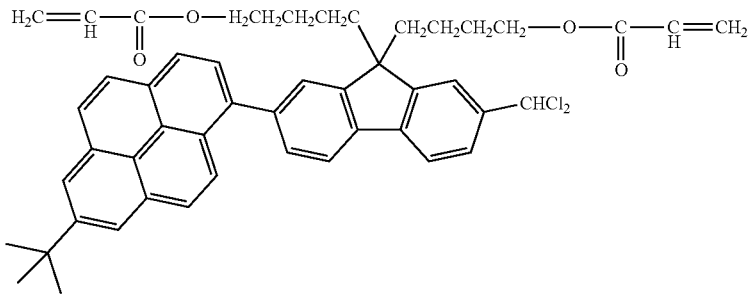
(No. 42)
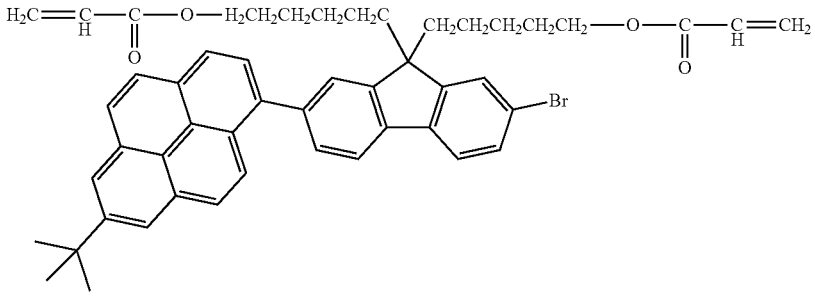
(No. 43)
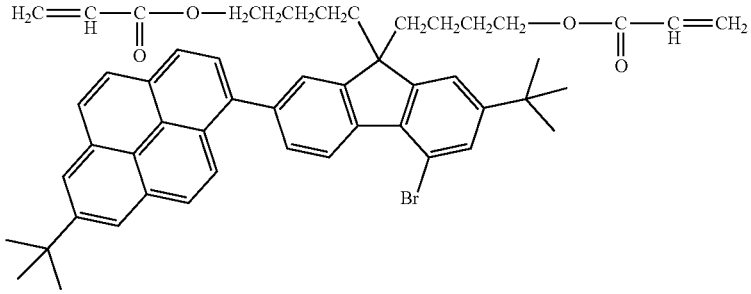
(No. 44)
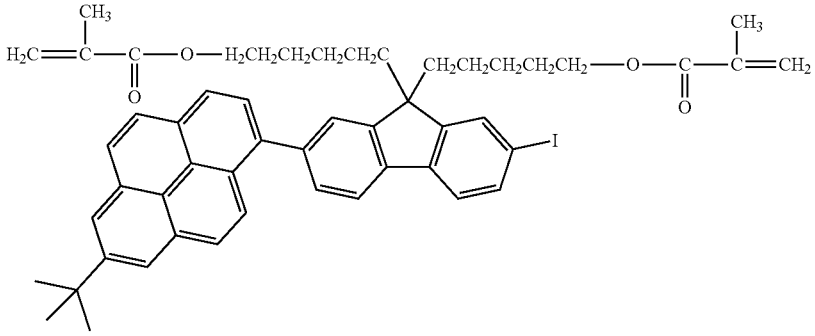
(No. 45)
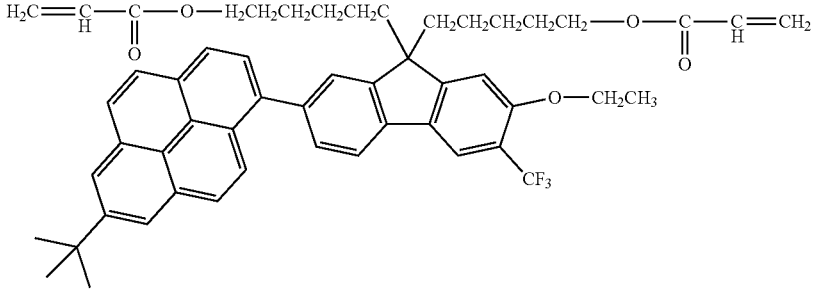

-continued
(No. 46)
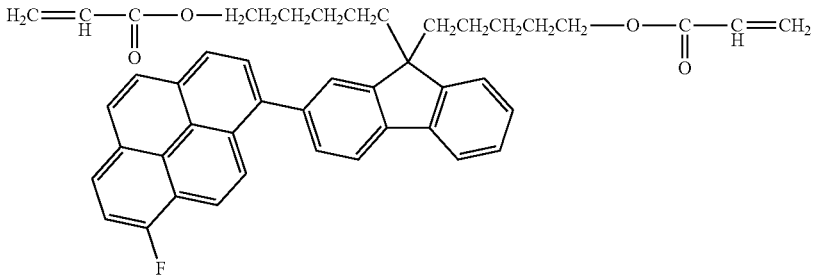
(No. 47)
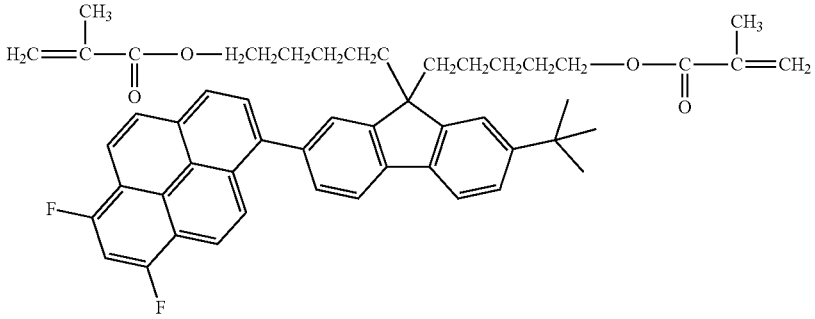
(No. 48)
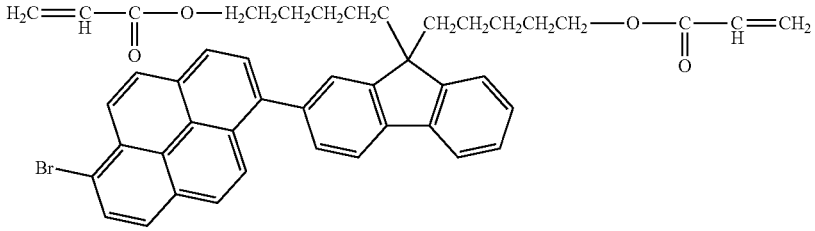
(No. 49)
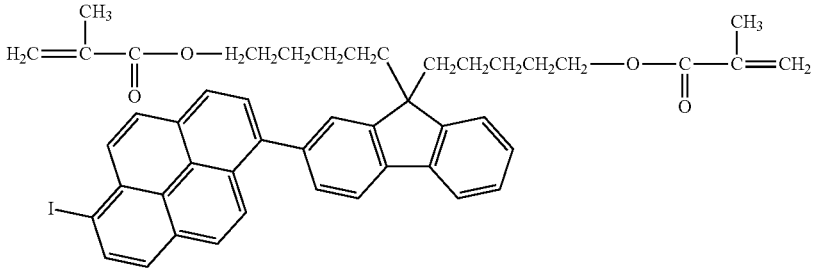
(No. 50)
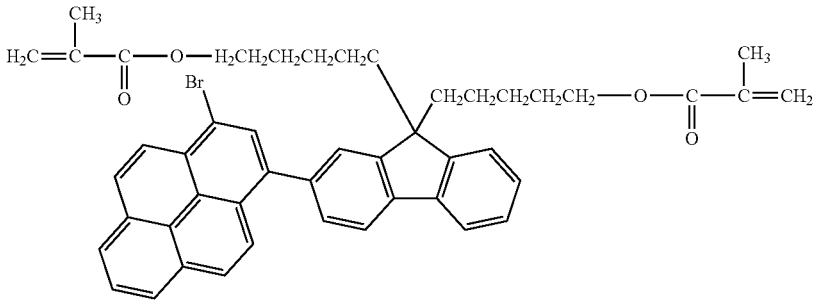

-continued
(No. 51)
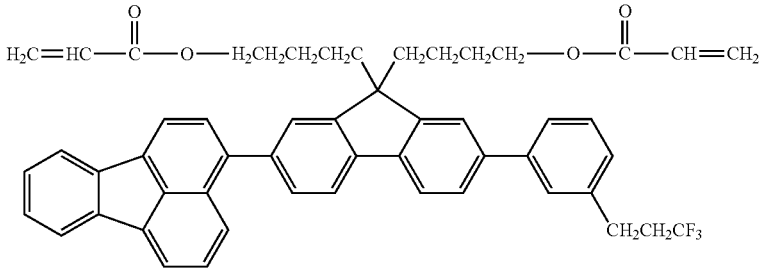
(No. 52)
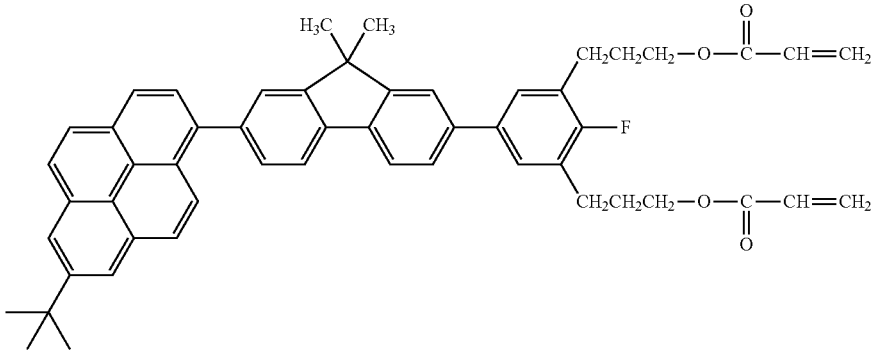
(No. 53)
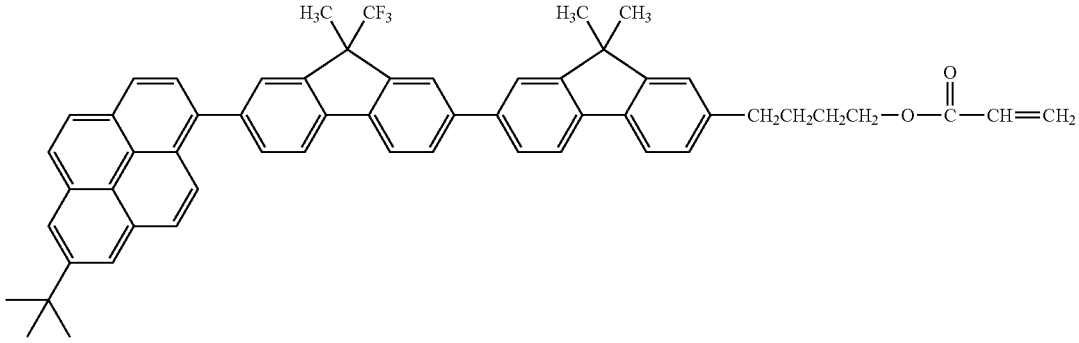
(No. 54)
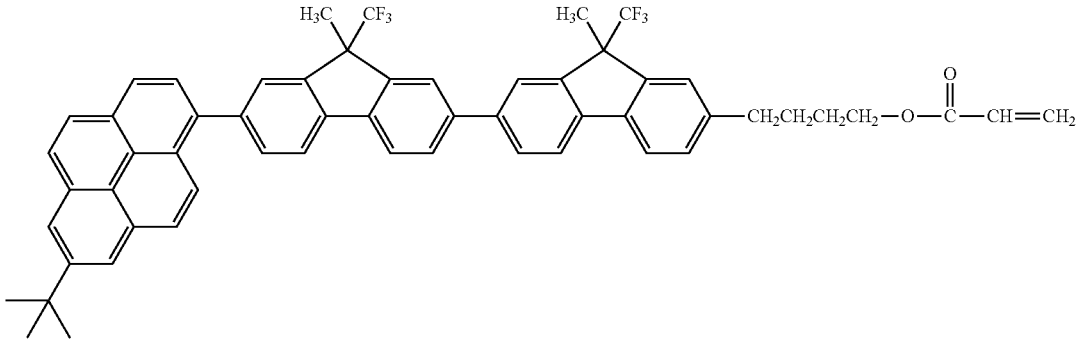
(No. 55)
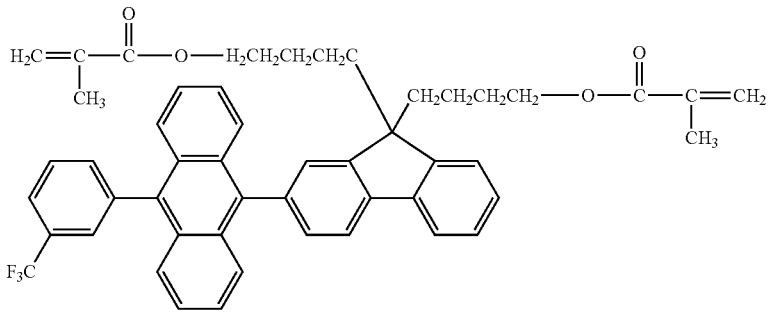

-continued
(No. 56)
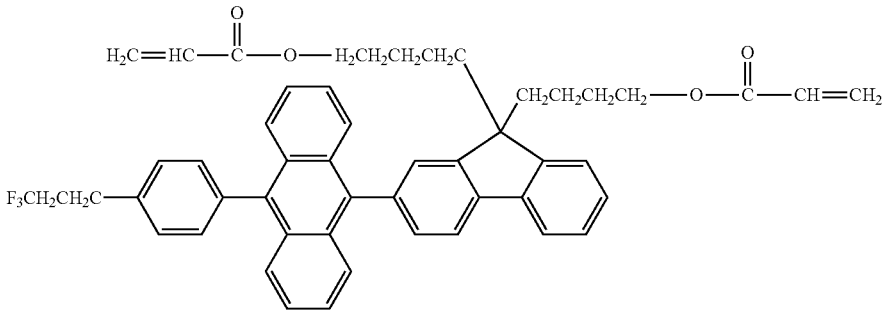
(No. 57)
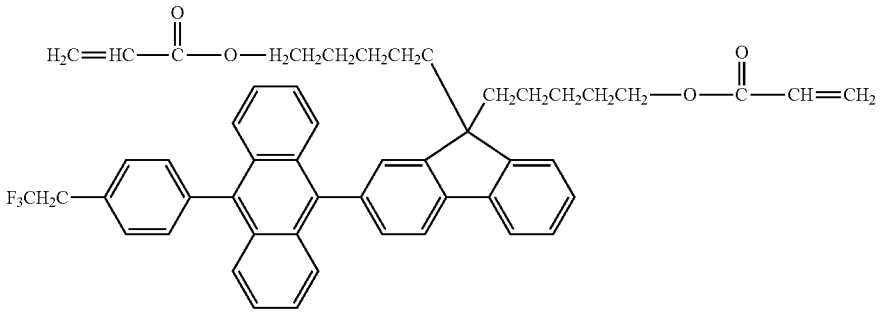
(No. 58)
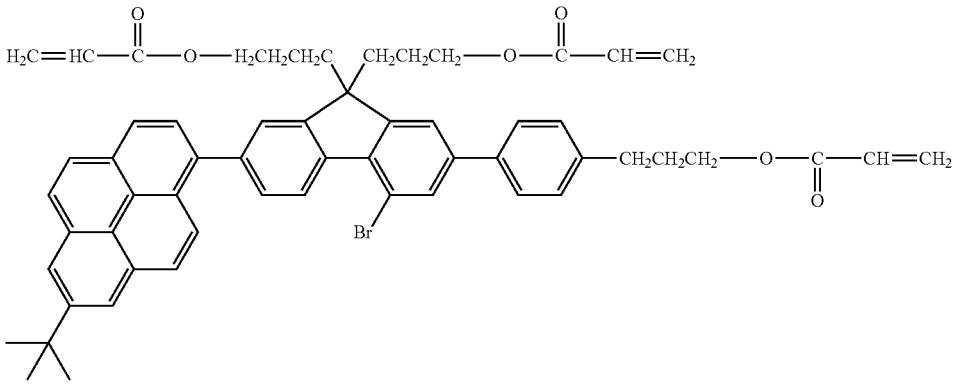
(No. 59)
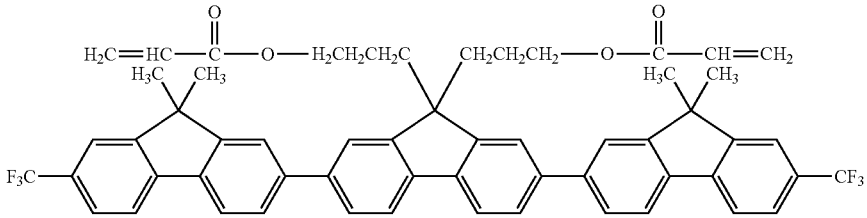
(No. 60)
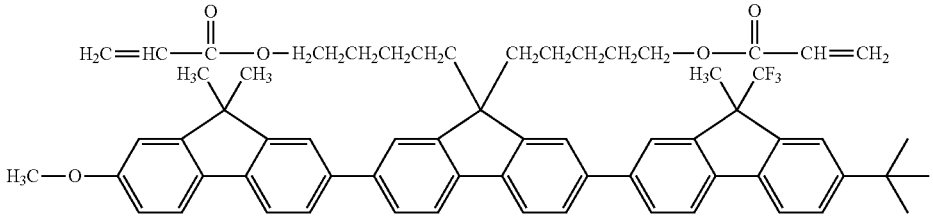

-continued
(No. 61)
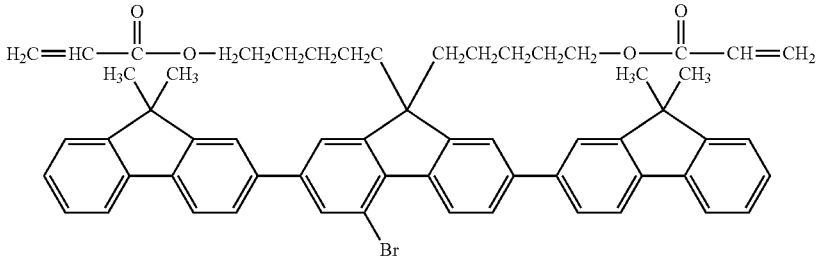
(No. 62)
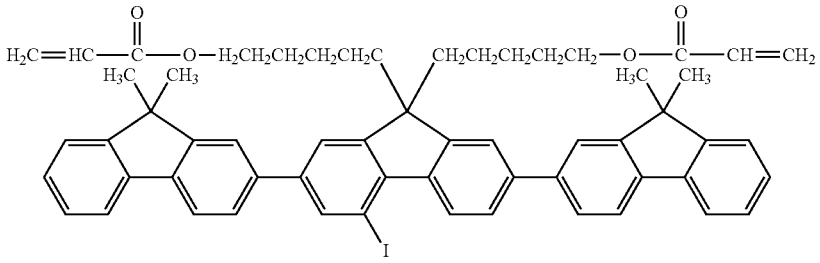
(No. 63)
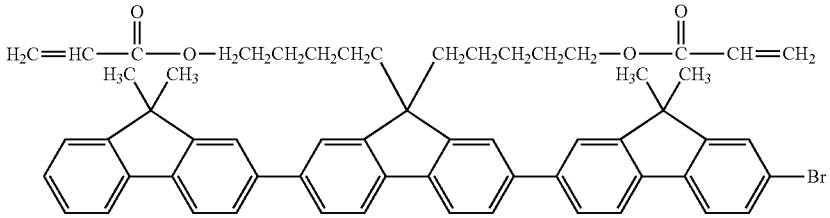
(No. 64)
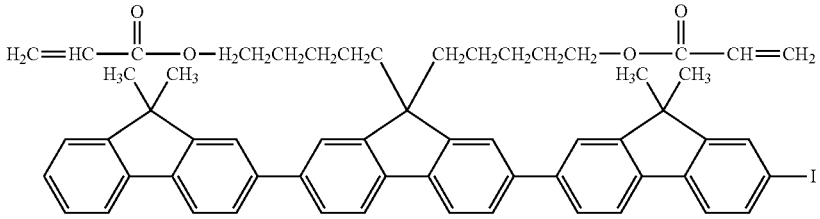
(No. 65)
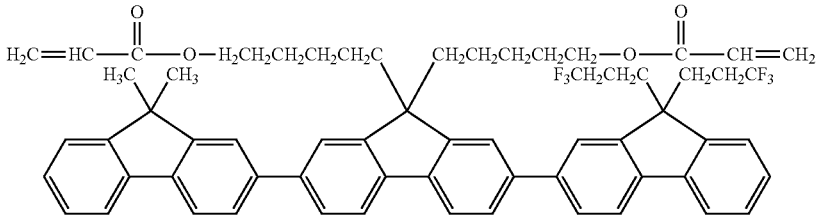
(No. 66)
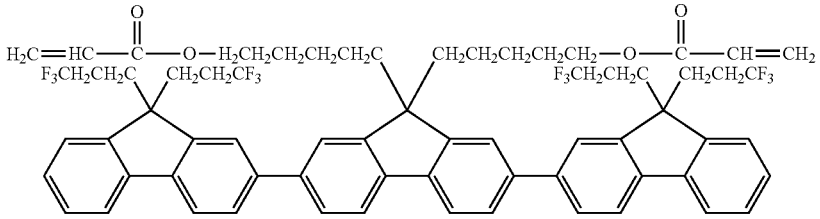

-continued
(No. 67)
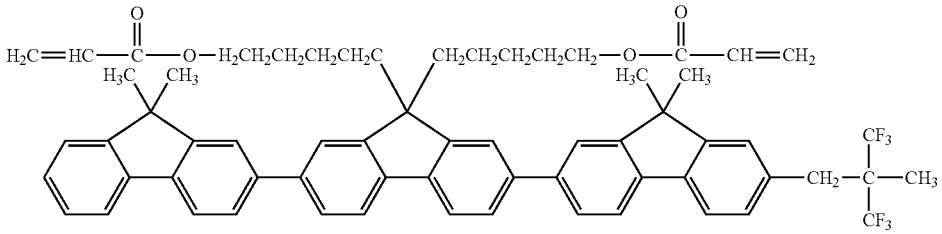
(No. 68)
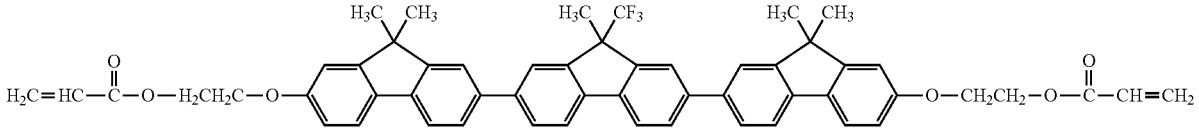
(No. 69)
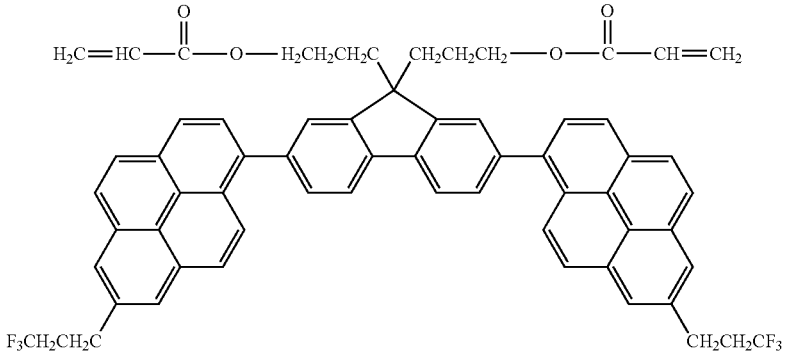
(No. 70)
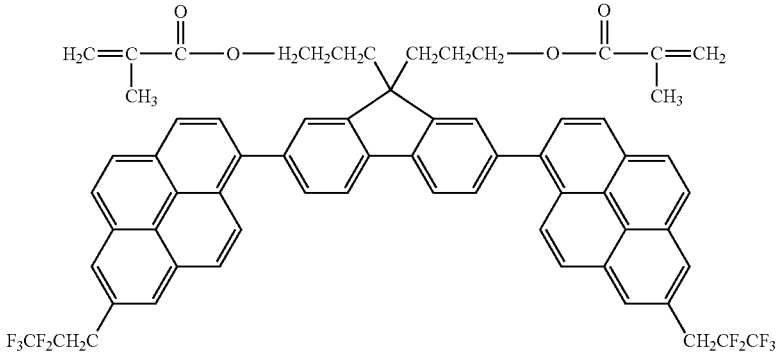
(No. 71)
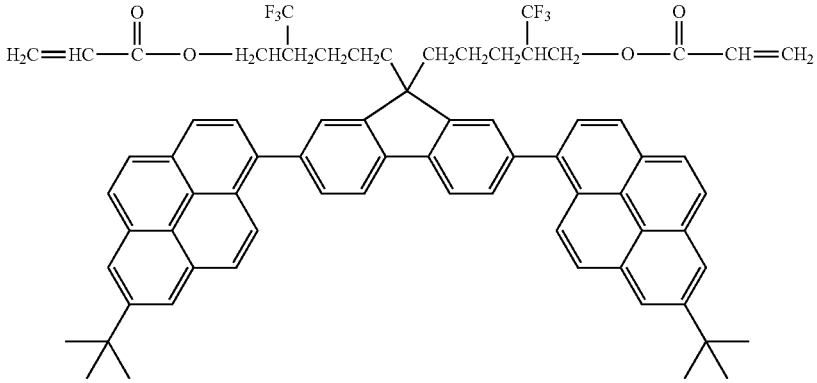

-continued
(No. 72)
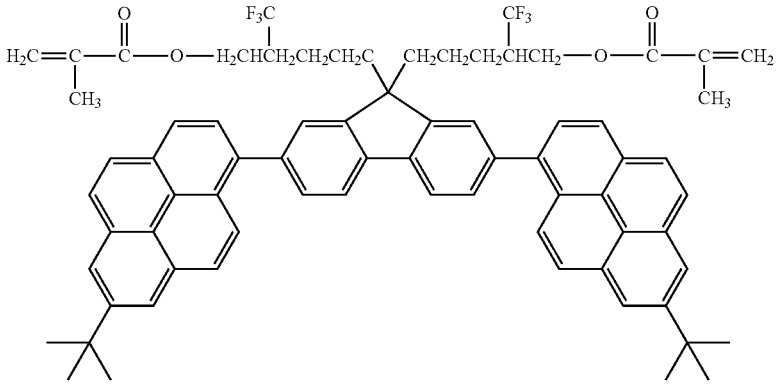
(No. 73)
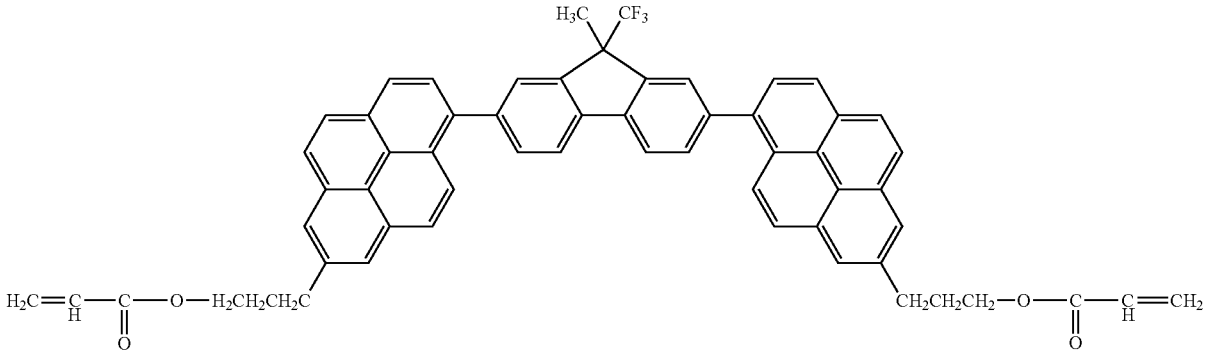
(No. 74)
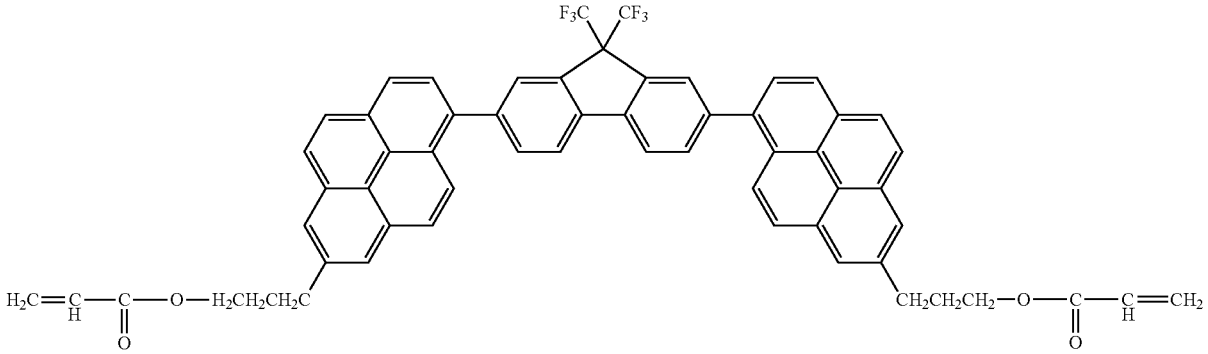
(No. 75)
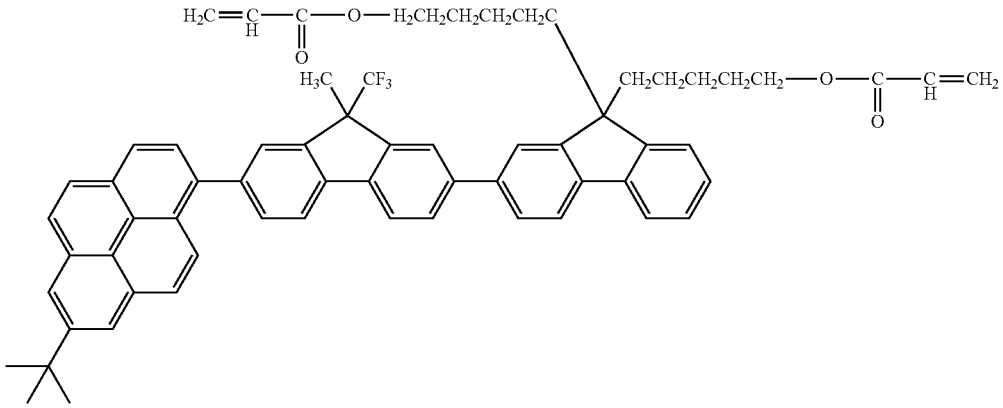

-continued
(No. 76)
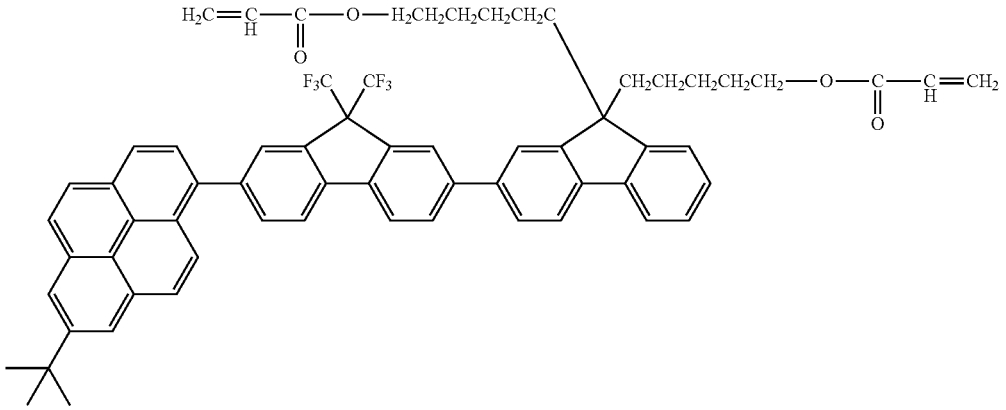
(No. 77)
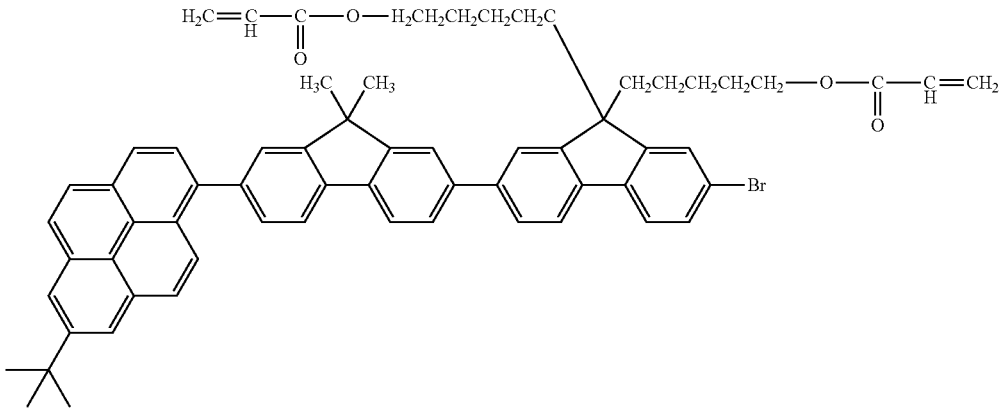
(No. 78)
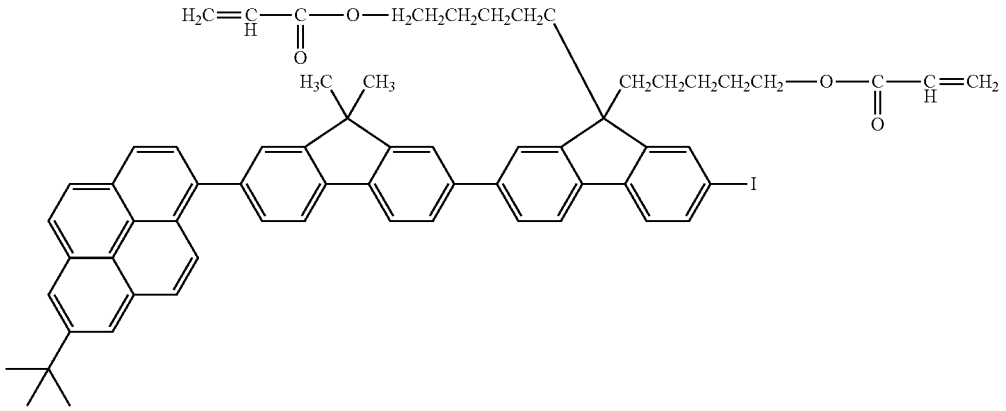
(No. 79)
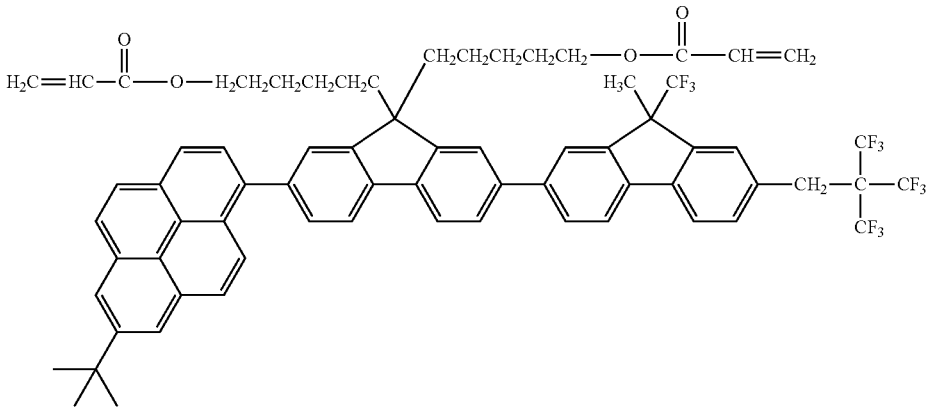

-continued
(No. 80)
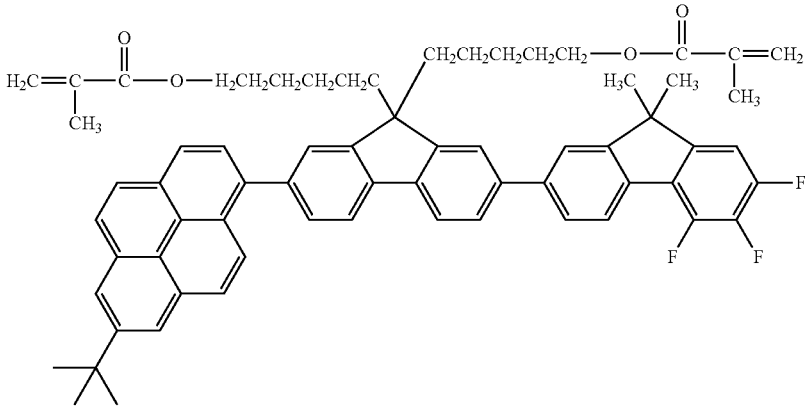
(No. 81)
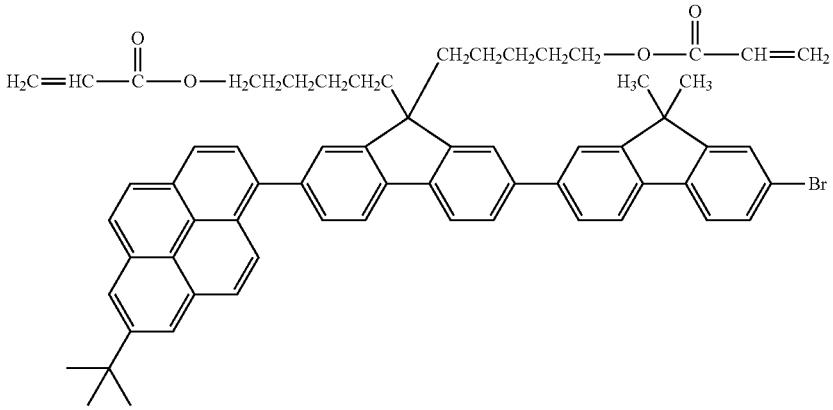
(No. 82)
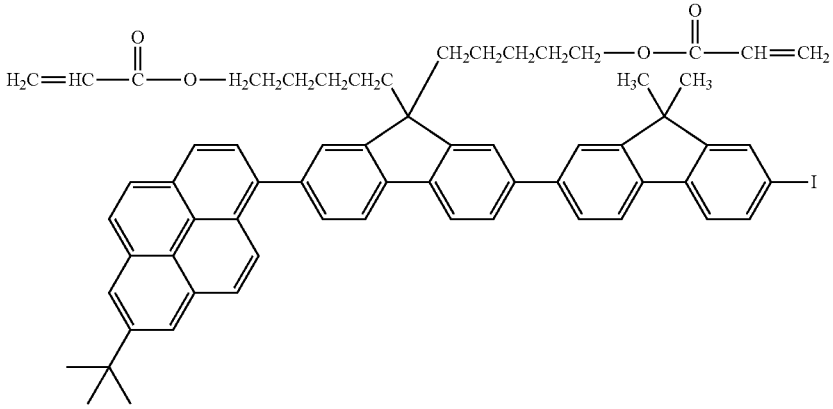
(No. 83)
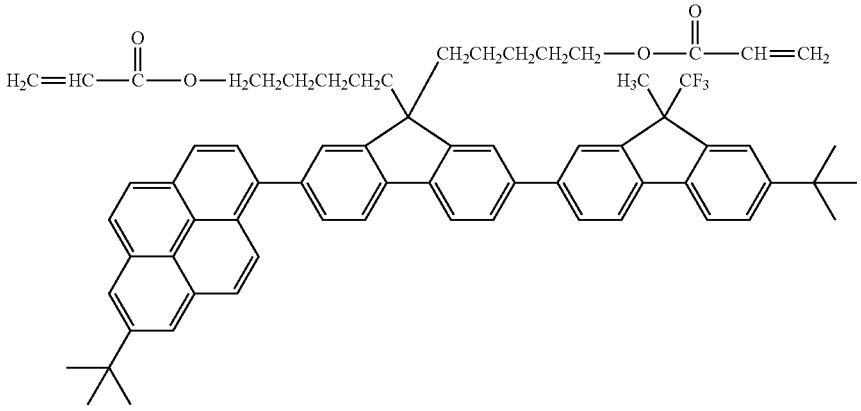

-continued
(No. 84)
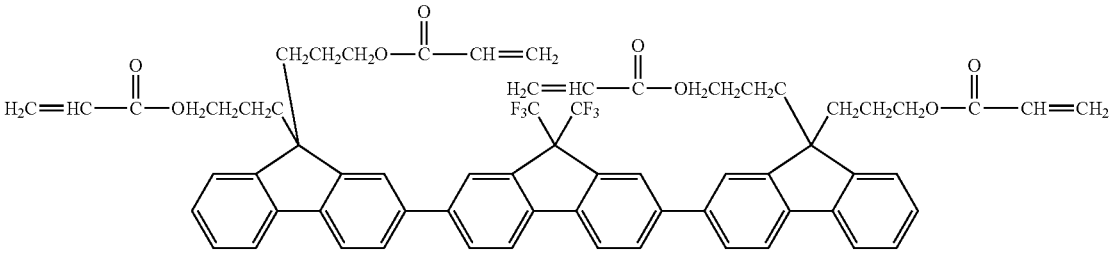
(No. 85)
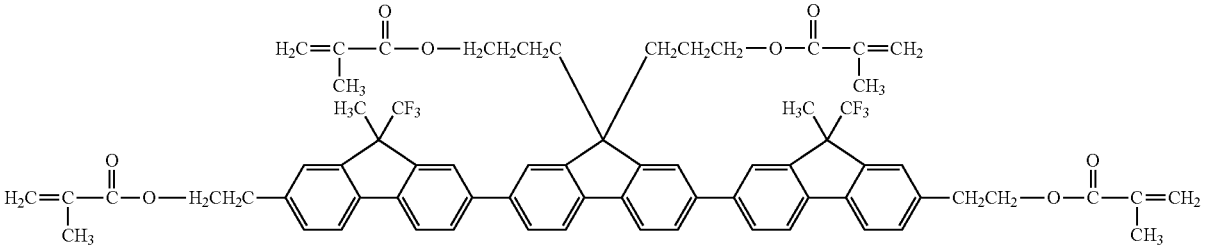
(No. 86)
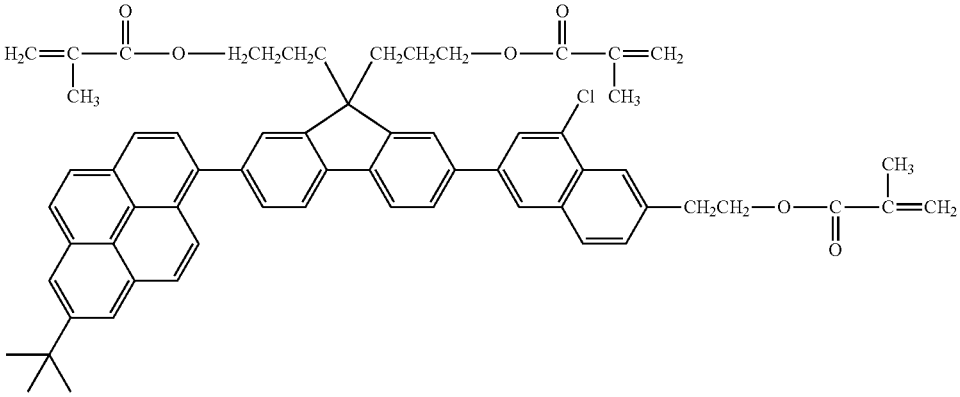
(No. 87)
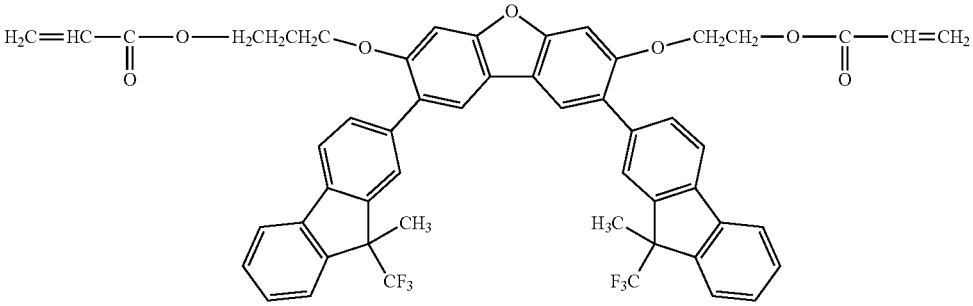
(No. 88)
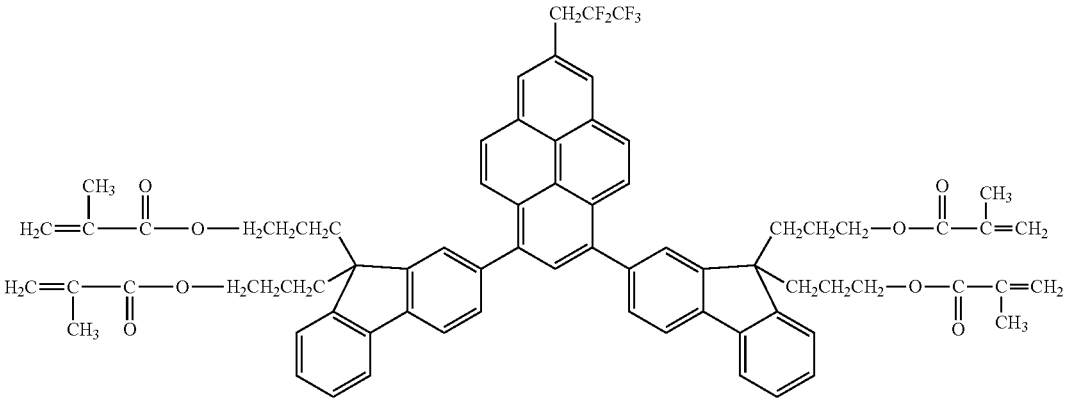

-continued
(No. 89)
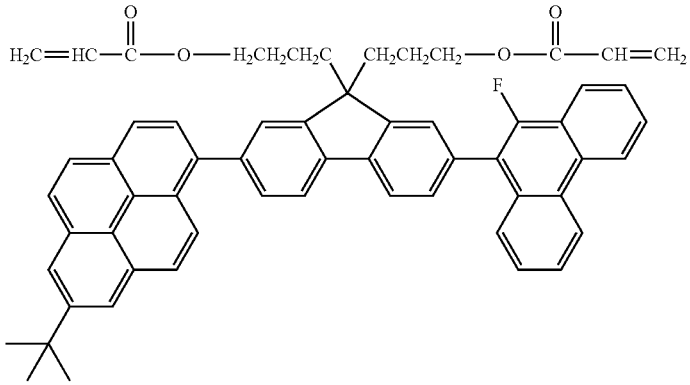
(No. 90)
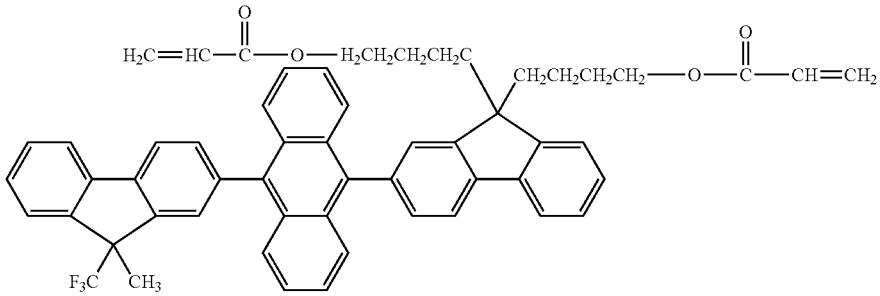
(No. 91)
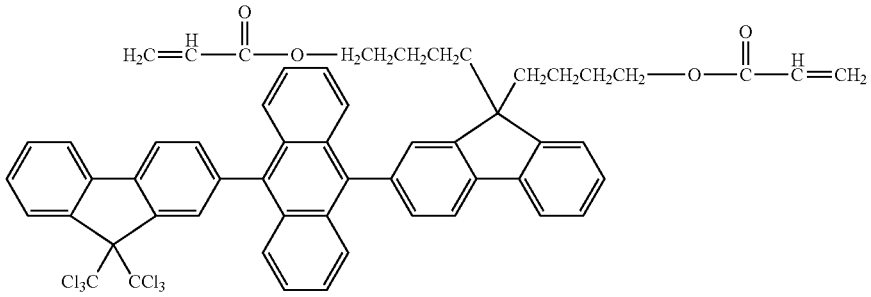
(No. 92)
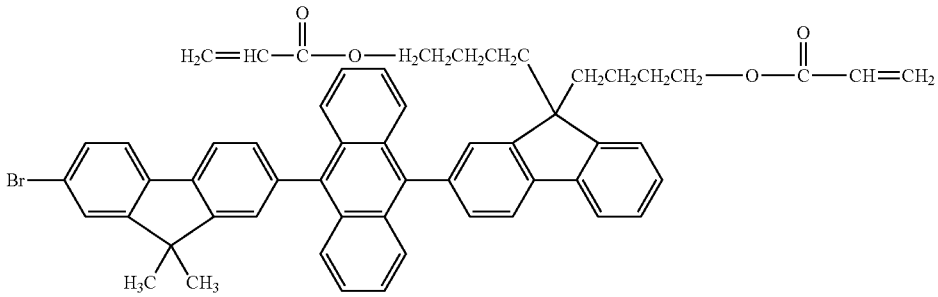

-continued
(No. 93)
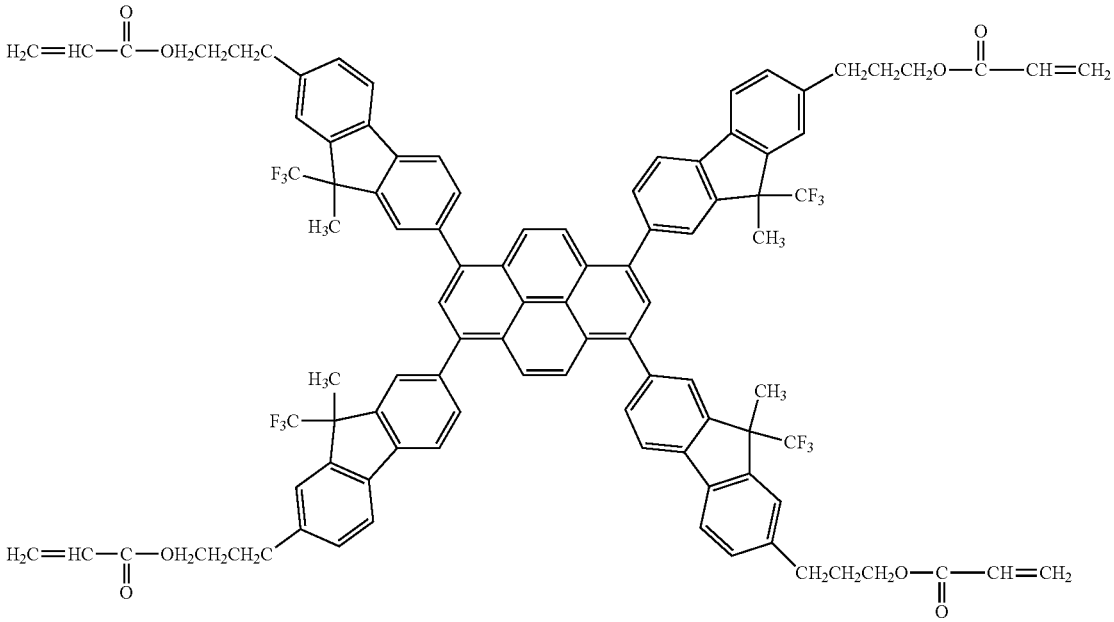
(No. 94)
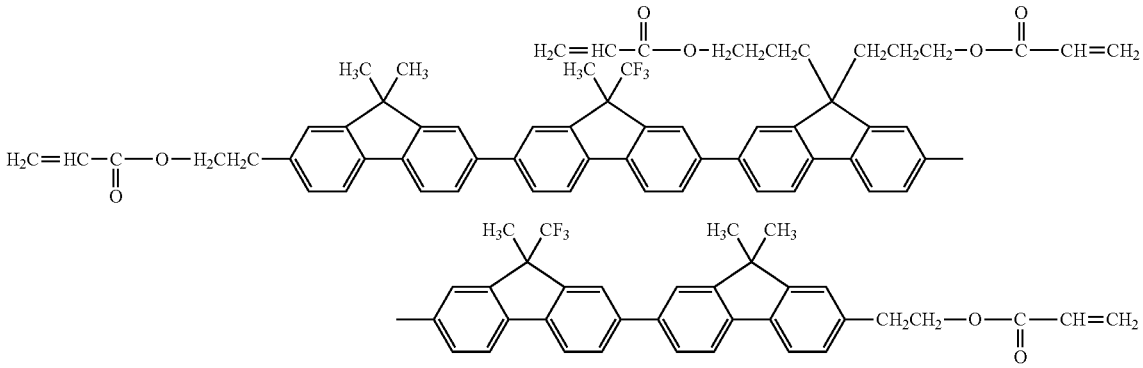
(No.95)
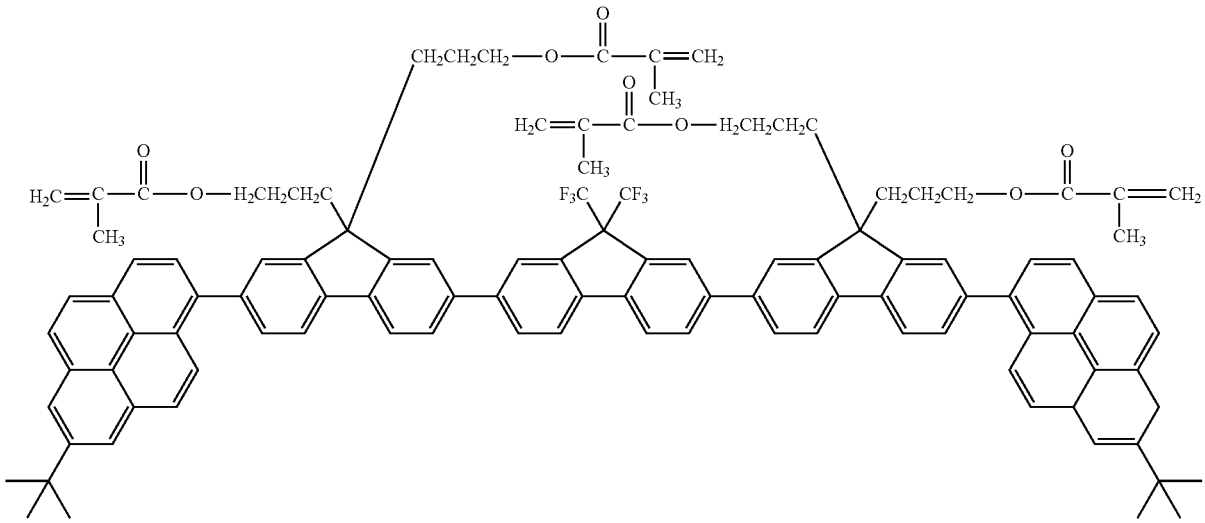

-continued
(No. 96)
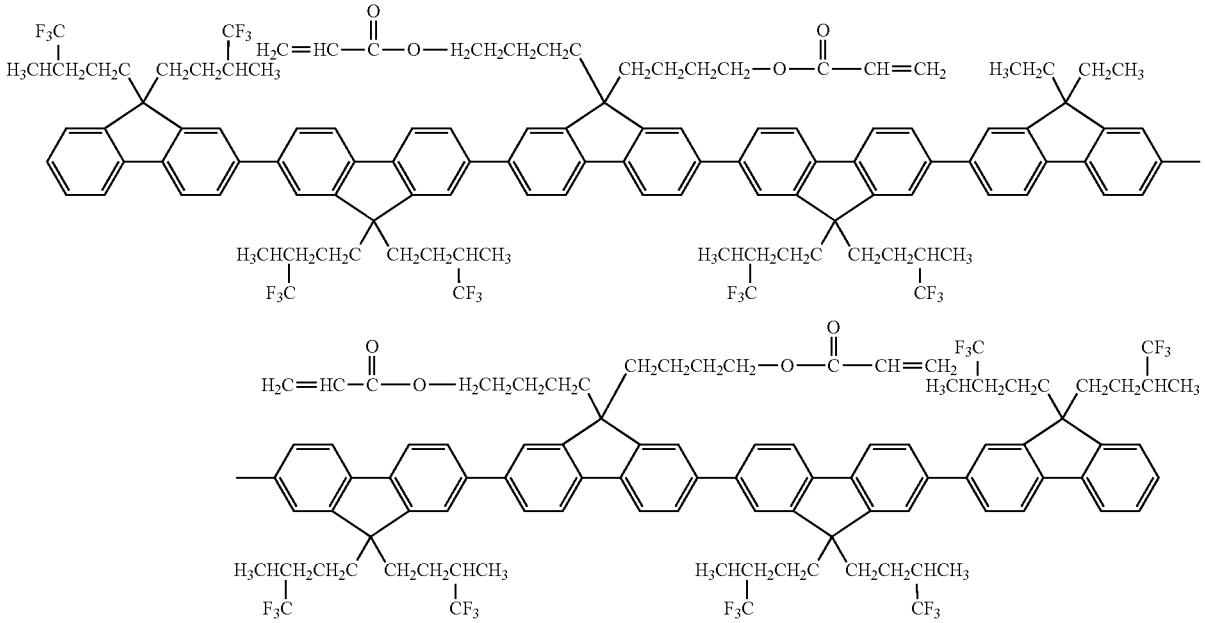
(No. 97)
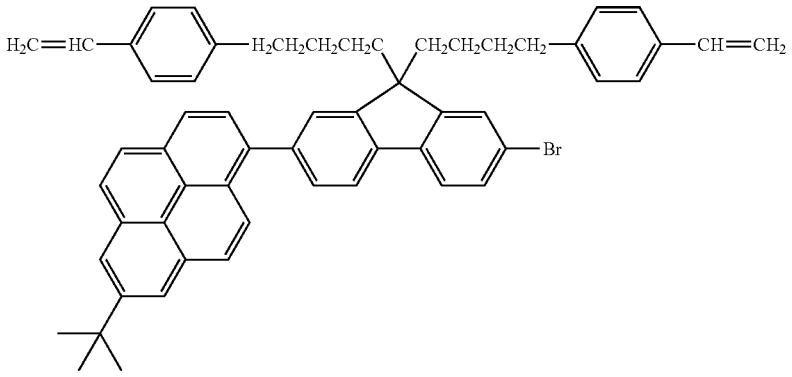
(No. 98)
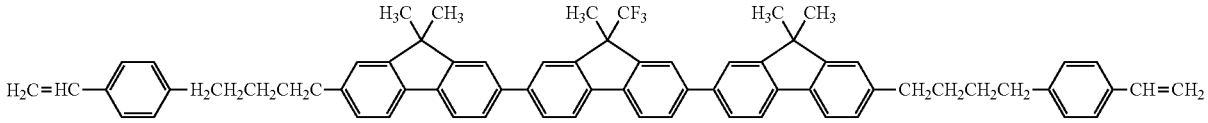
(No. 99)
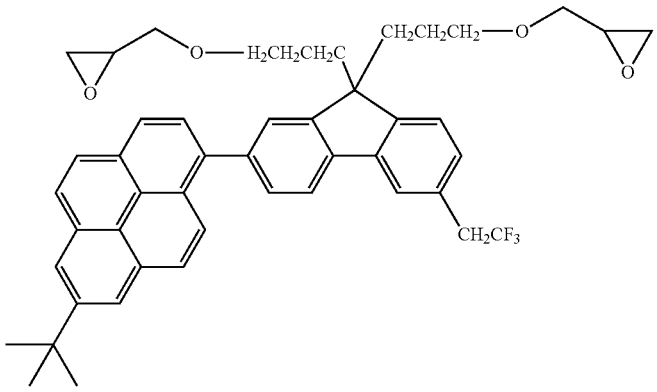

-continued
(No. 100)
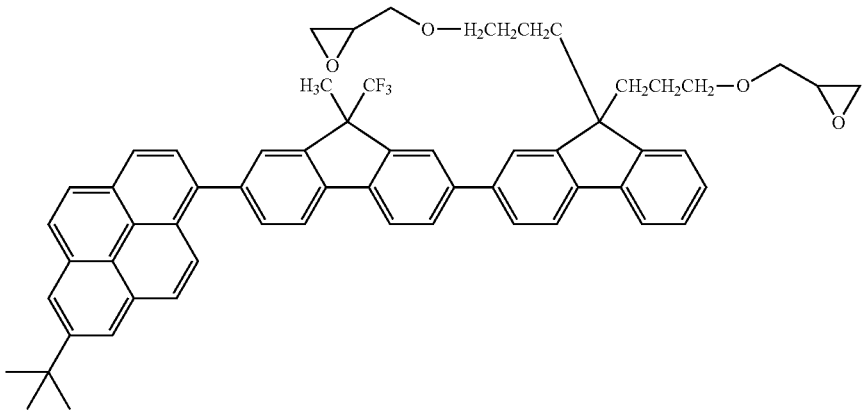
(No. 101)
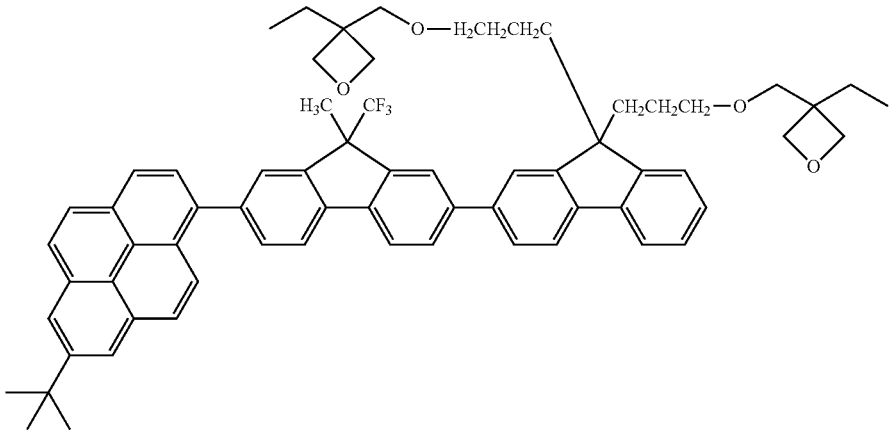
(No. 102)
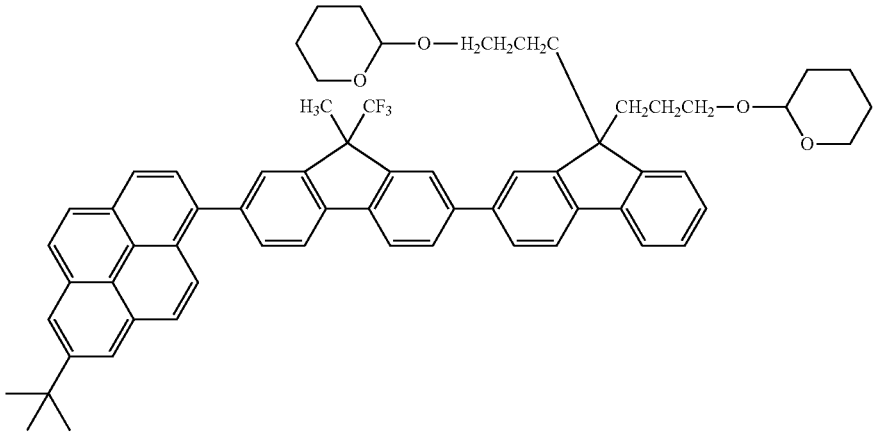

-continued (No. 103)

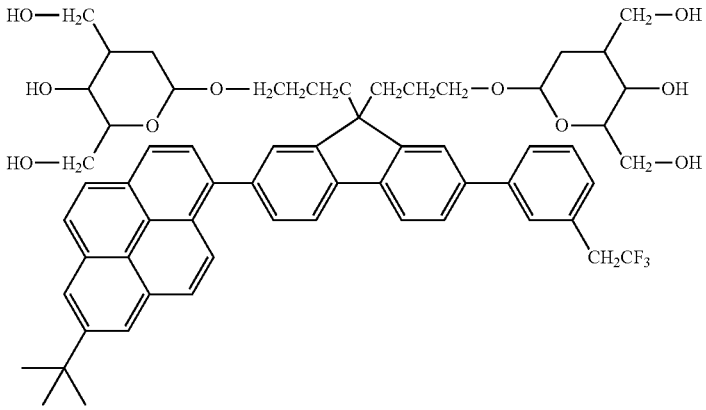

(No. 104)

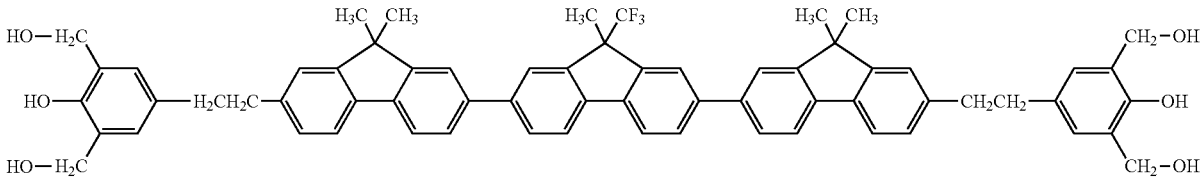

Synthesis examples of the hole transporting compound according to the present invention are shown below.

The exemplary compound No. 45 was synthesized by a reaction represented by the following reaction formula (1).

Reaction formula (1)

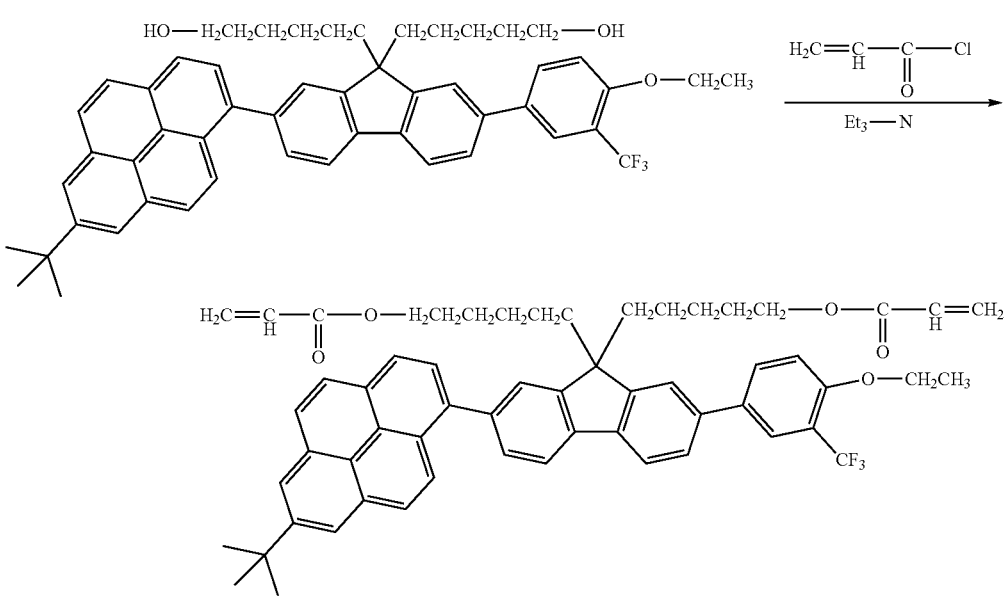

8 parts of dihydroxy compounds shown in the left side of the reaction formula (1), 84 parts of tetrahydrofuran, and 3.1 parts of triethylamine were placed in a three necked flask to dissolve the dihydroxy compound to thereby obtain a solution. Thereafter, the solution was cooled with ice water. Next, under cooling at 5° C. or less, 2.3 parts of acryl chloride was slowly added dropwise into the solution with attention to a temperature increase to be reacted to thereby obtain a reaction mixture. After the completion of the dropwise addition, the temperature of the reaction mixture was gradually increased until the internal temperature reached 50° C., and then the reaction was continuously performed for 30 minutes.

After the end of the reaction, 72 parts of a 10% aqueous sodium hydroxide solution was added to the reaction mixture to obtain a mixture 2. 70 parts of ethyl acetate was added to the mixture 2, and then an organic layer was separated to extract a product. Furthermore, the extraction operation using 70 parts of ethyl acetate was performed twice.

The obtained organic layer was repeatedly subjected to a water washing operation with 70 parts of pure water to be washed until the pH of the aqueous layer reached about 7. The water washing operation was performed 3 times.

Next, the obtained organic layer was dehydrated using anhydrous magnesium sulfate, magnesium sulfate was filtered to be removed, and then the organic layer was condensed to obtain a crude product.

Impurities were removed from the crude product by silica gel column chromatography using a solvent to collect a fraction containing a target substance. The solvent was removed from the obtained fraction, and then the exemplary compound No. 45 (Compound in the right side of the reaction formula (1)) which is a target substance was purified. The amount of yield was 7.1 parts and the yield was 78%.

The surface layer of the electrophotographic photosensitive member of the present invention contains the polymerized product of the hole transporting compound according to the present invention. The polymerized product may be a polymerized product of a composition containing the hole transporting compound according to the present invention and a compound which has a polymerizable functional group and does not have a hole transporting structure. In that case, it is suitable for the compound which has a polymerizable functional group and does not have a hole transporting structure to have two or more polymerizable functional groups. A combination of compounds include, for example, a combination of the hole transporting compound according to the present invention having one polymerizable functional group and a compound which has three polymerizable functional groups and does not have a hole transporting structure.

Usable as the polymerizable functional group of the compound which has a polymerizable functional group and does not have hole transportation ability are the same substances as the substances mentioned as the polymerizable functional group of the hole transporting compound according to the present invention. The polymerizable functional group of the compound which has a polymerizable functional group and does not have hole transportation ability is suitably a polymerizable functional group which can be subjected to the same kinds of polymerization manners as the polymerization manners which can be subjected to the hole transporting compound according to the present invention. For example, when the polymerizable functional group of the hole transporting compound according to the present invention is a chain polymerizable functional group (radically polymerizable functional group), the polymerizable functional group of the compound which has a polymerizable functional group and does not have hole transporting is also suitably a chain polymerizable functional group (radically polymerizable functional group). The chain polymerizable functional group (radically polymerizable functional group) includes, for example, a styryl group, a vinyl group, an acryloyloxy group, a methacryloyloxy group, and the like. Among the above, the acryloyloxy group and the methacryloyloxy group are suitable.

An "n-functional" described below means having n polymerizable functional groups. For example, monofunctional means having one polymerizable functional group and bifunctional means having two polymerizable functional groups.

The compound which has a polymerizable functional group and does not have a hole transporting structure includes, for example, compounds (polymerizable monomers) shown below.

Monofunctional polymerizable monomers include, for example, ethyl acrylate, n-propyl acrylate, n-butyl acrylate, isobutyl acrylate, 2-ethylhexyl acrylate, 2-hydroxyethyl acrylate, tetrahydrofurfuryl acrylate, benzyl acrylate, cyclohexyl acrylate, ethoxy-diethylene glycol acrylate, isoamyl acrylate, lauryl acrylate, stearyl acrylate, phenoxyethyl acrylate, phenoxy diethylene glycol acrylate, ethoxylated o-phenylphenol acrylate, and the like.

Bifunctional polymerizable monomers include, for example, 1,4-butanediol acrylate, 1,5-pentanediol diacrylate, 3-methyl-1,5-pentanediol diacrylate, 1,6-hexanediol acrylate, 1,9-nonanediol diacrylate, 1,10-decanediol diacrylate, triethylene glycol diacrylate, neopentyl glycol diacrylate, tricyclodecane dimethanol diacrylate, and the like.

Trifuncational polymerizable monomer includes, for example, trimethylol propane triacrylate, pentaerythritol triacrylate, ethoxylated isocyanuric acid triacrylate, and the like.

Tetrafunctional polymerizable monomers include, for example, pentaerythritol tetraacrylate, dimethylol propane tetraacrylate, and the like.

Hexafunctional polymerizable monomers include, for example, dipentaerythritol hexaacrylate and the like.

The compounds mentioned above are compounds (acrylate monomers) having an acryloyloxy group as the polymerizable functional group. However, compounds (polymerizable monomers) in which the acryloyloxy group of the compounds mentioned above is replaced by other polymerizable functional groups, such as a methacryloyloxy group, can also be mentioned.

The molecular weight of the compound which has a polymerizable functional group and does not have hole transportation ability is preferably 100 or more and 1,000 or less.

In the surface layer of the electrophotographic photosensitive member, fine particles may be contained from the viewpoint of abrasion resistance. The fine particles may be inorganic fine particles or may be organic fine particles.

The inorganic fine particles include, for example, particles containing inorganic oxides, such as aluminum oxide (alumina), silicon oxide (silica), zinc oxide, tin oxide, and titanium oxide (titania).

The organic fine particles include, for example, particles containing resin, such as polyolefin, polytetrafluoroethylene, polystyrene, polyacrylic acid ester, polymethacrylic acid ester, polyamide, polyester, and polyurethane.

The surface layer of the electrophotographic photosensitive member of the present invention can be formed by forming a coating film of a coating liquid for surface layer containing the hole transporting compound according to the present invention and a solvent, and then drying and/or curing the coating film.

The solvent for use in the coating liquid for surface layer include, for example, an alcohol solvent, a sulfoxide solvent, a ketone solvent, an ether solvent, an ester solvent, an aliphatic halogenated hydrocarbon solvent, an aromatic hydrocarbon solvent, and the like.

The film thickness of the surface layer of the electrophotographic photosensitive member is preferably 0.1 μm or more and 15 μm or less when the surface layer is a protective layer and is preferably 5 μm or more and 40 μm or less when the surface layer is a charge transport layer.

As a method for curing the coating film of the coating liquid for surface layer (polymerizing the hole transporting compound according to the present invention), the same methods as the methods for polymerizing the polymerizable functional group described above can be mentioned. Among the methods, the method using radiations is suitable. Among radiations, an electron beam is suitable.

When the hole transporting compound according to the present invention is polymerized using electron beams, a surface layer having a very dense (high density) three-dimensional network structure is formed, so that the abrasion resistance of the electrophotographic photosensitive member increases.

In the case of using electron beams, mentioned as an accelerator are a scanning type, an electrocurtain type, a broad beam type, a pulse type, a laminar type, and the like, for example.

In the case of using electron beams, an accelerating voltage of the electron beams is preferably 150 kV or less from the viewpoint of suppressing degradation of the properties of materials (hole transporting compound according to the present invention and the like) due to the electron beams and from the viewpoint of polymerization efficiency. The absorbed dose of the electron beams on the surface of the coating film of the coating liquid for surface layer is preferably 5 kGy or more and 50 kGy or less and more preferably 1 kGy or more and 10 kGy or less.

When polymerizing the hole transporting compound according to the present invention using electron beams, it is suitable that the electron beams are emitted in an inactive gas atmosphere, and then heating is performed in an inactive gas atmosphere from the viewpoint of suppressing the polymerization inhibitory action by oxygen. The inactive gas includes nitrogen, argon, helium, and the like, for example.

Next, the entire configuration of the electrophotographic photosensitive member of the present invention is described.

Electrophotographic Photoconductor

The electrophotographic photosensitive member of the present invention has a support and a photosensitive layer provided on the support. A suitable configuration of the photosensitive layer is a configuration (Multilayer type photosensitive layer/Function separation type photosensitive layer) of a function separation type configuration in which a charge generation layer and a hole transport layer are laminated in this order from the upper side of the support. As required, a conductive layer and an undercoat layer may be provided between the charge generation layer and the support and a protective layer may be provided on the hole transport layer.

In the surface layer of the electrophotographic photosensitive member of the present invention, a polymerized product of the hole transporting compound according to the present invention is blended. In the present invention, the surface layer of the electrophotographic photosensitive member refers to the protective layer when the electrophotographic photosensitive member has the protective layer and refers to the hole transport layer when no protective layer is provided.

Support

The support for use in the electrophotographic photosensitive member of the present invention is suitably one having conductivity (conductive support).

Materials of the support include metal or alloys, such as iron, copper, gold, silver, aluminum, zinc, titanium, lead, nickel, tin, antimony, indium, chromium, aluminum alloy, and stainless steel, for example. Moreover, a metal support and a resin support having a coating film formed by vacuum deposition of aluminum, aluminum alloy, indium oxide-tin oxide alloy, and the like can also be used. Moreover, a support obtained by impregnating plastic or paper with conductive particles, such as carbon black, tin oxide particles, titanium oxide particles, and silver particles, and a support containing conductive resin can also be used.

The shape of the support includes a cylindrical shape, a belt shape, a sheet shape, a plate shape, and the like, for example. Among the above, the cylindrical shape is suitable.

The surface of the support may be subjected to processing, such as cutting processing, roughening processing, and alumite processing, for the purpose of suppressing interference fringes due to scattering of laser light, an improvement of defects of the surface of the support, an improvement of the conductivity of the support, and the like.

Between the support and the undercoat layer or the charge generation layer described later, a conductive layer may be provided for the purpose of suppressing interference fringes due to scattering of laser light, controlling the resistance, and coating of damages of the support.

The conductive layer can be formed by applying a coating liquid for conductive layer obtained by dispersing carbon black, a conductive pigment, a resistance regulation pigment, and the like together with a binding resin to form a coating film, and then drying and/or curing the obtained coating film. In the coating liquid for conductive layer, a compound which is cured and polymerized by heating, emission of ultraviolet rays, emission of radiations, or the like may be blended. The conductive layer containing the conductive pigment or the resistance regulation pigment, the surface tends to be roughened.

The film thickness of the conductive layer is preferably 0.1 μm or more and 50 μm or less, more preferably 0.5 μm or more and 40 μm or less, and more preferably 1 μm or more and 30 μm or less.

The binding resin for use in the conductive layer include, for example, polymers/copolymers of vinyl compounds, polyvinyl alcohol, polyvinyl acetal, polycarbonate, polyester, polysulfone, polyphenylene oxide, polyurethane, cellulose resin, phenol resin, melamine resin, silicon resin, epoxy resin, isocyanate resin, and the like.

The conductive pigment and the resistance regulation pigment include particles (conductive particles) of metals (alloys), such as aluminum, zinc, copper, chromium, nickel, silver, and stainless steel, those in which the particles are vapor-deposited on the surface of plastic particles, and the like, for example. Moreover, particles of metal oxides, such as zinc oxide, titanium oxide, tin oxide, antimony oxide, indium oxide, bismuth oxide, indium oxide doped with tin, and tin oxide doped with antimony and tantalum, and the like are mentioned. Only one of these substances may be used or two or more thereof may be used in combination.

Between the support or the conductive layer and the charge generation layer, an undercoat layer (intermediate layer) may be provided for the purpose of an improvement of the adhesiveness of the charge generation layer, an improvement of the hole injection properties from the support, and protection against electrical breakdown of the charge generation layer, and the like.

The undercoat layer can be formed by applying a coating liquid for undercoat layer obtained by dissolving a binding resin and the like in a solvent to form a coating film, and then drying and/or curing the obtained coating film.

The binding resin for use in the undercoat layer includes, for example, polyvinyl alcohol, poly-N-vinyl imidazole, polyethylene oxide, ethyl cellulose, an ethylene-acrylic acid copolymer, casein, polyamide, N-methoxy methylated 6 nylon resin, copolymerized nylon resin, phenol resin, polyurethane, epoxy resin, acrylic resin, melamine resin, polyester, and the like.

In the undercoat layer, metal oxide particles may be blended.

The metal oxide particles include particles containing metal oxides, such as titanium oxide, zinc oxide, tin oxide, zirconium oxide, and aluminum oxide, and the like, for example. The surface of the metal oxide particles may be treated by a surface treatment agent, such as a silane coupling agent.

In the undercoat layer, organic resin particles, a leveling agent, and the like may be blended.

The film thickness of the undercoat layer is preferably 0.05 μm or more and 30 μm or less and more preferably 1 μm or more and 25 μm or less.

The charge generation layer can be formed by applying a coating liquid for charge generation layer obtained by dispersing a charge generation material together with a binding resin and a solvent to form a coating film, and then drying the obtained coating film. The charge generation layer may be a vapor deposited film of a charge generation material.

The charge generation material includes, for example, an azo pigment, a phthalocyanine pigment, an indigo pigment, a perylene pigment, a polycyclic quinone pigment, a squarylium pigment, a pyrylium salt, a thiapyrylium salt, a triphenylmethane dye, a quinacridone pigment, an azulenium salt pigment, a cyanine dye, an anthanthrone pigment, a pyranthrone pigment, a xanthene pigment, a quinonimine dye, a styryl pigment, and the like. Only one of these charge generation materials may be used or two or more kinds thereof may be used in combination. Among the charge generation materials, the phthalocyanine pigment and the azo pigment are suitable from the viewpoint of sensitivity and, among the pigments, the phthalocyanine pigment is more suitable.

Among phthalocyanine pigments, oxytitanium phthalocyanines, chlorogallium phthalocyanines, and hydroxygallium phthalocyanines show excellent charge generation efficiency. Among the hydroxy gallium phthalocyanines, a hydroxygallium phthalocyanine crystal having a crystal form having peaks at Bragg angles 2θ of 7.4°±0.3° and 28.2°±0.3° in the CuKα characteristic X-ray diffraction is suitable from the viewpoint of sensitivity.

The binding resin for use in the charge generation layer include, for example, polymers/copolymers of vinyl compounds, polyvinyl alcohol, polyvinyl acetal, polycarbonate, polyester, polysulfone, polyphenylene oxide, polyurethane, cellulose resin, phenol resin, melamine resin, silicon resin, epoxy resin, and the like.

The mass ratio of the charge generation material and the binding resin (Charge generation layer/Binding resin) in the charge generation layer is preferably in the range of 1/4 or more and 1/0.3 or less.

The film thickness of the charge generation layer is preferably 0.05 μm or more and 1 μm or less and more preferably 0.1 μm or more and 0.5 μm or less.

When the hole transport layer is the surface layer, the polymerized product of the hole transporting compound according to the present invention is contained as described above.

When providing the protective layer on the hole transport layer, the hole transport layer can be formed by applying a coating liquid for hole transport layer obtained by dissolving a hole transporting compound, a binding resin, and the like in a solvent to form a coating film, and then drying the obtained coating film.

The hole transporting compound includes, for example, a carbazole compound, a hydrazone compound, an N,N-dialkyl aniline compound, a diphenylamine compound, a triphenylamine compound, a triphenylmethane compound, a pyrazoline compound, a styryl compound, a stilbene compound, and the like.

The binding resin for use in the hole transport layer includes, acrylic acid ester, methacrylic acid ester, polyvinyl alcohol, polyvinyl acetal, polycarbonate, polyester, and the like, for example. Moreover, curable resin, such as curing type phenol resin, curing type urethane resin, curing type melamine resin, curing type epoxy resin, curing type acrylic resin, and curing type methacrylic resin, is mentioned.

The solvent for use in the coating liquid for hole transport layer includes an alcohol solvent, a sulfoxide solvent, a ketone solvent, an ether solvent, an ester solvent, an aliphatic halogenated hydrocarbon solvent, an aromatic hydrocarbon solvent, and the like, for example.

The film thickness of the hole transport layer is preferably 1 μm or more and 100 μm or less, more preferably 3 μm or more and 50 μm or less, and still more preferably 5 μm or more and 40 μm or less.

To each layer of the electrophotographic photosensitive member of the present invention, various kinds of additives can be added. The additives include an organic pigment, an organic dye, a coating film surface regulator, an electron transporting compound, oil, wax, an antioxidant, a light absorption agent, a polymerization initiator, a radical inactivator, organic resin particles, inorganic particles, and the like, for example.

The surface of each layer of the electrophotographic photosensitive member may be surface treated using a polishing sheet, a shape transfer mold member, glass beads, zirconia beads, and the like, for example. Irregularities may be formed in the surface of each layer utilizing the constituent materials of the coating liquid.

Methods for applying the coating liquid for each layer described above include, a dip coating method, a spray coating method, a circular amount regulating (ring) coating method, a spin coating method, a roller coating method, a Meyer Bar coating method, a blade coating method, and the like, for example.

Next, an electrophotographic apparatus having a process cartridge having the electrophotographic photosensitive member of the present invention is described.

An example of the electrophotographic apparatus of the present invention is illustrated in FIG. 1.

In FIG. 1, a cylindrical electrophotographic photosensitive member 1 of the present invention is rotated and driven at a predetermined circumferential velocity in the direction indicated by the arrow. The circumferential surface (surface) of the electrophotographic photosensitive member 1 to be rotated and driven is charged to a predetermined positive or negative potential by a charging device 2. Then, the circumferential surface of the charged electrophotographic photosensitive member 1 receives exposure light (image exposure light) 3 output from an exposing device (not illustrated), such as a slit exposure and a laser beam scanning exposure. Thus, an electrostatic latent image corresponding to a target image is formed on the circumferential surface of the electrophotographic photosensitive member 1. A voltage to be applied to the charging device (charging roller and the like) 2 may be either a voltage in which an AC component is superimposed on a DC component or a voltage containing only a DC component.

The electrostatic latent image formed on the circumferential surface of the electrophotographic photosensitive member 1 is developed with a toner contained in a developing agent of a developing device 4 to be formed into a toner image. Then, the toner image formed on the circumferential surface of the electrophotographic photosensitive member 1 is transferred to a transfer material (paper and the like) 6 by a transfer bias from a transfer device (transfer roller and the like) 5. The transfer material 6 is fed synchronizing with the rotation of the electrophotographic photosensitive member 1.

The circumferential surface of the electrophotographic photosensitive member 1 after the toner image is transferred to the transfer material is cleaned by the removal of an untransferred toner by a cleaning device 8, and then subjected to static elimination treatment by emission of pre-exposure light 7 from a pre-exposing device (not illustrated). Thus, the electrophotographic photosensitive member 1 is repeatedly used for image formation. The pre-exposure process may be performed before or after the cleaning process. The cleaning device and the pre-exposing device are not necessarily required.

A plurality of constituent components among constituent components selected from the group consisting of the electrophotographic photosensitive member 1, the charging device 2, the developing device 4, the cleaning device 8, and the like may be accommodated in a container and integrally processed to constitute a process cartridge 9. Then, the process cartridge 9 may be attachable/detachable to/from an electrophotographic apparatus body.

In FIG. 1, the electrophotographic photosensitive member 1 and the charging device 2, the developing device 4, and the cleaning device 8 are integrally supported to form the process cartridge 9 which is attachable/detachable to/from the electrophotographic apparatus body.

Figure 2:
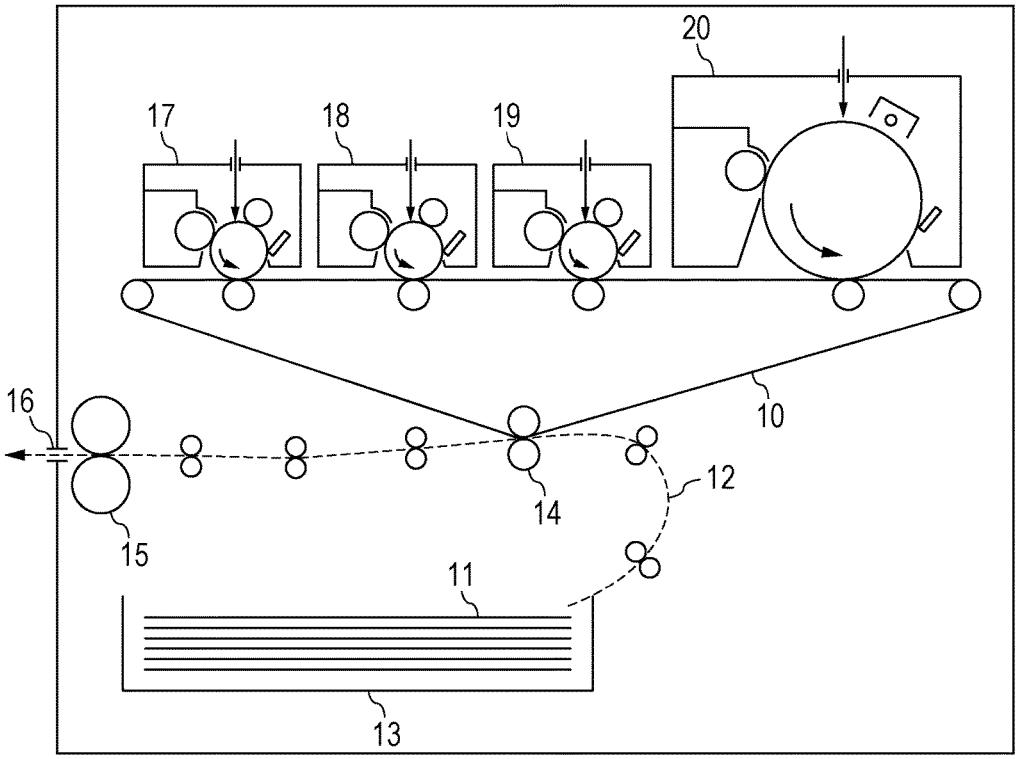
FIG. 2 is a view illustrating another example of an electrophotographic apparatus.

Another example of the electrophotographic apparatus of the present invention is illustrated in FIG. 2.

In FIG. 2, a process cartridge 17 for yellow color, a process cartridge 18 for magenta color, a process cartridge 19 for cyan color, and a process cartridge 20 for black color are disposed side by side along an intermediate transfer body 10. There is no necessity of unifying the diameter and the constituent materials of the electrophotographic photosensitive member, a developing agent, a charging system, and other devices in each color. For example, in the electrophotographic apparatus of FIG. 2, the diameter of the electrophotographic photosensitive member for black color is larger than the diameters of the electrophotographic photosensitive members for yellow color, magenta color, and cyan color. Moreover, while the charging system for each of yellow color, magenta color, and cyan color is a system of applying a voltage in which an AC component is superimposed on a DC component to a charging roller, the charging system for black color is a system using corona discharge.

When an image formation operation starts, a toner image of each color is transferred one by one to the intermediate transfer body 10 in place of the transfer material, and then laminated according to the almost same image formation process as that described with reference to FIG. 1. In parallel to the process, the transfer material 11 is fed out from a paper feed tray 13 through a paper feed path 12, and then fed to a secondary transfer device 14 synchronizing the timing with the rotation operation of the intermediate transfer body 10. The toner image containing a laminate of each color on the intermediate transfer body 10 is transferred to the transfer material 11 by a transfer bias from the secondary transfer device 14. The toner image transferred onto the transfer material 11 is conveyed along the paper feed path 12, fixed onto the transfer material 11 by a fixing device 15, and then discharged from a paper discharge unit 16.

EXAMPLES

Hereinafter, the present invention is described in detail with reference to specific Examples. In Examples below, "part(s)" means "mass part(s)". An electrophotographic photosensitive member is also simply referred to as a "photoconductor".

Manufacturing of Electrophotographic Photosensitive Member

Example 1

A cylindrical aluminum cylinder having an outer diameter of 30.0 mm, a length of 357.5 mm, and a thickness of 0.7 mm was used as a support (conductive support).

Next, 10 parts of zinc oxide particles (Specific surface area: 19 $m^2/g$, Powder resistivity: $4.7\times10^6$ Ω·cm) was stirred and mixed with 50 parts of toluene, 0.08 part of a silane coupling agent was added thereto, and then the mixture was stirred for 6 hours. Thereafter, the toluene was distilled off under reduced pressure, and then dried by heating at 130° C. for 6 hours to thereby obtain zinc oxide particles whose surface was treated. As the silane coupling agent, N-2-(aminoethyl)-3-aminopropyl methyl dimethoxy silane (Trade name: KBM602, manufactured by Shin-Etsu Chemical Co., Ltd.) was used.

Next, 15 parts of polyvinyl butyral (Weight average molecular weight: 40,000, Trade name: BM-1, manufactured by Sekisui Chemical Co., Ltd.) and 15 parts of blocked isocyanate (Trade name: Sumidur 3175, manufactured by Sumika Bayer Urethane Co., Ltd.) were dissolved in a mixed solvent of 73.5 parts of methyl ethyl ketone/73.5 parts of 1-butanol to obtain a solution. To the solution, 80.8 parts of the surface-treated zinc oxide particles above and 0.8 part of 2,3,4-trihydroxy benzophenone (manufactured by Tokyo Kasei Kogyo Co., Ltd.) were added, and the mixture was dispersed in a 23±3° C. atmosphere for 3 hours with a sand mill apparatus employing glass beads having a diameter of 0.8 mm. After the dispersion, 0.01 part of silicone oil (Trade name: SH28PA, manufactured by Toray Dow Corning Corporation), 5.6 parts of crosslinked polymethyl methacrylate (PMMA) particles (Average primary particle size of 2.5 μm, Trade name: TECHPOLYMERSSX-102, manufactured by Sekisui Plastics Co., Ltd.) were added and stirred to prepare a coating liquid for undercoat layer.

The coating liquid for undercoat layer was applied to the support by dipping to form a coating film, and then the coating film was dried at 160° C. for 40 minutes to form an undercoat layer having a film thickness of 18 μm.

Next, a hydroxy gallium phthalocyanine crystal (charge generation material) of a crystal form having peaks at Bragg angles (2θ±0.2°) of 7.4° and 28.2° in the CuKα characteristic X-ray diffraction was prepared. 2 parts of the hydroxy gallium phthalocyanine crystal, 0.02 part of a calyx arene compound represented by the following formula (A), (A)

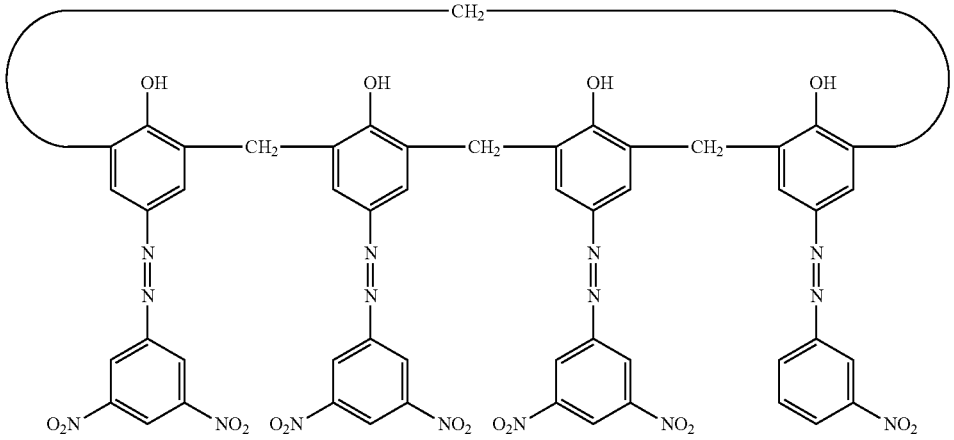

1 part of polyvinyl butyral (Trade name: Ethlec BX-1, manufactured by Sekisui Chemical Co., Ltd.), and 60 parts of cyclohexanone were placed in a sand mill employing glass beads having a diameter of 1 mm to be dispersed for 4 hours. Thereafter, 70 parts of ethyl acetate was added to prepare a coating liquid for charge generation layer.

The coating liquid for charge generation layer was applied onto the undercoat layer to form a coating film, and then drying the obtained coating film at 80° C. for 15 minutes to form a charge generation layer having a film thickness of 0.17 μm.

Next, 6 parts of a compound represented by the following formula (B), 3 parts of a compound represented by the following formula (C), 1 part of a compound represented by the following formula (D), (B)

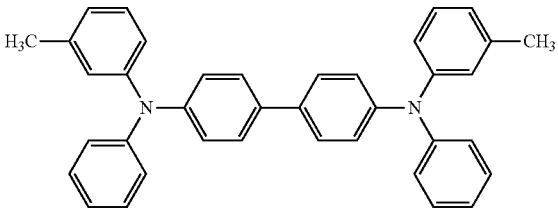

(C)

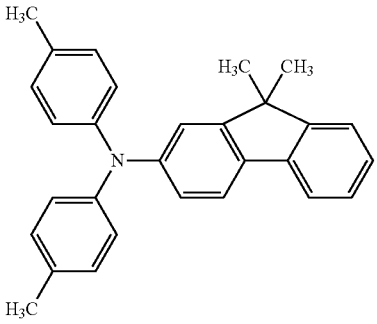

-continued (D)

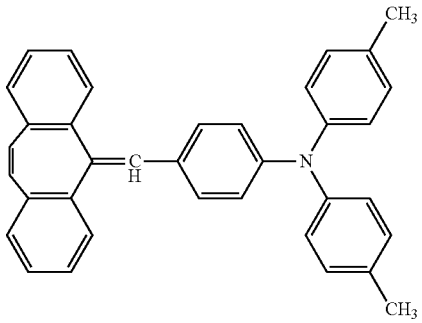

and 10 parts of bisphenol Z type polycarbonate (Trade name: Iupilon Z400, manufactured by Mitsubishi Engineering Plastics) were dissolved in a mixed solvent of 60 parts of monochlorobenzene/20 parts of dimethoxy methane to thereby prepare a coating liquid for hole transport layer.

The coating liquid for hole transport layer was applied onto the charge generation layer by dipping to form a coating film, and then the obtained coating film was dried at 100° C. for 50 minutes to thereby form a hole transport layer having a film thickness of 18 μm.

Next, 3 parts of the exemplary compound No. 45 was dissolved in a mixed solvent of 5 parts of 1-methoxy-2-propanol/2 parts of ethylene glycol dimethyl ether to thereby prepare a coating liquid for protective layer.

The coating liquid for protective layer was applied onto the hole transport layer by dipping to form a coating film, the obtained coating film was dried at 50° C. for 10 minutes, and then the dried coating film was polymerized and cured by emission of electron beams and heating under the following conditions.

The support (cylindrical aluminum cylinder) to which the coating film of the coating liquid for protective layer was applied was rotated at a speed of 300 rpm in an atmosphere with an oxygen concentration of 100 ppm or less. The coating film was irradiated with electron beams using an electron beam emitting apparatus while rotating. The electron beam emission conditions are an emission distance of 30 mm, an accelerating voltage of 70 kV, a beam current of 10 mA, and an emission period of time of 6.4 seconds.

After the emission of electron beams, the temperature of the surface of the coating film was made to reach 130° C.

over 20 seconds using an induction heating apparatus, and then taken out into the air atmosphere. Then, the coating film was further heated at 100° C. for 10 minutes to thereby form a protective layer having a film thickness of 3 μm.

Thus, a cylindrical electrophotographic photosensitive member having the support and the undercoat layer, the charge generation layer, the charge transport layer, and the protective layer formed one by one on the support was manufactured. The obtained electrophotographic photosensitive member was used as Example photoconductor 1.

A structure other than the polymerizable functional group of the exemplary compound No. 45 has a conjugated structure containing continuously bonded 34 sp2 carbon atoms. Moreover, the conjugated structure has a condensed polycyclic structure (pyrene structure) containing continuously bonded 16 sp2 carbon atoms and a condensed polycyclic structure (fluorene structure) containing continuously bonded 12 sp2 carbon atoms.

Example 2

Example photoconductor 2 was manufactured in the same manner as Example photoconductor 1, except changing the exemplary compound No. 45 to the exemplary compound No. 36.

A structure other than the polymerizable functional group of the exemplary compound No. 36 has a conjugated structure containing continuously bonded 28 sp2 carbon atoms. The conjugated structure has a condensed polycyclic structure (pyrene structure) containing continuously bonded 16 sp2 carbon atoms and a condensed polycyclic structure (fluorene structure) containing continuously bonded 12 sp2 carbon atoms.

Example 3

Example photoconductor 3 was manufactured in the same manner as Example photoconductor 1, except forming a protective layer as follows.

4 parts of the exemplary compound No. 51 was dissolved in 100 parts of ethylene glycol dimethyl ether to thereby prepare a coating liquid for protective layer.

The coating liquid for protective layer was applied onto the hole transport layer by a spray to form a coating film, and then the obtained coating film was dried at 50° C. for 10 minutes. Then, emission of electron beams and heating before taking out the coating film into the air atmosphere were performed under the same conditions as those in Example 1. Then, the coating film after heating was taken out into the air atmosphere, and then further heated at 100° C. for 10 minutes to thereby form a protective layer having a film thickness of 3 μm.

A structure other than the polymerizable functional group of the exemplary compound No. 51 has a conjugated structure containing continuously bonded 34 sp2 carbon atoms. The conjugated structure has a condensed polycyclic structure (fluoranthene structure) containing continuously bonded 16 sp2 carbon atoms and a condensed polycyclic structure (fluorene structure) containing continuously bonded 12 sp2 carbon atoms.

Examples 4 to 7

The exemplary compound No. 51 used in Example 3 was changed to the exemplary compound No. 57 (Example 4), the exemplary compound No. 60 (Example 5), the exemplary compound No. 83 (Example 6), and the exemplary compound No. 92 (Example 7) in each Example. Example photoconductors 4 to 7 were manufactured in the same manner as Example photoconductor 3, except the change of the exemplary compound.

A structure other than the polymerizable functional group of the exemplary compound No. 57 has a conjugated structure containing continuously bonded 32 sp2 carbon atoms. The conjugated structure has a condensed polycyclic structure (anthracene structure) containing continuously bonded 14 sp2 carbon atoms and a condensed polycyclic structure (fluorene structure) containing continuously bonded 12 sp2 carbon atoms.

A structure other than the polymerizable functional group of the exemplary compound No. 60 has a conjugated structure containing continuously bonded 36 sp2 carbon atoms. The conjugated structure has three units of condensed polycyclic structures (fluorene structure) containing continuously bonded 12 sp2 carbon atoms.

A structure other than the polymerizable functional group of the exemplary compound No. 83 has a conjugated structure containing continuously bonded 40 sp2 carbon atoms. The conjugated structure has a condensed polycyclic structure (pyrene structure) containing continuously bonded 16 sp2 carbon atoms and two units of condensed polycyclic structures (fluorene structure) containing continuously bonded 12 sp2 carbon atoms.

A structure other than the polymerizable functional group of the exemplary compound No. 92 has a conjugated structure containing continuously bonded 38 sp2 carbon atoms. The conjugated structure has a condensed polycyclic structure (anthracene structure) containing continuously bonded 14 sp2 carbon atoms and two units of condensed polycyclic structures (fluorene structure) containing continuously bonded 12 sp2 carbon atoms.

Example 8

The same aluminum cylinder as that used in Example photoconductor 1 was used as a support.

Next, 60 part of titanium oxide ($TiO_2$) particles coated with oxygen deficient tin oxide ($SnO_2$) (Powder resistivity: 100 Ω·cm, Coverage of tin oxide ($SnO_2$) (Mass ratio): 35%), 36.5 parts of phenol resin (Resin solid content: 60%, Trade name: Pliophen J-325, manufactured by Dainippon Ink & Chemicals, Inc.), and 20 parts of methoxy propanol as a solvent were placed in a sand mill dispersing machine employing glass beads having a diameter of 1 mm to be dispersed to thereby obtain a dispersion liquid.

The glass beads were removed from the obtained dispersion liquid with a mesh. Thereafter, 1.6 parts of silicone resin particles (Average particle diameter: 2 μm, Trade name: Tospearl 120, manufactured by GE Toshiba Silicones Co., Ltd.) and 0.008 part of silicone oil (SH28PA) were added to the dispersion liquid, and then stirred to thereby prepare a coating liquid for conductive layer.

The average particle diameter of the titanium oxide particles coated with the oxygen deficient tin oxide in the coating liquid for conductive layer was 0.35 μm.

The coating liquid for conductive layer was applied onto the support by dipping to form a coating film, and then the obtained coating film was dried and cured at 140° C. for 30 minutes (heat curing) to thereby form a conductive layer having a film thickness of 18 μm.

Next, 10 parts of methoxy methylated 6 nylon resin (Trade name: Toresin EF-30T, manufactured by TEIKOKU CHEM IND CORP LTD) was dissolved in a mixed solvent of 100 parts of methanol/50 parts of n-butanol to thereby prepare a coating liquid for undercoat layer.

The coating liquid for undercoat layer was applied onto the conductive layer by dipping to form a coating film, and then the obtained coating film was dried at 100° C. for 30 minutes to thereby form an undercoat layer having a film thickness of 0.45 μm.

Then, a charge generation layer, a hole transport layer, and a protective layer were formed in this order to manufacture Example photoconductor 8 in the same manner as in Example 1.

Example 9

Example photoconductor 9 was manufactured in the same manner as Example photoconductor 1, except forming a protective layer as follows.

10 parts of the examplary compound No. 12, 10 parts of trimethylol propane triacrylate, 2 parts of 1-hydroxy cyclohexyl phenyl ketone as a photopolymerization initiator, 2 parts of 2,2-bis(4,4-di-t-butylperoxycyclohexyl)propane, and 580 parts of tetrahydrofuran were mixed to thereby prepare a coating liquid for protective layer.

The coating liquid for protective layer was applied onto the hole transport layer by a spray to form a coating film, the obtained coating film was dried at 45° C. for 10 minutes, and then photocuring treatment was performed under the following conditions.

An aluminum cylinder (support) to which the coating film of the coating liquid for protective layer was applied was rotated at a speed of 100 rpm under an atmosphere with an oxygen concentration of 6,000 to 8,000 ppm. The coating film was irradiated with light using a metal halide lamp having an output 160 W/cm while rotating. The light emission conditions are an emission distance of 100 mm, an emission intensity of 600 mW/cm$^2$, and an emission period of time of 2 minutes. After the light emission, the coating film was heated at 135° C. for 30 minutes to thereby form a protective layer having a film thickness of 3 μm.

Thus, Example photoconductor 9 was manufactured.

A structure other than the polymerizable functional group of the exemplary compound No. 12 has a conjugated structure containing continuously bonded 28 sp2 carbon atoms. The conjugated structure has a condensed polycyclic structure (pyrene structure) containing continuously bonded 16 sp2 carbon atoms and a condensed polycyclic structure (fluorene structure) containing continuously bonded 12 sp2 carbon atoms.

Example 10

Example photoconductor 10 was manufactured in the same manner as Example photoconductor 9, except changing the exemplary compound No. 12 to the exemplary compound No. 18.

A structure other than the polymerizable functional group of the exemplary compound No. 18 has a conjugated structure containing continuously bonded 32 sp2 carbon atoms. The conjugated structure has a condensed polycyclic structure (anthracene structure) containing continuously bonded 14 sp2 carbon atoms and a condensed polycyclic structure (fluorene structure) containing continuously bonded 12 sp2 carbon atoms.

Example 11

Example photoconductor 11 was manufactured in the same manner as Example photoconductor 9, except changing 10 parts of the exemplary compound No. 12 and 10 parts of trimethylol propane triacrylate to 20 parts of the exemplary compound No. 26.

A structure other than the polymerizable functional group of the exemplary compound No. 26 has a conjugated structure containing continuously bonded 32 sp2 carbon atoms. The conjugated structure has a condensed polycyclic structure (anthracene structure) continuously bonded containing 14 sp2 carbon atoms and a condensed polycyclic structure (fluorene structure) containing continuously bonded 12 sp2 carbon atoms.

Example 12

Example photoconductor 12 was manufactured in the same manner as Example photoconductor 1, except forming a protective layer as follows.

10 parts of the exemplary compound No. 90, 10 parts of 1,6-hexanediol diacrylate, and 570 parts of tetrahydrofuran were mixed to thereby prepare a coating liquid for protective layer.

The coating liquid for protective layer was applied onto the hole transport layer by a spray to form a coating film, the obtained coating film was irradiated with electron beams by the same method and under the same conditions as those of Example 1, and then the coating film was heated to form a protective layer having a film thickness of 3 μm.

A structure other than the polymerizable functional group of the exemplary compound No. 90 has a conjugated structure containing continuously bonded 38 sp2 carbon atoms. The conjugated structure has a condensed polycyclic structure (anthracene structure) containing continuously bonded 14 sp2 carbon atoms and two units condensed polycyclic structures (fluorene structure) containing continuously bonded 12 sp2 carbon atoms.

Example 13

Example photoconductor 13 was manufactured in the same manner as Example photoconductor 1, except forming a protective layer as follows.

4 parts of the exemplary compound No. 100 and 0.01 part of p-toluenesulfonic acid were dissolved in 100 parts of tetrahydrofuran to thereby prepare a coating liquid for protective layer.

The coating liquid for protective layer was applied onto the hole transport layer by a spray to form a coating film, and then the obtained coating film was dried and cured (heat curing) at 150° C. for 60 minutes to thereby form a protective layer having a film thickness of 5 μm.

A structure other than the polymerizable functional group of the exemplary compound No. 100 has a conjugated structure containing continuously bonded 40 sp2 carbon atoms. The conjugated structure has a condensed polycyclic structure (pyrene structure) containing continuously bonded 16 sp2 carbon atoms and two units condensed polycyclic structures (fluorene structure) containing continuously bonded 12 sp2 carbon atoms.

Example 14

Example photoconductor 14 was manufactured in the same manner as Example photoconductor 1, except forming a protective layer as follows.

4 parts of the exemplary compound No. 103 was dissolved in 100 parts of tetrahydrofuran to thereby prepare a coating liquid for protective layer.

The coating liquid for protective layer was applied onto the hole transport layer by a spray to form a coating film, and then the obtained coating film was dried and cured (heat curing) at 150° C. for 60 minutes to thereby form a protective layer having a film thickness of 5 μm.

A structure other than the polymerizable functional group of the exemplary compound No. 103 has a conjugated structure containing continuously bonded 34 sp2 carbon atoms. The conjugated structure has a condensed polycyclic structure (pyrene structure) containing continuously bonded 16 sp2 carbon atoms and a condensed polycyclic structure (fluorene structure) containing continuously bonded 12 sp2 carbon atoms.

Comparative Example 1

Comparative Example photoconductor 1 was manufactured in the same manner as Example photoconductor 1, except forming a protective layer as follows.

10 parts of the following comparative compound No. 1,

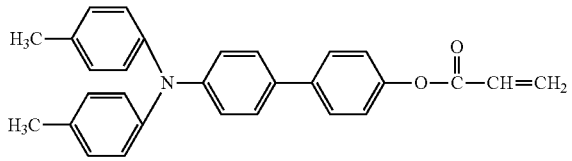

10 parts of trimethylolpropane triacrylate, 2 parts of 1-hydroxy cyclohexyl phenyl ketone as a polymerization initiator, 2 parts of 2,2-bis(4,4-di-t-butyl peroxycyclohexyl)propane, and 580 parts of tetrahydrofuran were mixed to thereby prepare a coating liquid for protective layer.

The coating liquid for protective layer was applied onto the hole transport layer by a spray to form a coating film, and then the obtained coating film was dried and cured (heat curing) at 45° C. for 10 minutes to thereby form a protective layer having a film thickness of 3 μm.

Comparative Example 2

Comparative Example photoconductor 2 was manufactured in the same manner as Example photoconductor 1, except forming a protective layer as follows.

10 parts of the following comparative compound No. 2,

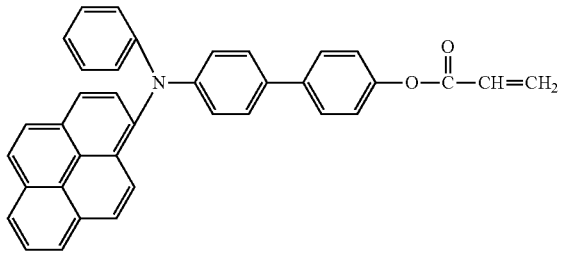

10 parts of 1,6-hexanediol diacrylate, and 570 parts of tetrahydrofuran were mixed to thereby prepare a coating liquid for protective layer.

The coating liquid for protective layer was applied onto the hole transport layer by a spray to form a coating film, the obtained coating film was irradiated with electron beams by the same method and under the same conditions as those of Example 1, and then the coating film was heated to thereby form a protective layer having a film thickness of 3 μm.

Comparative Example 3

Comparative Example photoconductor 3 was manufactured in the same manner as Example photoconductor 1, except forming a protective layer as follows.

4 parts of the following comparative compound No. 3

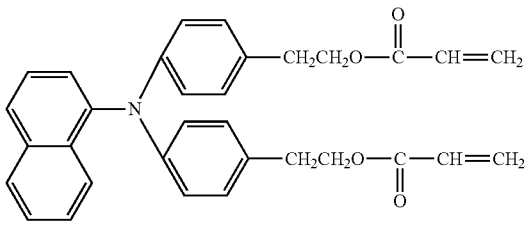

was dissolved in 100 parts of tetrahydrofuran to thereby prepare a coating liquid for protective layer.

The coating liquid for protective layer was applied onto the hole transport layer by a spray to form a coating film, the obtained coating film was irradiated with electron beams by the same method and under the same conditions as those of Example 1, and then the coating film was heated to thereby form a protective layer having a film thickness of 3 μm.

Comparative Example 4

Comparative Example photoconductor 4 was manufactured in the same manner as Example photoconductor 14, except forming a protective layer as follows.

4 parts of the following comparative compound No. 4

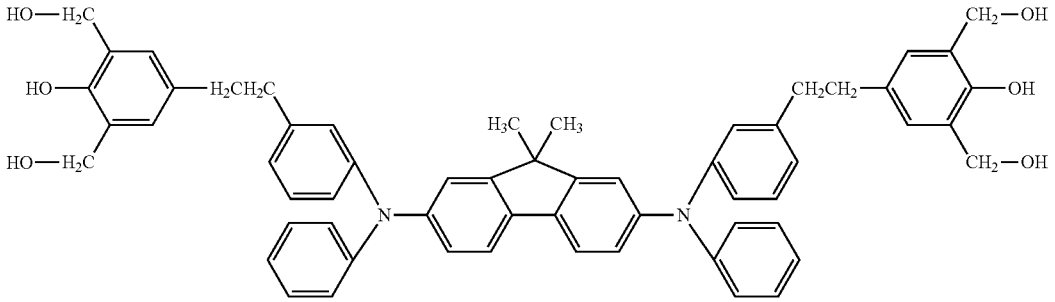

was dissolved in 100 parts of tetrahydrofuran to thereby prepare a coating liquid for protective layer.

The coating liquid for protective layer was applied onto the hole transport layer by a spray to form a coating film, and then the obtained coating film was dried and cured (heat curing) at 150° C. for 60 minutes to thereby form a protective layer having a film thickness of 4 μm.

Evaluation: Sensitivity and Residual Potential

The manufactured Example photoconductors 1 to 14 and Comparative Example photoconductors 1 to 4 were evaluated for sensitivity and residual potential under the following conditions.

A photoconductor test apparatus (Trade name: CYNTHIA59, manufactured by GEN-TECH, INC.) was used. First, the conditions of a charging device of the photoconductor test apparatus were set in such a manner that the surface of each electrophotographic photosensitive member was set to −700 V in an environment of a temperature of 23° C./humidity 50% RH.

The light quantity required for reducing the surface potential of the electrophotographic photosensitive member to −200 V from −700 V by irradiating the surface of the electrophotographic photosensitive member with a monochromatic light with a wavelength of 780 nm was measured, and then the light quantity was defined as the sensitivity ($\mu J/cm^2$) of the electrophotographic photosensitive member.

Moreover, the potential of the surface of the electrophotographic photosensitive member after irradiating the surface of the electrophotographic photosensitive member with light with a light having a light quantity of 20 ($\mu J/cm^2$) was measured, and the value was defined as a residual potential (V).

Evaluation: Image Deletion 1

The manufactured Example photoconductors 1 to 14 and Comparative Example photoconductors 1 to 4 were evaluated for image deletion 1 under the following conditions.

As an electrophotographic apparatus for use in the evaluation, a modified machine of iR-C3380F (Trade name) which is a copying machine manufactured by CANON KABUSHIKI KAISHA was used. The machine was modified in such a manner that the power (light quantity) of image exposure light (laser light), the amount of a current (hereinafter also referred to as "total current") flowing into the support of the electrophotographic photosensitive member from a charging roller, and an applied voltage to the charging roller were able to be adjusted and measured. The evaluation was performed in the state where a cassette heater (heater for electrophotographic photosensitive member) was removed.

First, the electrophotographic apparatus and Example photoconductors/Comparative Example photoconductors to be evaluated were allowed to stand in an environment of a temperature of 30° C./humidity of 80% RH for 24 hours or more, and then Example photoconductors/Comparative Example photoconductors to be evaluated were attached to a cartridge of cyan color for the electrophotographic apparatus.

Next, a solid image was output in a cyan single color using an A4 size plain paper, and the light quantity of image exposure light was set in such a manner that the density of the output image on the paper was set to 1.45 by a spectral densitometer (Trade name: X-rite504, manufactured by X-rite).

Next, the applied voltage to the charging roller was applied up to −1,600 V from −400 V at an interval of 100 V, and then the total current at each applied voltage was measured. Then, a graph in which the horizontal axis represents the applied voltage and the vertical axis represents the total current was created, and then the applied voltage was determined at which the current component deviating from the primary approximate curve at the applied voltages of −400 V to −800 V (hereinafter also referred to as "discharge current") was 100 μA. The amount of the current flowing into the support of the electrophotographic photosensitive member from the charging roller was set to the value of the total current at the applied voltage at which the discharge current was 100 μA.

Next, a square lattice image with an A4 size, a line width of 0.1 mm, and a line interval of 10 mm was read from a scanner of the copying machine, and then 5,000 images were continuously output in a cyan single color. After the images were output, the main power supply of the electrophotographic apparatus was shut off, and then the apparatus was allowed to stand for three days. After allowed to stand for three days, one image was output in the same manner as above from the square lattice image immediately after the main power supply of the electrophotographic apparatus was switched on. Then, the image deletion of the output image was visually confirmed, and then the image deletion 1 was evaluated under the following criteria.

The evaluation ranks were as follows.

Rank 5: Abnormalities are not observed in the lattice image.

Rank 4: Although the horizontal lines of the lattice image are broken, abnormalities are not observed in the vertical lines.

Rank 3: Although the horizontal lines of the lattice image disappear, abnormalities are not observed in the vertical lines.

Rank 2: The horizontal lines of the lattice image disappear and the vertical lines are broken.

Rank 1: The horizontal lines of the lattice image disappear and the vertical lines also disappear.

In this case, the horizontal lines in the lattice image refer to lines parallel to the cylindrical axis direction of the electrophotographic photosensitive member and the vertical lines refer to lines vertical to the cylindrical axis direction of the electrophotographic photosensitive member.

Evaluation: Abrasion Amount

The manufactured Example photoconductors 1 to 14 and Comparative Example photoconductors 1 to 4 were used and the abrasion amount of the protective layer of each electrophotographic photosensitive member was evaluated under the following conditions.

A modified machine of iR ADVANCE C5051F (Trade name) which is a copying machine manufactured by CANON KABUSHIKI KAISHA was used as an electrophotographic apparatus for use in the evaluation. The machine was modified in such a manner that the power (light quantity) of image exposure light (laser light) was able to be adjusted.

First, the film thickness of the protective layer of Example photoconductors/Comparative Example photoconductors to be evaluated before outputting 100,000 sheets was measured using an interference film thickness meter (Trade name: MCPD-3700, manufactured by Otsuka Electronics Co., Ltd.).

Next, the electrophotographic apparatus and Example photoconductors/Comparative Example photoconductors to be evaluated were allowed to stand in an environment of a temperature of 23° C./humidity of 50% RH for 24 hours or more, and then Example photoconductors/Comparative Example photoconductors to be evaluated were attached to a cartridge of cyan color for the electrophotographic apparatus.

Next, a halftone image was output in a cyan single color using an A4 size plain paper, and then the light quantity of image exposure light was set in such a manner that the density of the output image on the paper was set to 0.85 by a spectral densitometer (Trade name: X-rite504, manufactured by X-rite). Then, 100,000 images were continuously output.

Next, Example photoconductors/Comparative Example photoconductors to be evaluated were taken out from the electrophotographic apparatus, and then the film thickness of the protective layer after outputting the 100,000 image was measured. A difference (i.e., abrasion amount) in the film thickness of the protective layer before and after outputting the 100,000 images was calculated. The evaluation results are shown in Table 1.

TABLE 1

| | | Evaluation results of photoconductors | | | |
|---|---|---|---|---|---|
| | Hole transport material | Sensitivity [μJ/cm$^2$] | Residual potential [−V] | Image deletion 1 [Rank] | Abrasion amount [μm] |
| Ex. 1 | Exemplary compound No. 45 | 0.46 | 78 | 5 | 0.3 |
| Ex. 2 | Exemplary compound No. 36 | 0.44 | 81 | 5 | 0.3 |
| Ex. 3 | Exemplary compound No. 51 | 0.47 | 79 | 4 | 0.3 |
| Ex. 4 | Exemplary compound No. 57 | 0.43 | 73 | 5 | 0.2 |
| Ex. 5 | Exemplary compound No. 60 | 0.43 | 84 | 5 | 0.3 |
| Ex. 6 | Exemplary compound No. 83 | 0.42 | 76 | 4 | 0.2 |
| Ex. 7 | Exemplary compound No. 92 | 0.55 | 96 | 5 | 0.2 |
| Ex. 8 | Exemplary compound No. 45 | 0.46 | 77 | 5 | 0.3 |
| Ex. 9 | Exemplary compound No. 12 | 0.50 | 85 | 4 | 0.4 |
| Ex. 10 | Exemplary compound No. 18 | 0.47 | 85 | 4 | 0.4 |
| Ex. 11 | Exemplary compound No. 26 | 0.53 | 95 | 4 | 0.5 |
| Ex. 12 | Exemplary compound No. 90 | 0.45 | 80 | 5 | 0.2 |
| Ex. 13 | Exemplary compound No. 100 | 0.49 | 85 | 3 | 0.9 |
| Ex. 14 | Exemplary compound No. 103 | 0.48 | 75 | 4 | 0.8 |
| Comp. Ex. 1 | Comparative Exemplary compound No. 1 | 0.39 | 45 | 1 | 0.6 |
| Comp. Ex. 2 | Comparative Exemplary compound No. 2 | 0.38 | 40 | 1 | 0.8 |
| Comp. Ex. 3 | Comparative Exemplary compound No. 3 | 0.58 | 97 | 1 | 0.5 |
| Comp. Ex. 4 | Comparative Exemplary compound No. 4 | 0.38 | 52 | 2 | 0.8 |

In Example photoconductors 1 to 14, the hole transporting compound according to the present invention is used as the hole transporting compound of the protective layer. The hole transporting compound according to the present invention has a conjugated structure of imparting sufficient hole transportation ability as a hole transporting compound for electrophotographic photosensitive member and also has a halogen atom. Therefore, Example photoconductors 1 to 14 have sufficient electrophotographic properties and also have the effect of sufficiently suppressing the image deletion.

On the other hand, in Comparative Example photoconductors 1 to 4, aromatic amine compounds are used as the hole transporting compound of the protective layer. Therefore, although the sensitivity and the residual potential of the electrophotographic photosensitive member are good, the image deletion, which may result from chemical changes (degradation) of the polymerized product of the hole transporting compound in the surface layer of the electrophotographic photosensitive member, was not sufficiently suppressed.

As described above, the present invention can provide an electrophotographic photosensitive member which has high abrasion resistance and which is difficult cause the image deletion and a process cartridge and an electrophotographic apparatus having the electrophotographic photosensitive member.

Moreover, the present invention can provide a condensed polycyclic aromatic compound with high chemical stability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An electrophotographic photosensitive member comprising:

a support; and a photosensitive layer provided on the support, wherein a surface layer of the electrophotographic photosensitive member contains a polymerized product of a hole transporting compound, the hole transporting compound comprises:

a polymerizable functional group, and a structure other than the polymerizable functional group, wherein the structure other than the polymerizable functional group consists of:

one or more carbon atoms, one or more hydrogen atoms, and one or more halogen atoms; or one or more carbon atoms, one or more hydrogen atoms, one or more oxygen atoms, and one or more halogen atoms, the structure other than the polymerizable functional group consists of two or more and four or less condensed polycyclic structures in one molecule of the hole transporting compound, the condensed polycyclic structures are connected to each other by a single bond, the condensed polycyclic structure is one of a fluorine structure, an anthracene structure, a phenanthrene structure, a fluoranthene structure, and a pyrene structure, and wherein the polymerizable functional group is one of an acryloyloxy group and a methacryloyloxy group.

2. The electrophotographic photosensitive member according to claim 1, wherein the hole transporting compound is a compound represented by the following formula (1), (1)

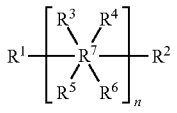

in which a hydrogen atom is replaced with the polymerizable functional group, wherein $R^1$ to $R^6$ each independently represent a hydrogen atom, a halogen atom, a substituted or unsubstituted alkyl group, a substituted or unsubstituted alkoxy group, a substituted or unsubstituted aralkyl group, or a substituted or unsubstituted aryl group;

$R^7$ represents a hexavalent group derived from substituted or unsubstituted arene by removing six hydrogen atoms;

the arene represented by $R^7$ in the formula (1) is one of benzene, naphthalene fluorene, anthracene, phenanthrene, fluoranthene, and pyrene; and n represents an integer of 2 to 4, partial structures each represented by the following formula (2) in the formula (1) above may be identical to or different from each other (2)

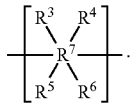

3. The electrophotographic photosensitive member according to claim 1, wherein the halogen atom of the hole transporting compound is a fluorine atom.

4. The electrophotographic photosensitive member according to claim 1, wherein the hole transporting compound has an alkyl fluoride group.

5. The electrophotographic photosensitive member according to claim 1, wherein a molecular weight of the hole transporting compound is 300 or more and 3,000 or less.

6. A process cartridge, which integrally supports the electrophotographic photosensitive member according to claim 1 and at least one device selected from the group consisting of a charging device, a developing device, a transfer device, and a cleaning device, and which is detachably mountable to a main body of an electrophotographic apparatus.

7. An electrophotographic apparatus, comprising:

the electrophotographic photosensitive member according to claim 1; a charging device; an exposing device; a developing device; and a transfer device.

8. The electrophotographic photosensitive member according to claim 1, wherein the hole transporting compound is selected from the group consisting of compounds represented by any one of the following formulae (No. 1) to (No. 93)

(No. 1)

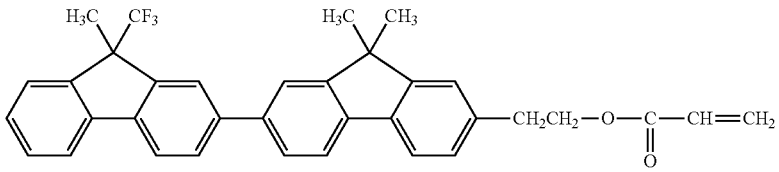

(No. 2)

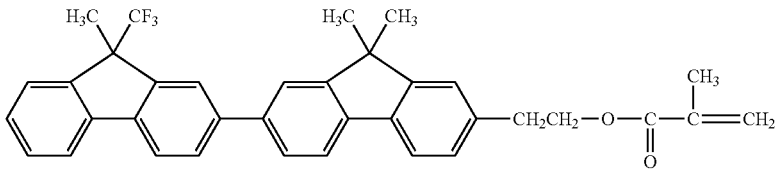

-continued
(No. 3)
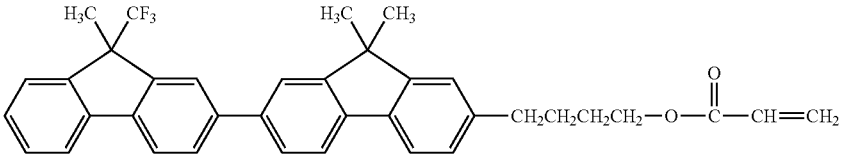
(No. 4)
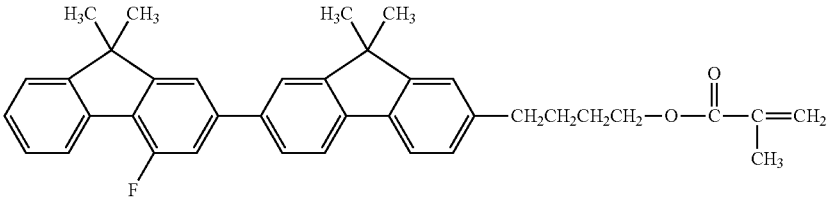
(No. 5)
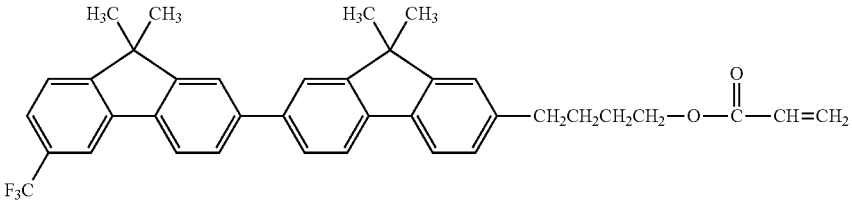
(No. 6)
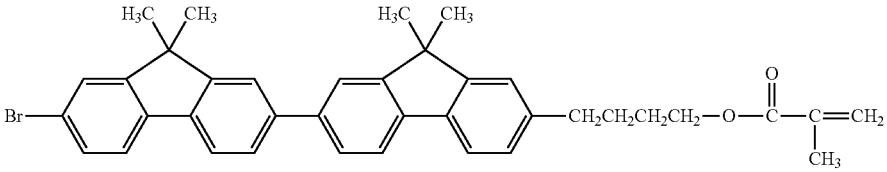
(No. 7)
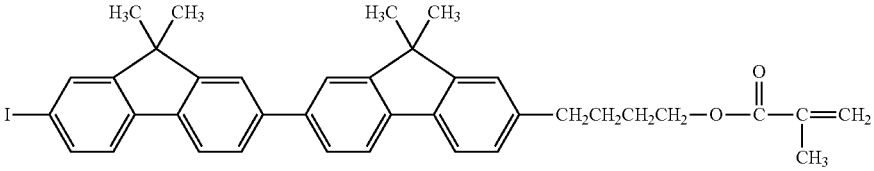
(No. 8)
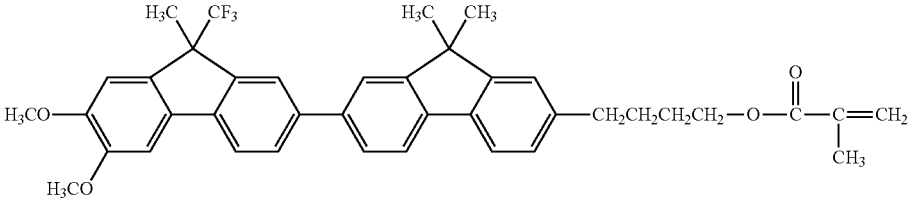
(No. 9)
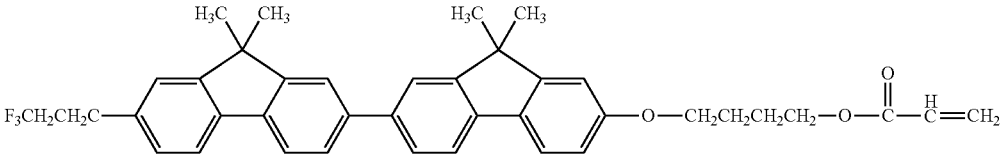
(No. 10)
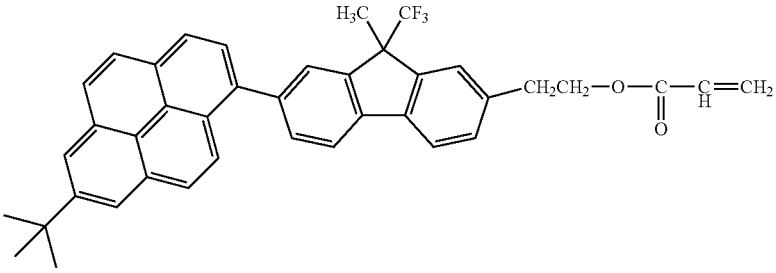

-continued
(No. 11)
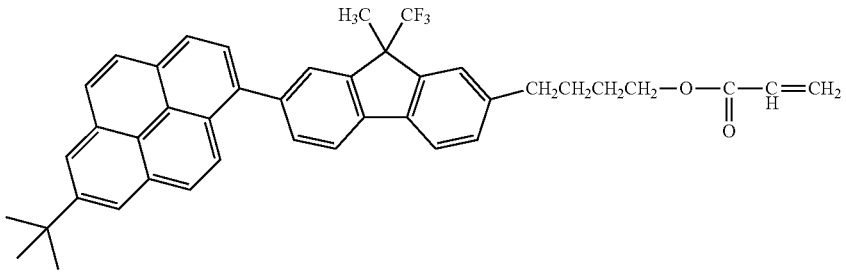
(No. 12)
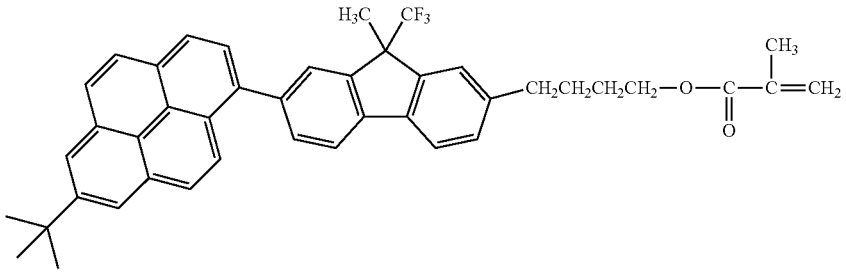
(No. 13)
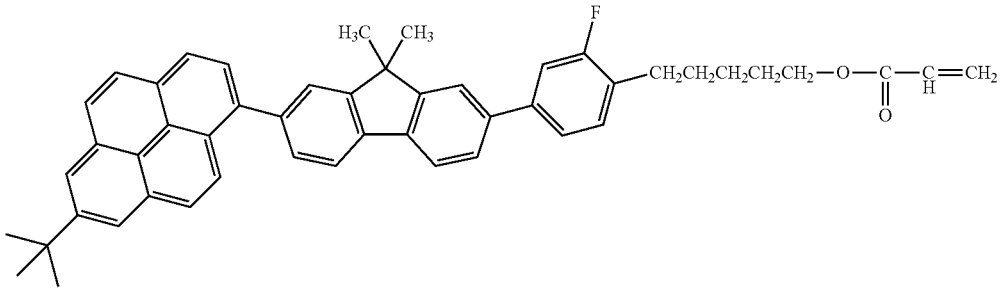
(No. 14)
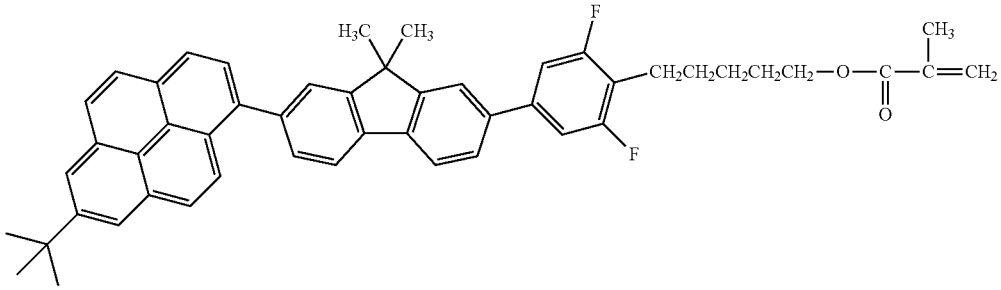
(No. 15)
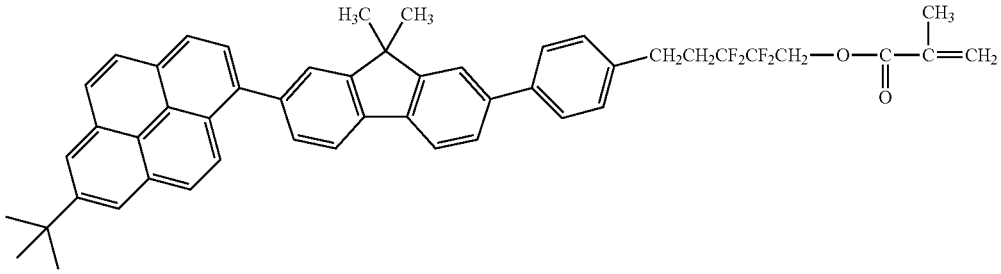

-continued
(No. 16)
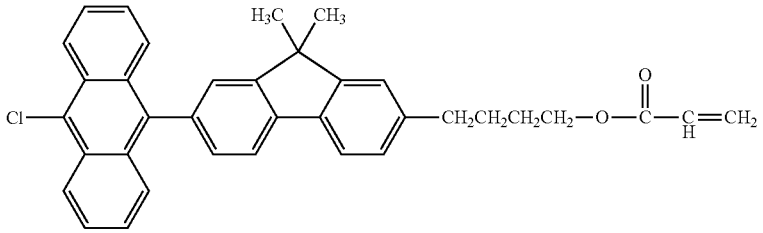
(No. 17)
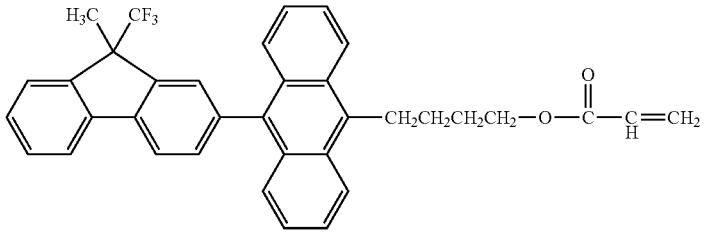
(No. 18)
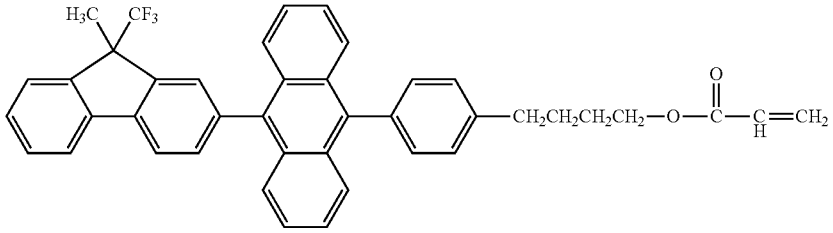
(No. 19)
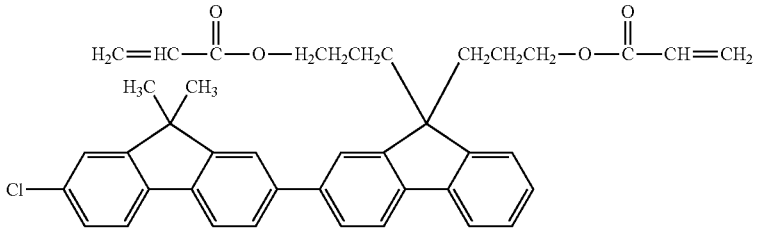
(No. 20)
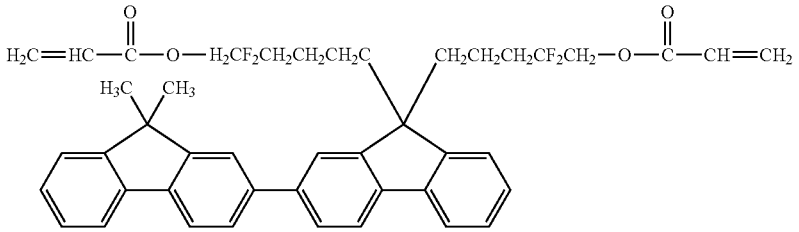
(No. 21)
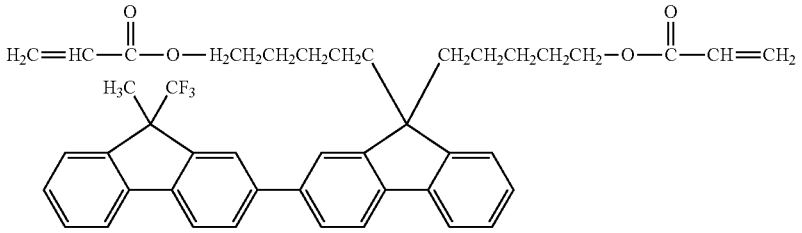

-continued
(No. 22)
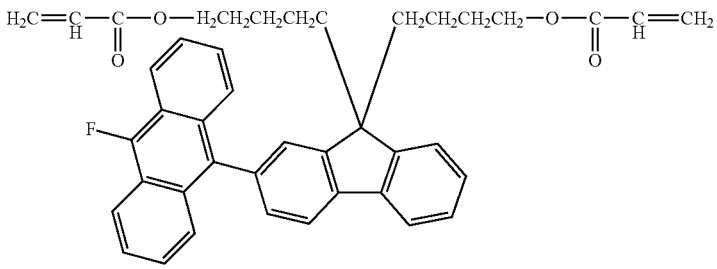
(No. 23)
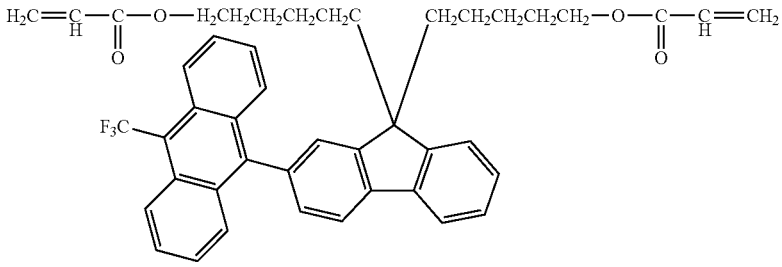
(No. 24)
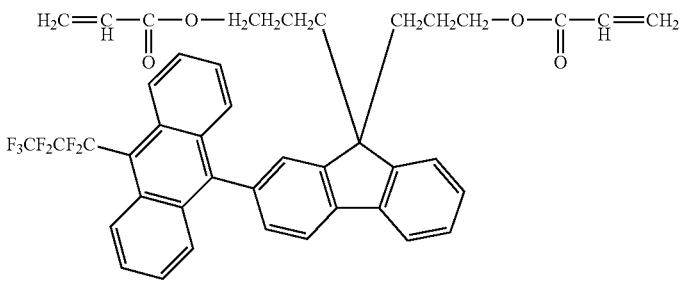
(No. 25)
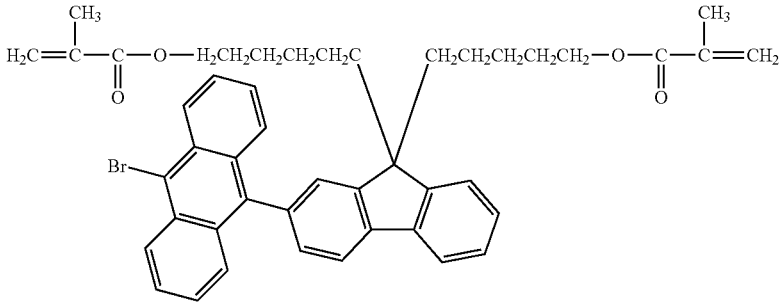
(No. 26)
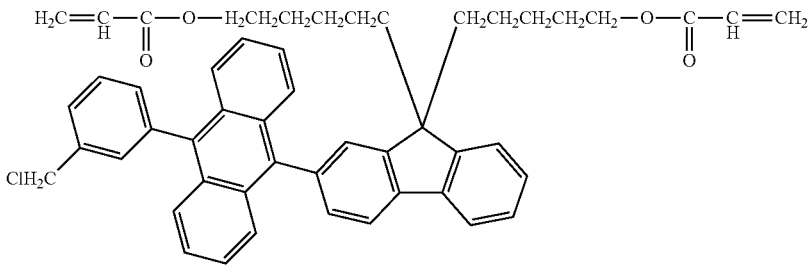

-continued
(No. 27)
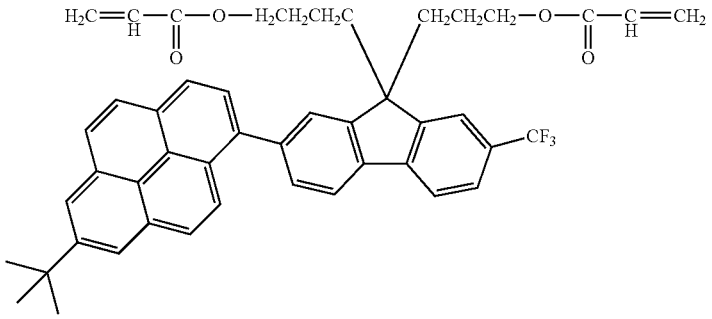
(No. 28)
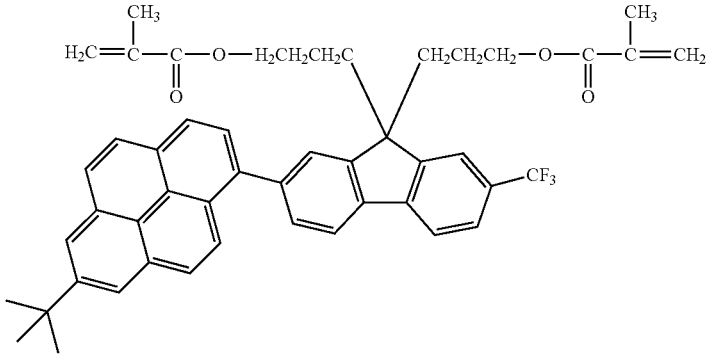
(No.29)
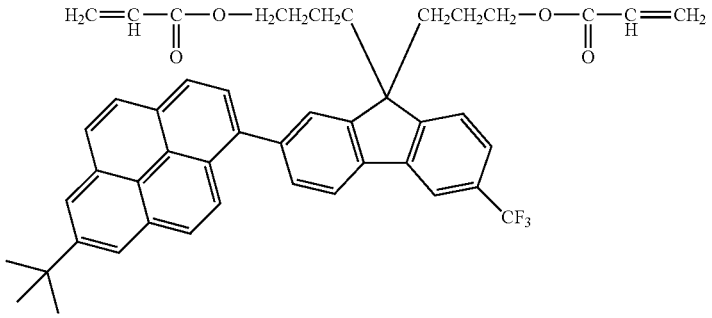
(No.30)
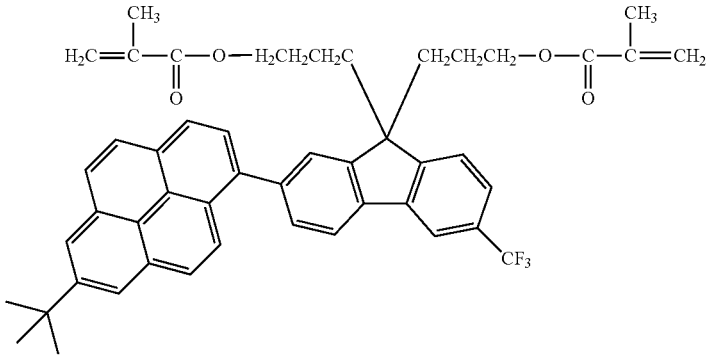

-continued
(No. 31)
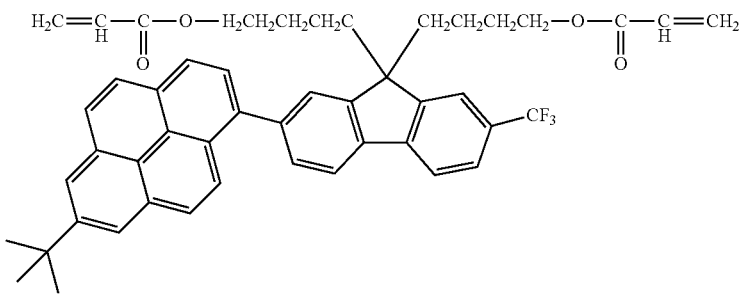
(No. 32)
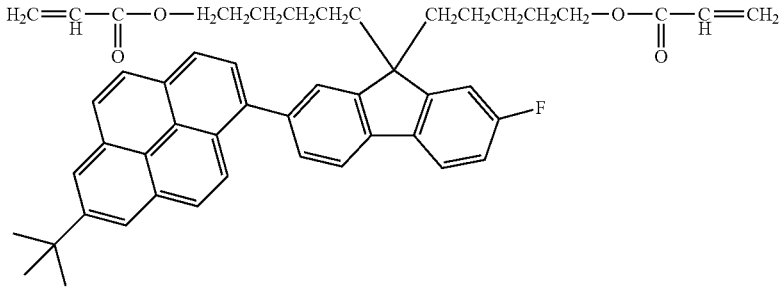
(No. 33)
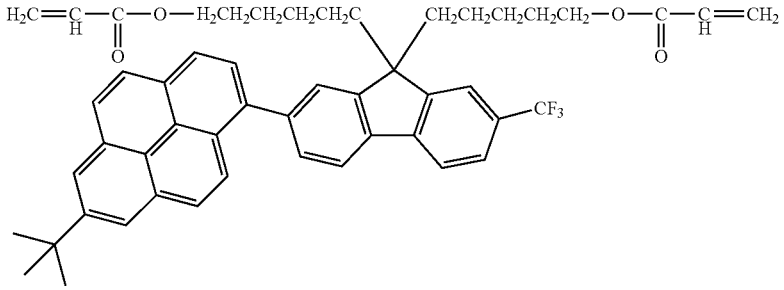
(No. 34)
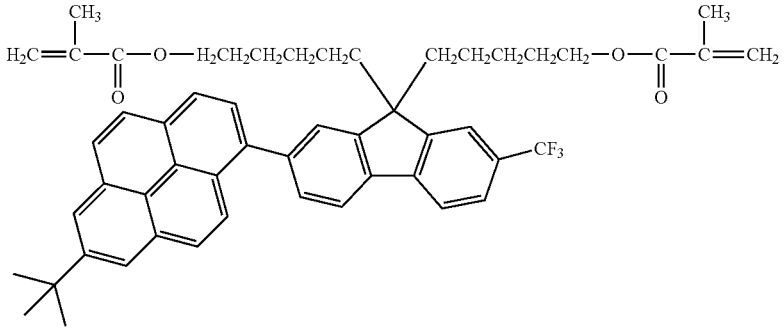
(No. 35)
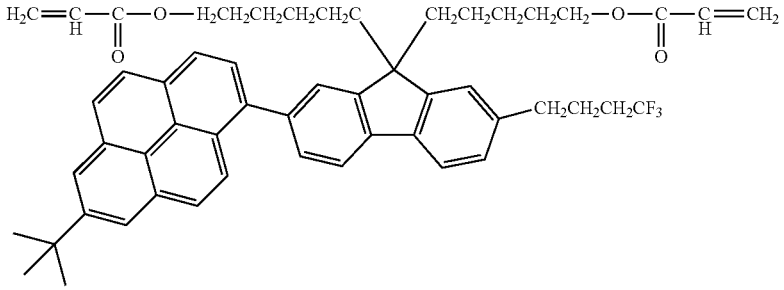

-continued
(No. 36)
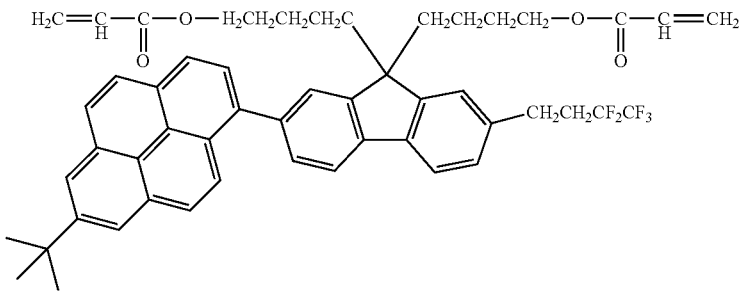
(No. 37)
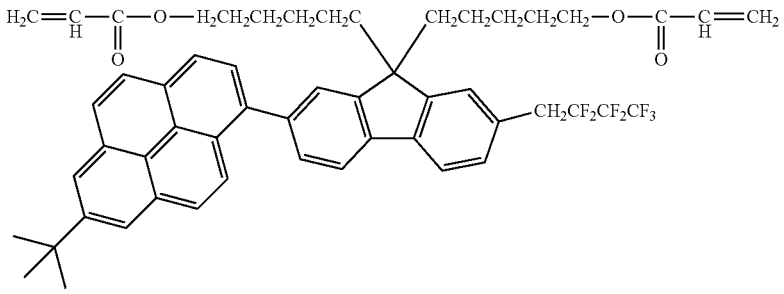
(No. 38)
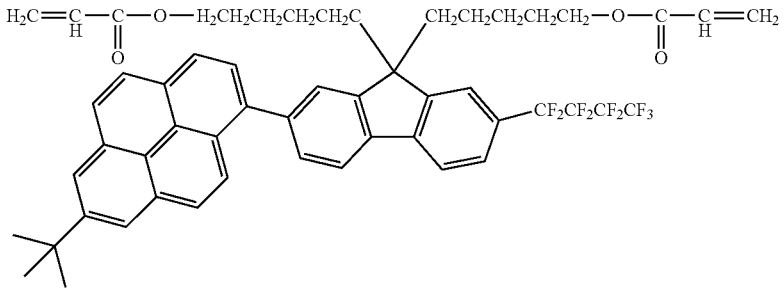
(No. 39)
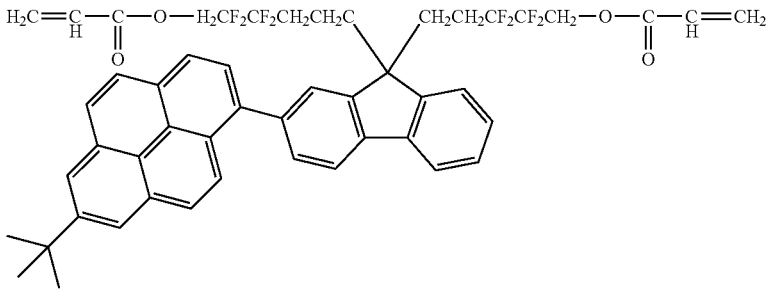
(No. 40)
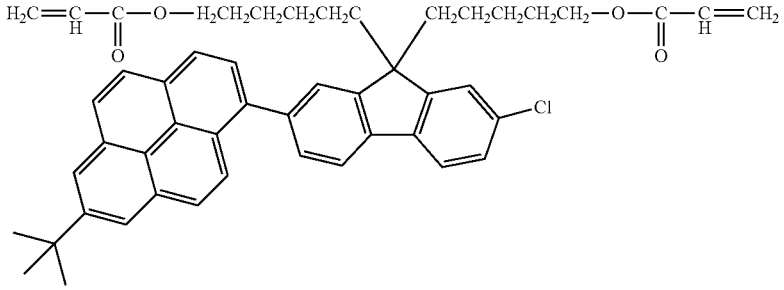

-continued
(No. 41)
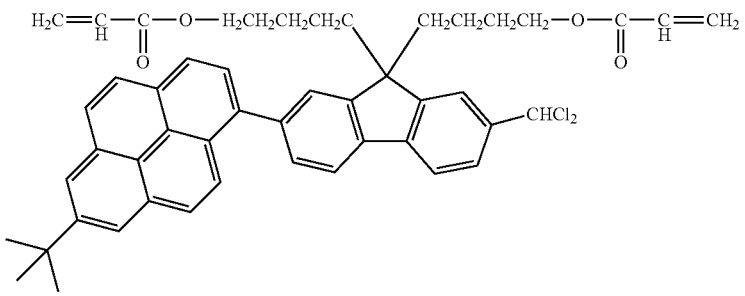
(No. 42)
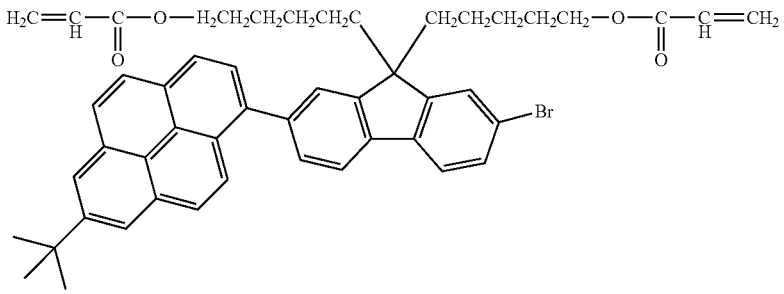
(No. 43)
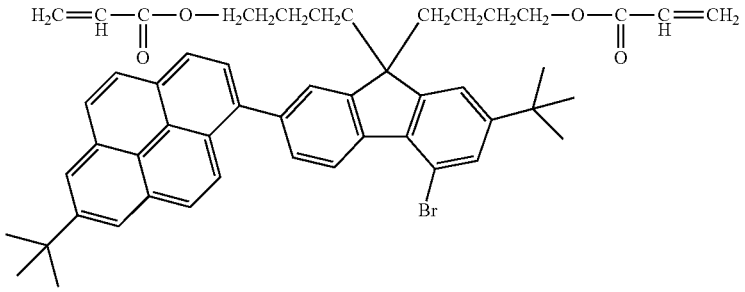
(No. 44)
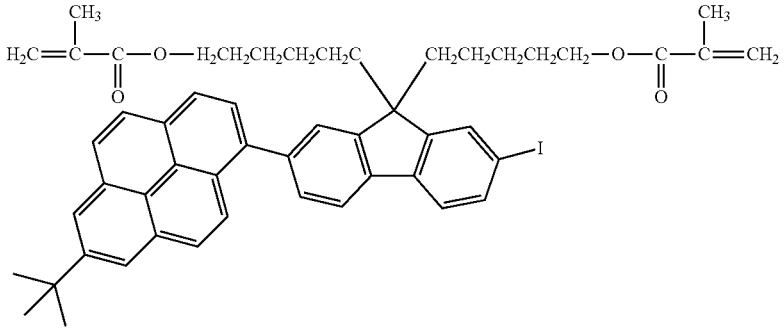
(No. 45)
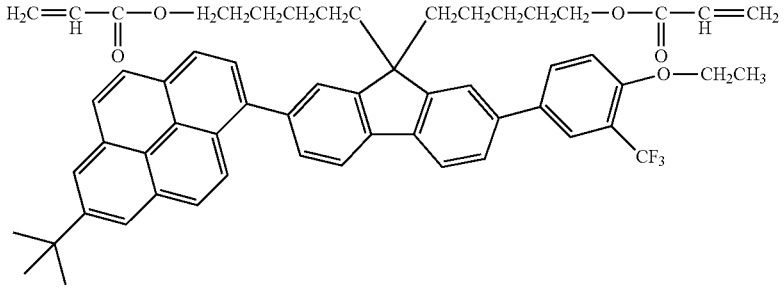

-continued
(No. 46)
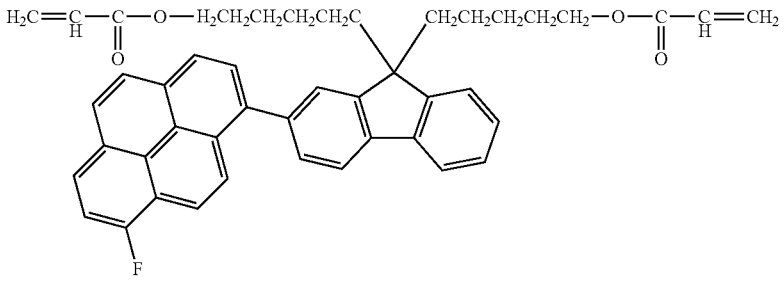
(No. 47)
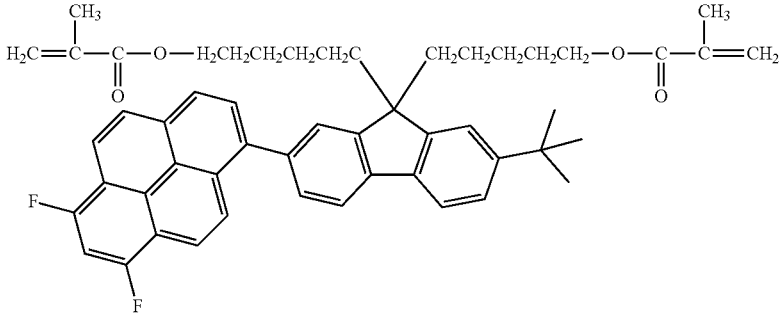
(No. 48)
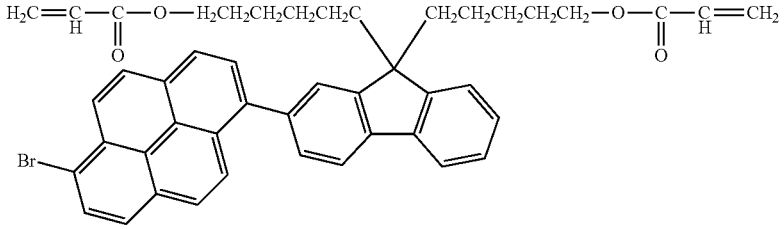
(No. 49)
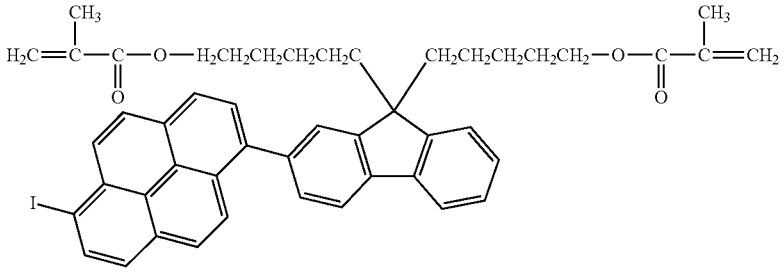
(No. 50)
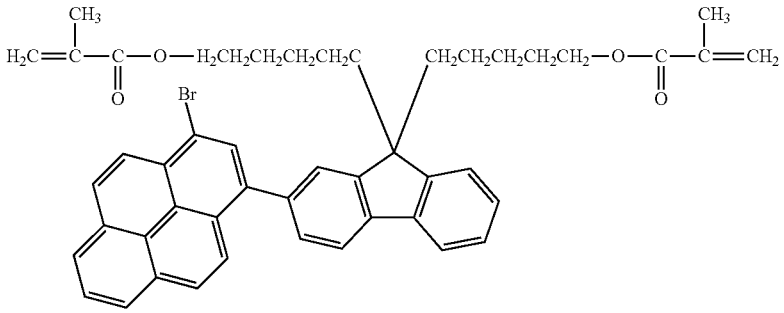

-continued
(No. 51)
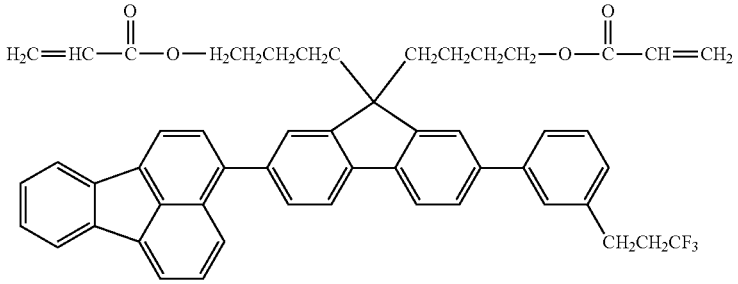
(No. 52)
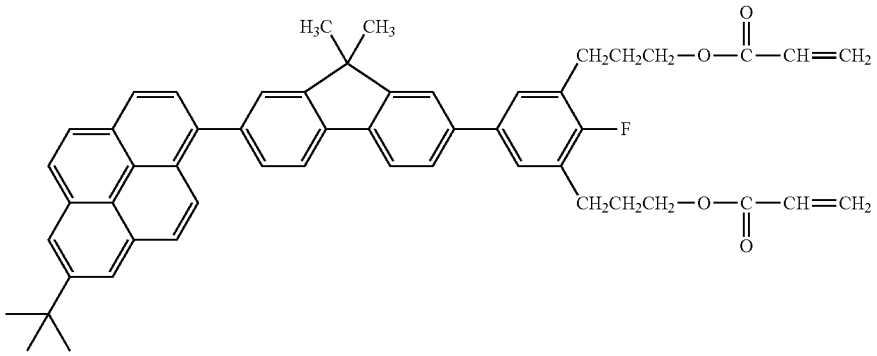
(No. 53)
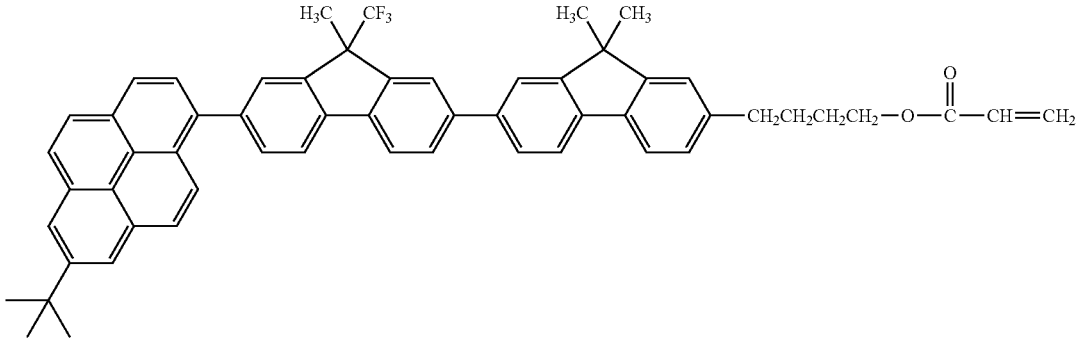
(No. 54)
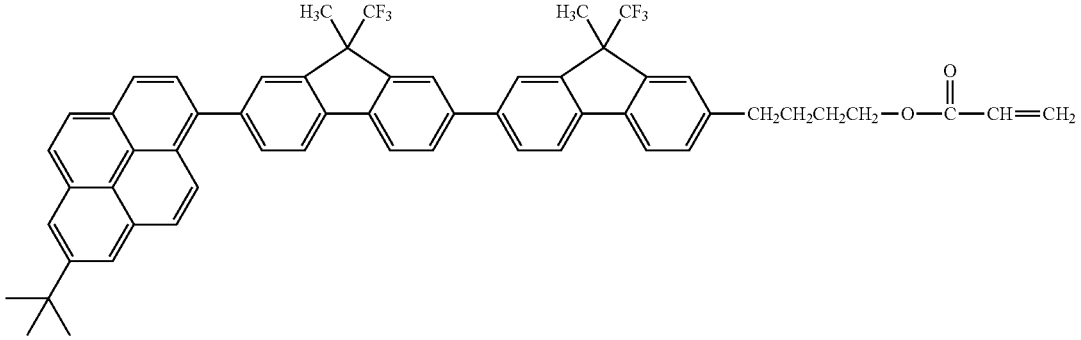
(No. 55)
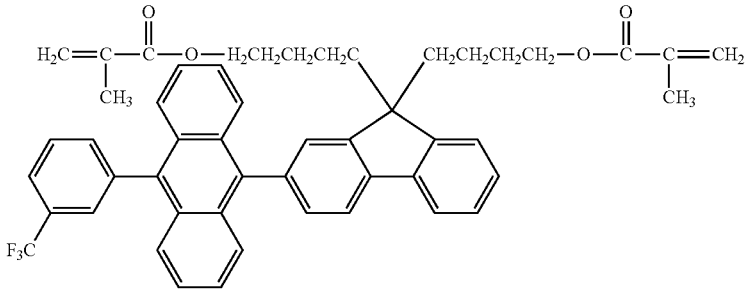

-continued
(No. 56)
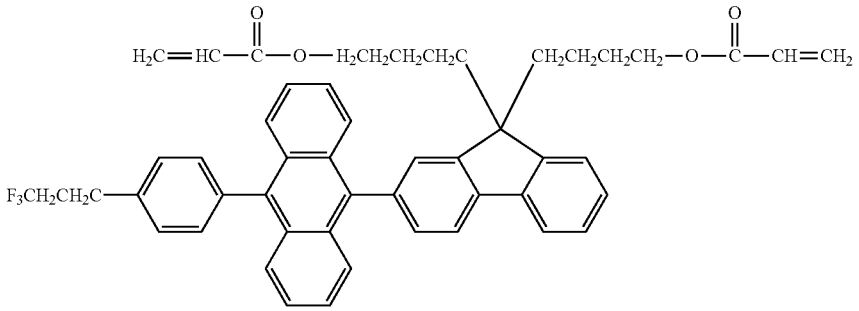
(No. 57)
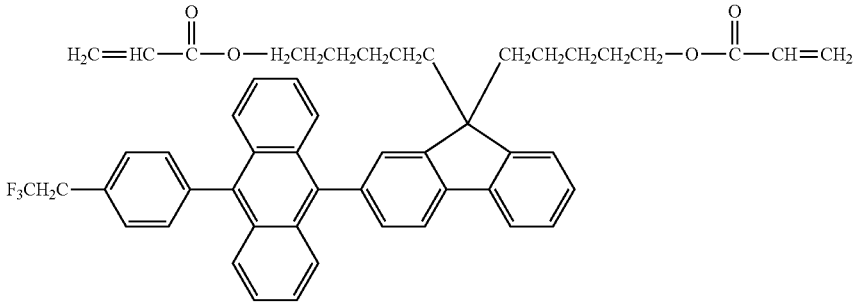
(No. 58)
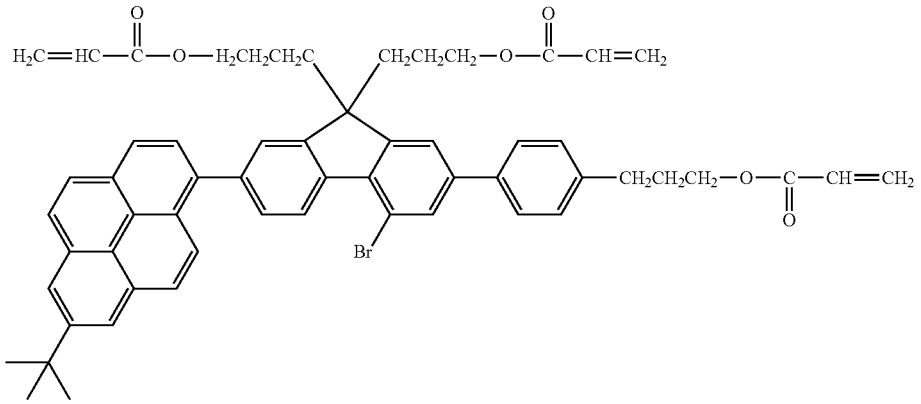
(No. 59)
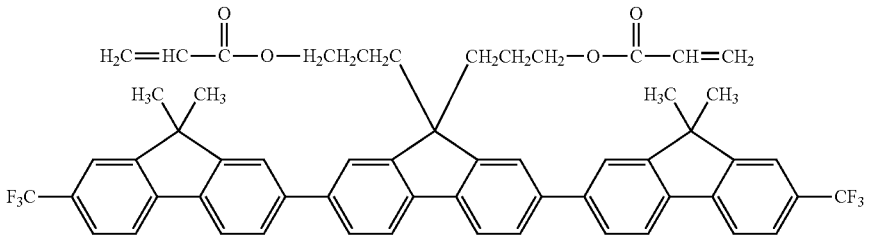
(No. 60)
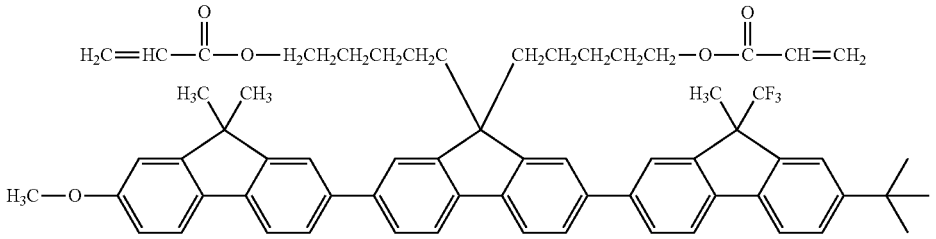

-continued
(No. 61)
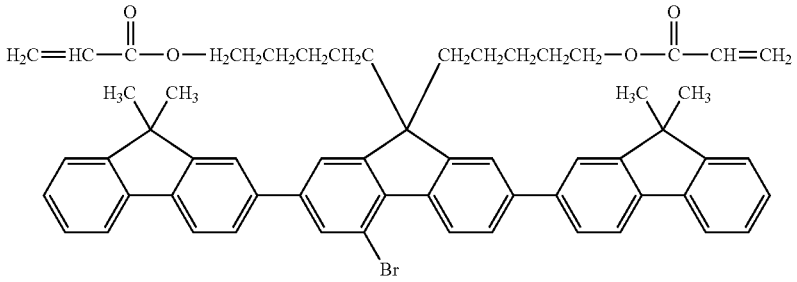
(No. 62)
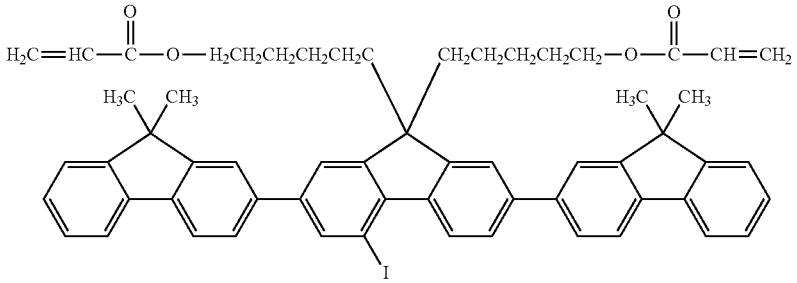
(No. 63)
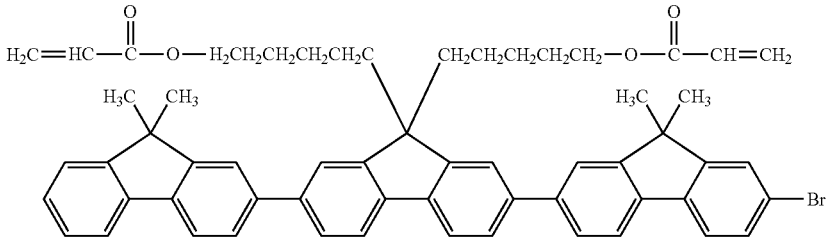
(No. 64)
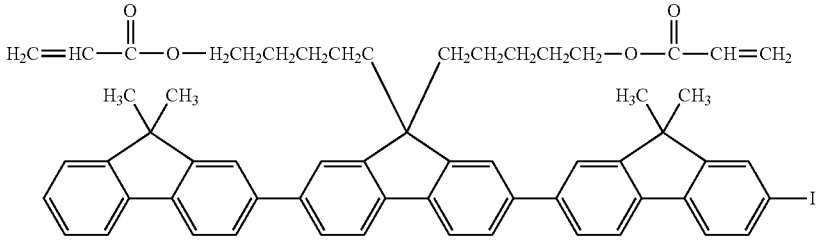
(No. 65)
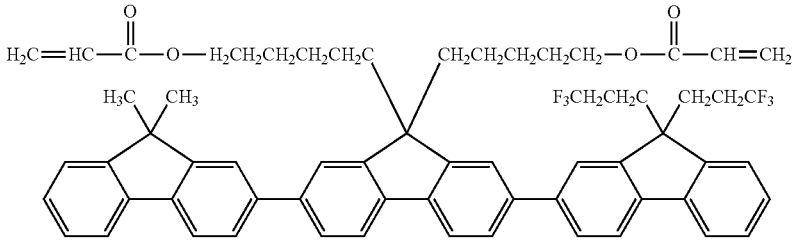
(No. 66)
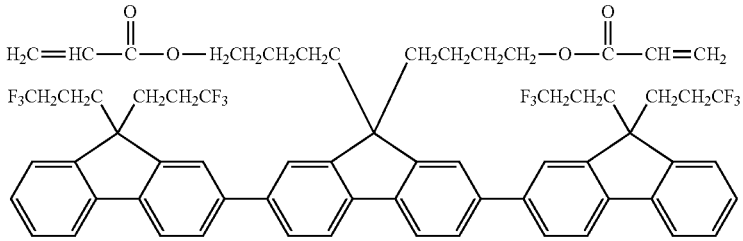

-continued
(No. 67)
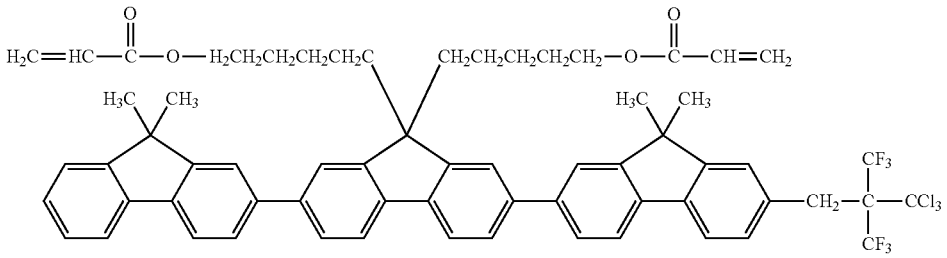
(No. 68)
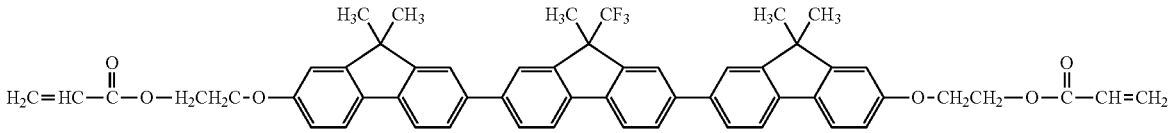
(No. 69)
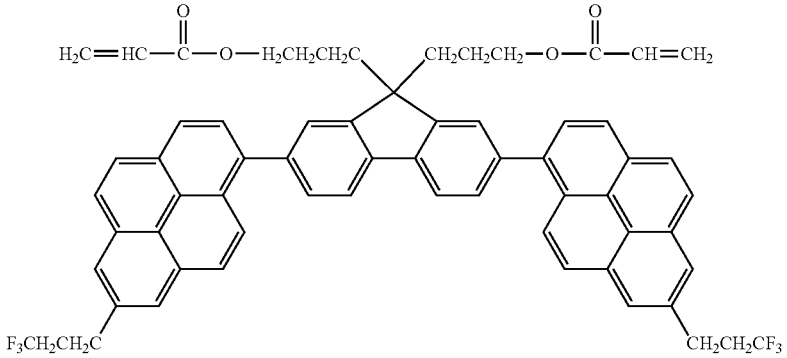
(No. 70)
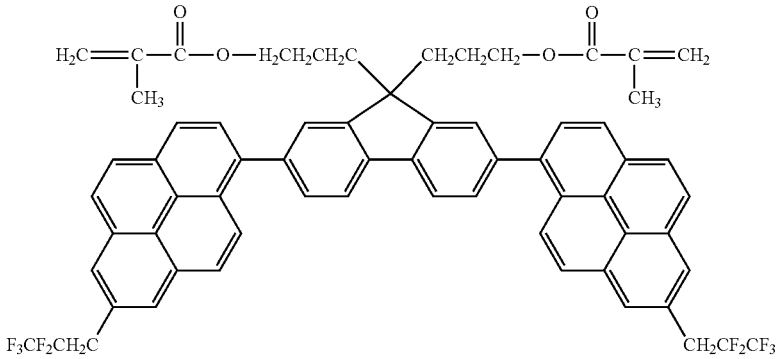
(No. 71)
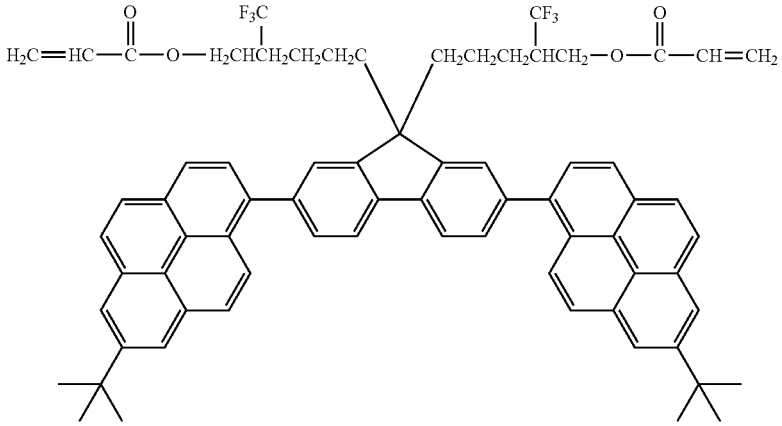

-continued
(No. 72)
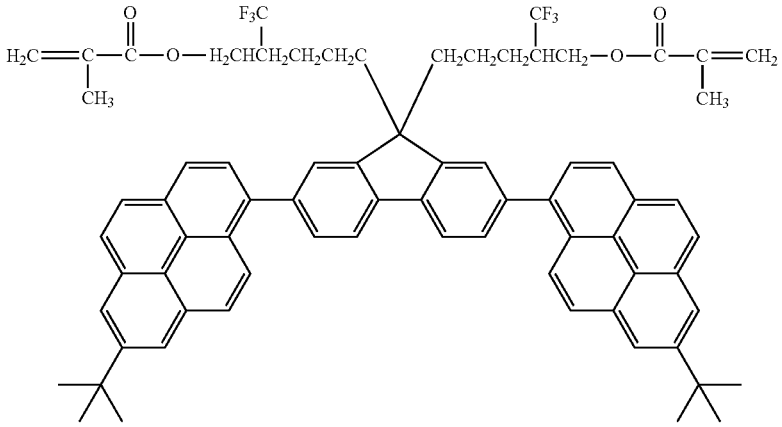
(No. 73)
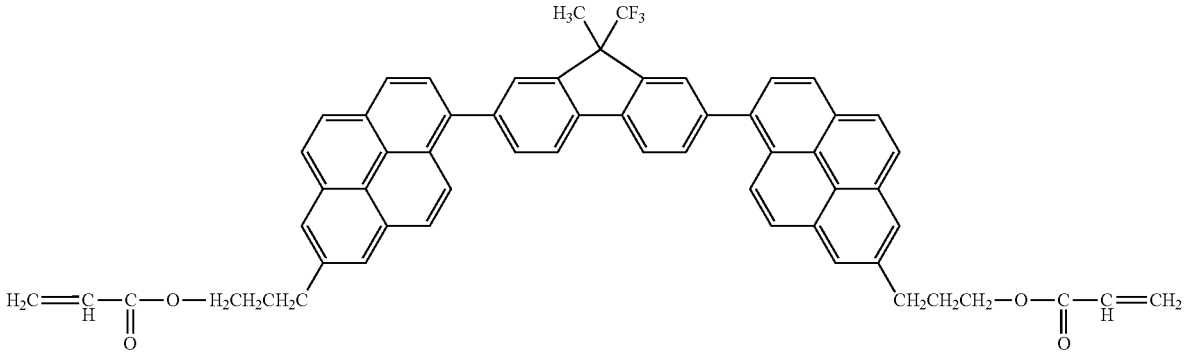
(No. 74)
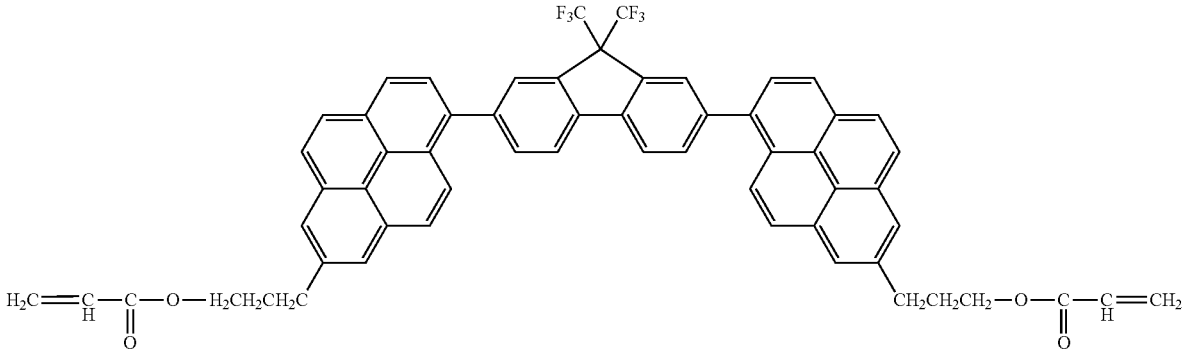
(No. 75)
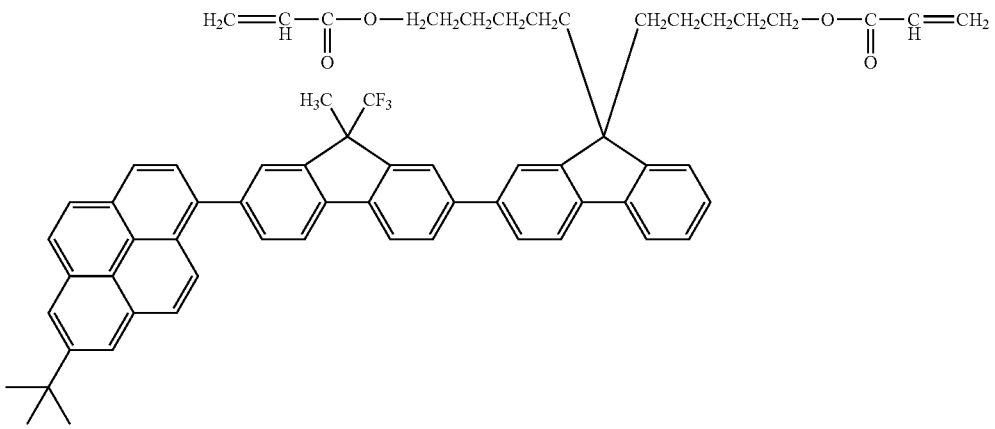

-continued
(No. 76)
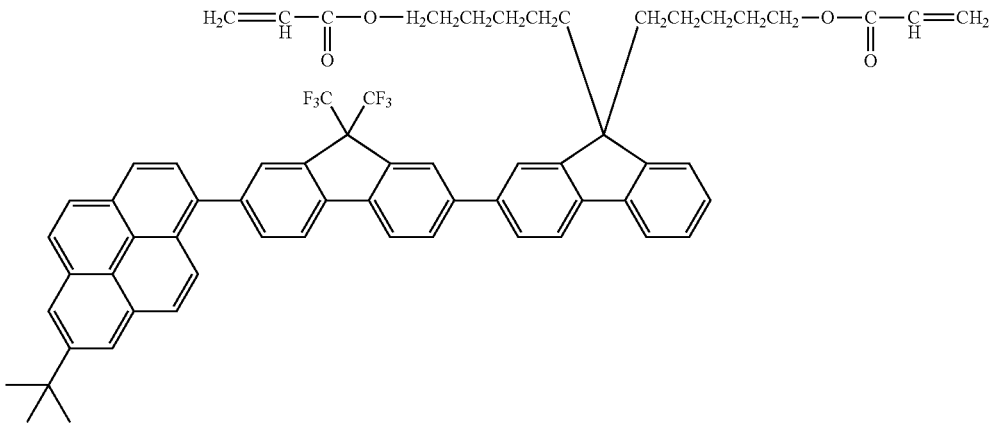
(No. 77)
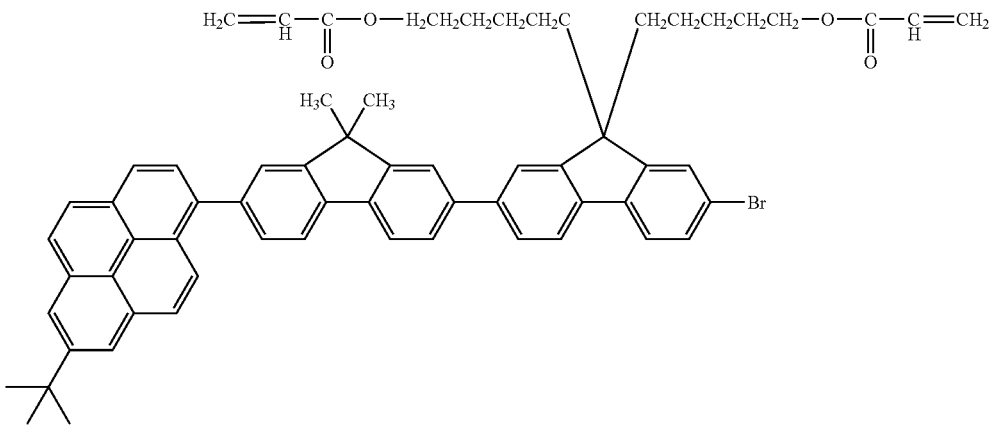
(No. 78)
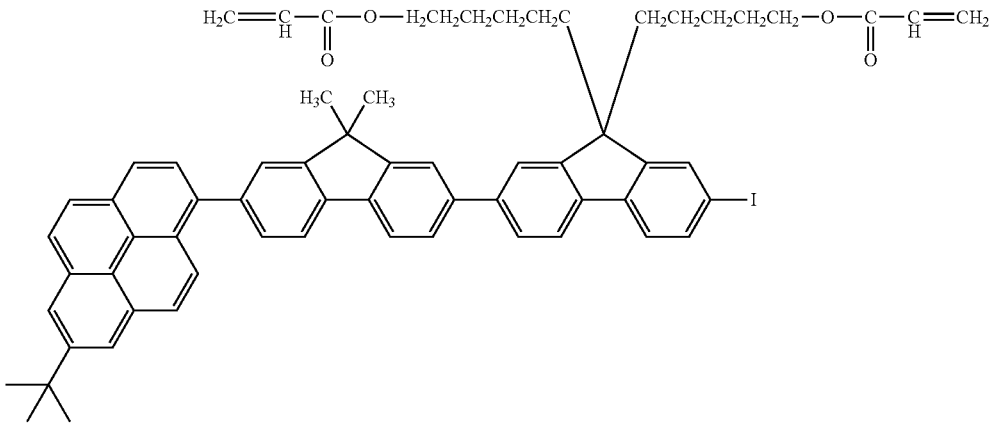

-continued
(No. 79)
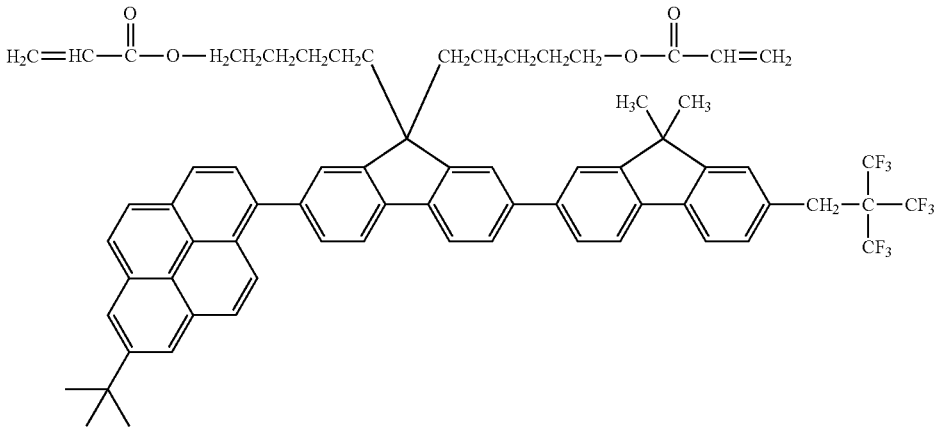
(No. 80)
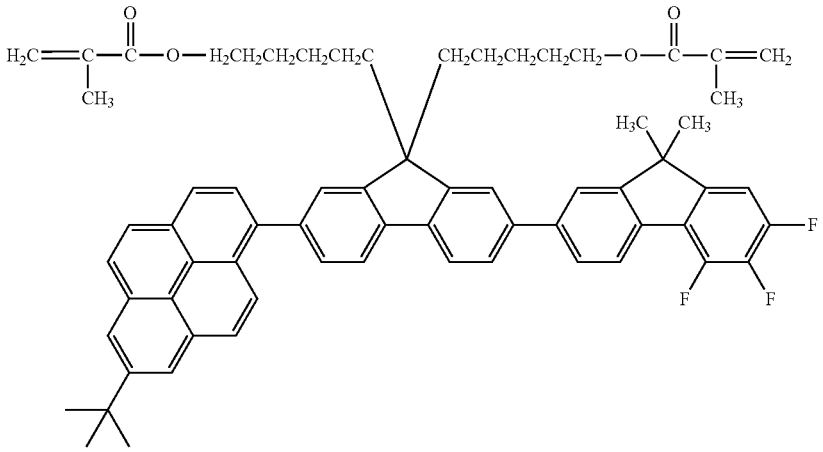
(No. 81)
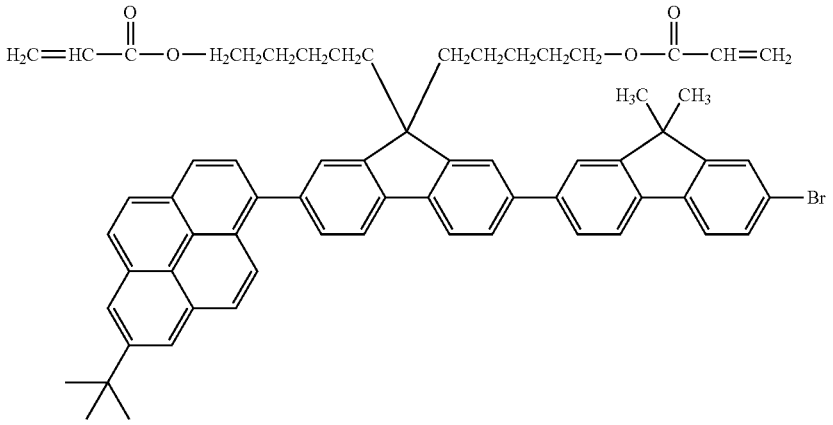

-continued
(No. 82)
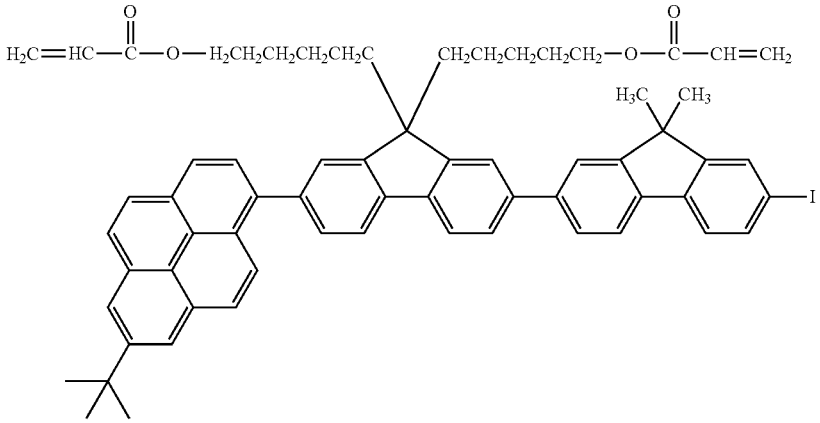
(No. 83)
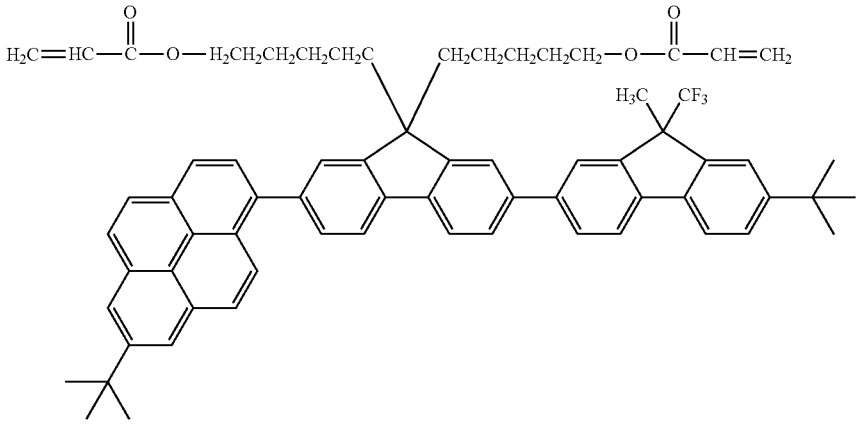
(No. 84)
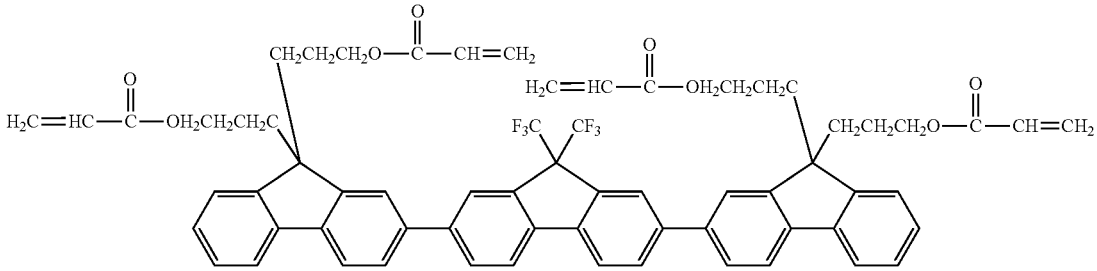
(No. 85)
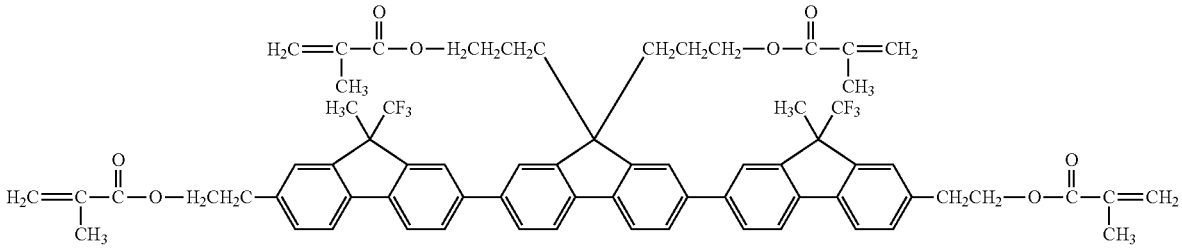

-continued
(No. 86)
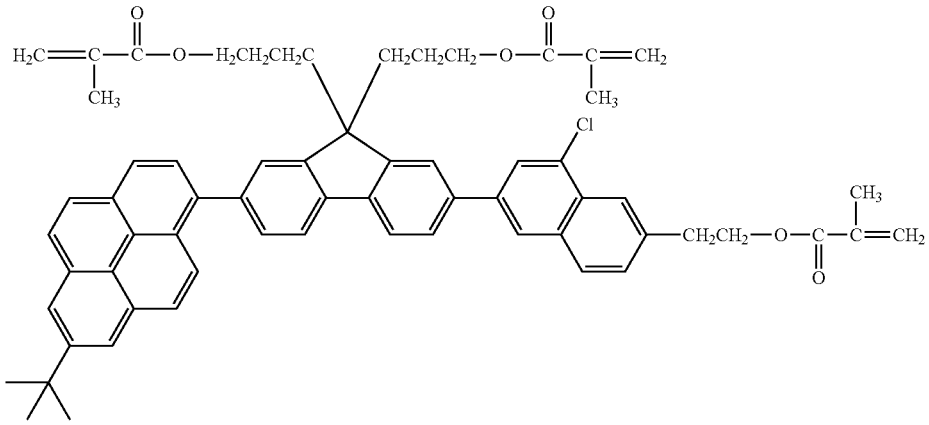
(No. 87)
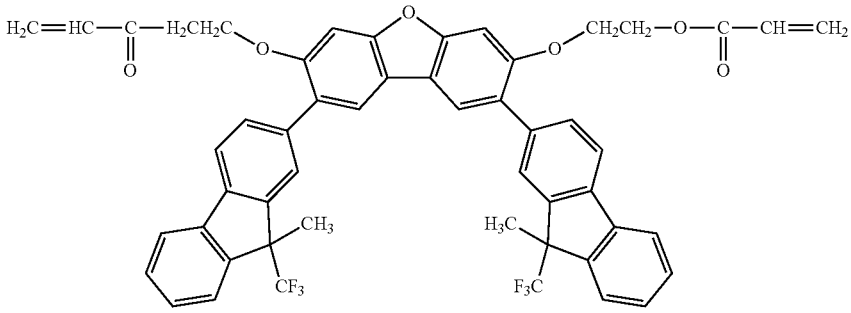
(No. 88)
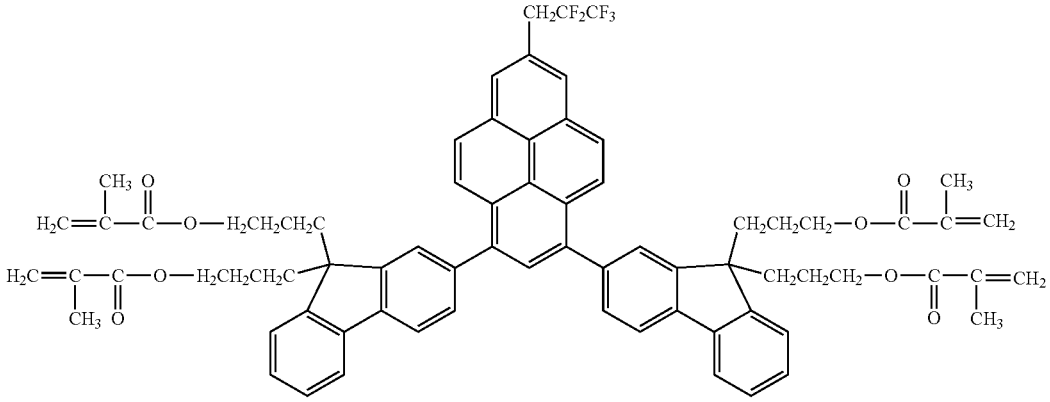
(No. 89)
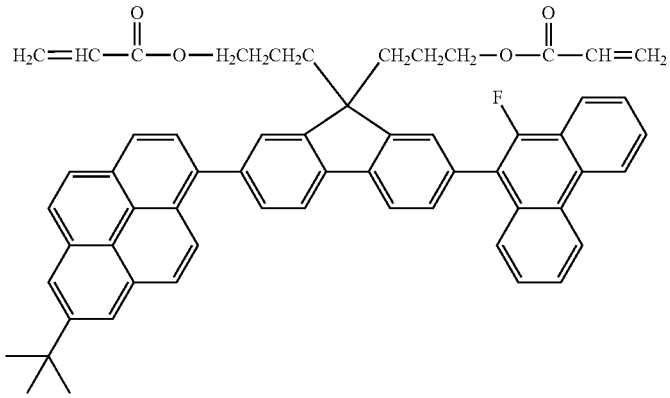

-continued
(No. 90)
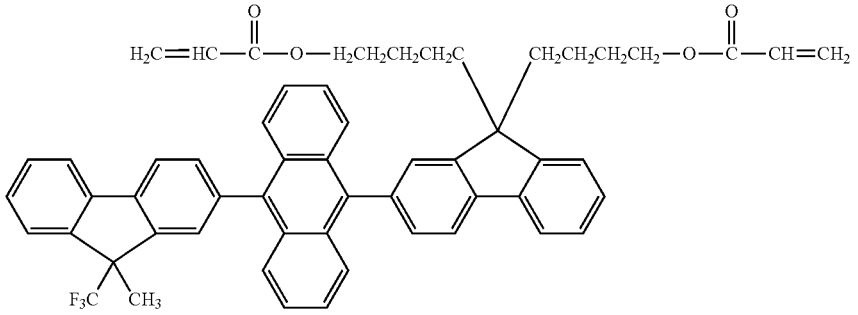
(No. 91)
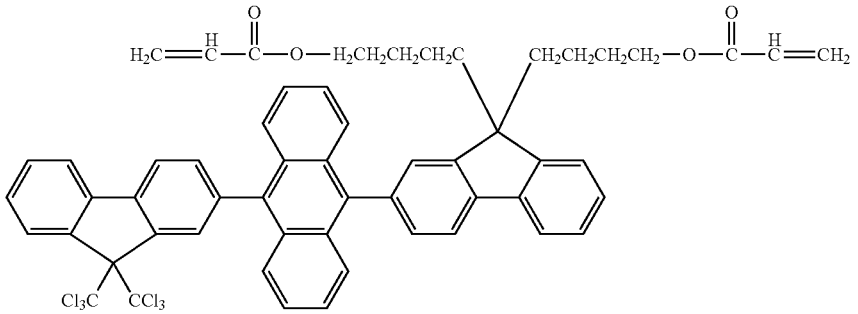
(No. 92)
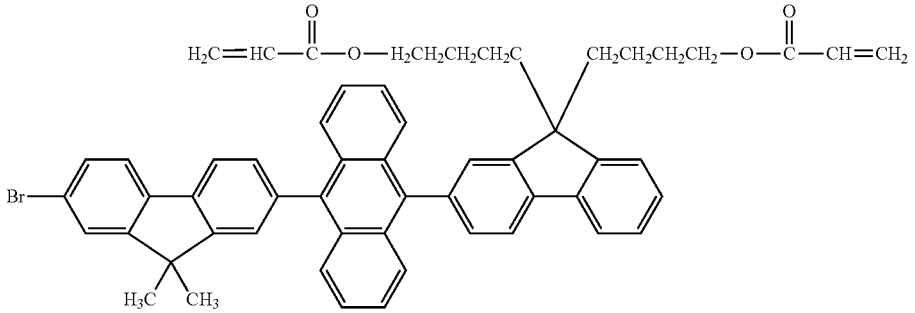
(No. 93)
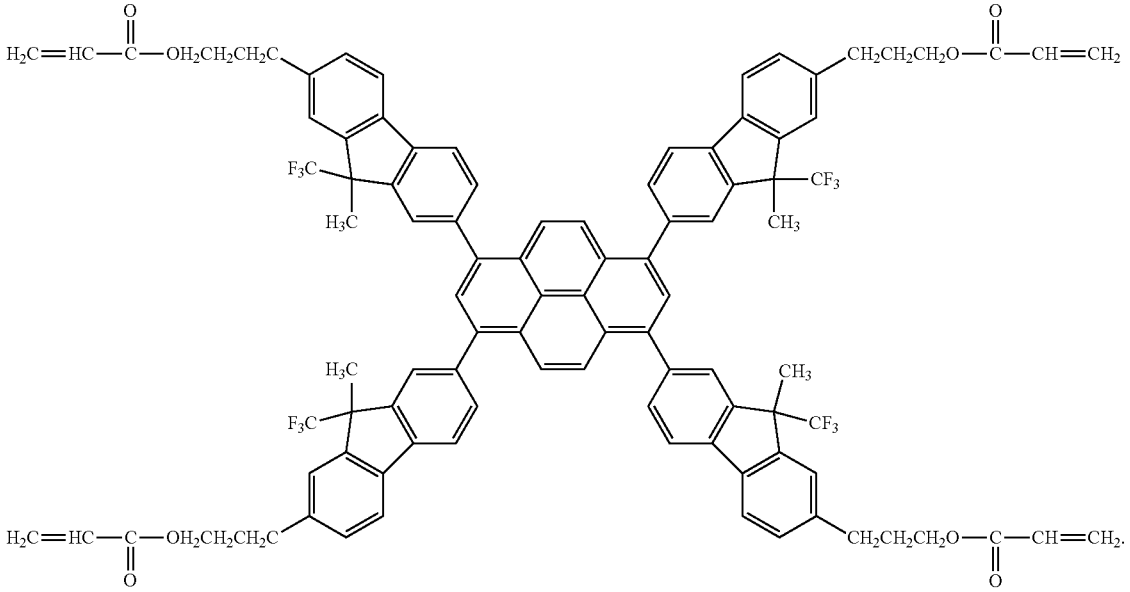
* * * * *